US007474865B2

(12) United States Patent
Chiba et al.

(10) Patent No.: US 7,474,865 B2
(45) Date of Patent: Jan. 6, 2009

(54) IMAGE FORMING APPARATUS AND METHOD FOR SEPARATING CONTAMINANT FROM BLADE FOR CLEANING TRANSFER BELT SURFACE

(75) Inventors: Satoshi Chiba, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 11/533,264

(22) Filed: Sep. 19, 2006

(65) Prior Publication Data

US 2007/0071486 A1 Mar. 29, 2007

(30) Foreign Application Priority Data

Sep. 27, 2005 (JP) ..... 2005-280542
Sep. 27, 2005 (JP) ..... 2005-280543
Sep. 27, 2005 (JP) ..... 2005-280544

(51) Int. Cl.
*G03G 15/16* (2006.01)

(52) U.S. Cl. ..... 399/101; 399/345; 399/350

(58) Field of Classification Search ..... 399/98, 399/99, 101, 343, 345, 350, 351
See application file for complete search history.

(56) References Cited

U.S. PATENT DOCUMENTS 5,905,013 A * 5/1999 Seto ..... 430/125.3
5,970,282 A * 10/1999 Yanagida et al. ..... 399/101
6,529,695 B2 * 3/2003 Katayanagi et al. ..... 399/49
2003/0053819 A1 3/2003 Nomura et al. ..... 399/110

FOREIGN PATENT DOCUMENTS

JP 2003-015378 1/2003
JP 2004-102178 4/2004

OTHER PUBLICATIONS

Japanese Patent Application No. 2003-015378 corresponds to the U.S. Publication No. 2003/0053819 A1.

* cited by examiner

*Primary Examiner*—Hoan H Tran
(74) *Attorney, Agent, or Firm*—Hogan & Hartson LLP

(57) ABSTRACT

An image forming apparatus includes a transfer belt stretched around driving and blade opposing rollers. The blade opposing roller is biased in a bias direction away from the driving roller by a biasing member and has a cleaning blade in contact with the belt. In a color mode, the belt is thrust against multiple image forming stations using multiple transfer members. In a monochromatic model, the belt is thrust against only a monochromatic image forming station using a monochromatic transfer member and other transfer members are moved away from the image forming stations. The belt is brought into a thrust-condition after completion of the monochromatic mode to be thrust against multiple image forming stations; and is then released to bring the blade opposing roller into following rotation in the opposite direction of the transport direction so that the blade opposing roller is biased in the bias direction.

19 Claims, 32 Drawing Sheets

IMAGE FORMING APPARATUS AND METHOD FOR SEPARATING CONTAMINANT FROM BLADE FOR CLEANING TRANSFER BELT SURFACE

CROSS REFERENCE TO RELATED ART

The disclosure of Japanese Patent Applications enumerated below including specification, drawings and claims is incorporated herein by reference in its entirety:

No. 2005-280542 filed Sep. 27, 2005;

No. 2005-280543 filed Sep. 27, 2005; and

No. 2005-280544 filed Sep. 27, 2005.

BACKGROUND

1. Technical Field

The present invention relates to a tandem-type image forming apparatus including a cleaner blade holding its distal end in contact against a surface of a moving transfer belt for cleaning the belt surface, and to an image forming method for the apparatus.

2. Related Art

A so-called tandem-type image forming apparatus is known as an image forming apparatus such as copiers, printers and facsimiles. JP A-2003-015378 is an example of related art. According to JP A-2003-015378, the tandem-type image forming apparatus includes a plurality of image forming stations arranged along the transfer belt transported in a predetermined direction, the image forming stations individually forming toner images of mutually different colors. Such an image forming apparatus forms a color image by superimposing the toner images on the surface of the transfer belt, the toner images formed by the respective image forming stations in mutually different colors. The color image formed on the belt surface is transferred to a transfer medium such as paper.

In some cases, such an image forming apparatus may be provided with the cleaner blade for removing toner remaining on the surface of the transfer belt. Such a cleaner blade holds its distal end in contact against the surface of the transfer belt transported in the predetermined direction, thereby removing the residual toner from the transfer belt surface.

Besides the above residual toner, however, contaminant such as powdery paper may sometimes adhere to the surface of the transfer belt. Similarly to the residual toner, the contaminant may be mostly removed from the transfer belt surface by means of the cleaner blade. However, some of the contaminant may sometimes adhere to the distal end of the cleaner blade so as to be caught between the distal end of the cleaner blade and the transfer belt surface. As a result, a clearance is formed between the cleaner blade and the transfer belt surface, so that an adequate removal of the residual toner may not be achieved because the residual toner is allowed to pass through the clearance.

JP A-2004-102178, for example, also points out the aforementioned problem encountered by the constitution wherein the cleaner blade is pressed against an image carrier such as the transfer belt moved in the predetermined direction, thereby cleaning the surface of the image carrier. According to JP A-2004-102178, a rotational direction of the image carrier is controlled to overcome the above problem. Specifically, the image carrier is rotated in the opposite direction of a direction in which the image carrier is rotated during the image formation. The image carrier is driven in the opposite direction for moving the contaminant caught between the surface of the image carrier and the distal end of the cleaner blade to an upstream side of the rotational direction for image formation, whereby the contaminant is separated from the distal end of the cleaner blade.

SUMMARY

However, in a case where the art according to JP A-2004-102178 is applied to the apparatus using the cleaner blade for cleaning the transfer belt surface, a reverse rotation mechanism must be added to a drive system of the transfer belt so that the drive system is complicated in structure. This leads to the increase of cost and size of the apparatus.

An advantage of some aspects of the invention is to provide a technique for effectively separating the contaminant adhered to the cleaner blade by means of a more simplified structure, achieving the reduction of cost and size of the apparatus.

A method according to the first aspect of the invention is an image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; and M transfer members disposed in one-on-one relation with the M image forming stations and each of which individually opposes the corresponding image forming station via the transfer belt, the image forming method comprising: performing a color mode or a monochromatic mode, selectively, the color mode in which the transfer belt is thrust against the M image forming stations with positioning the M transfer members in adjacency to the image forming stations, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member and with moving (M−1) color transfer member(s) away from the image forming stations, the (M−1) color transfer member(s) defined by excluding the monochromatic transfer member from the M transfer members, so that only the toner image formed by the monochromatic image forming station is primarily transferred to the surface of the transfer belt to form monochromatic images; bringing the transfer belt into a thrust-condition, as needed after completion of the monochromatic mode, with being positioned N, where N is integer which is equal to or smaller than (M−1) and which is equal to or larger than 1, color transfer member(s) out of the (M−1) color transfer members in adjacency to the image forming stations, the thrust-condition in which the transfer belt is thrust against the image forming stations; and releasing the transfer belt from the thrust-condition with moving the N color transfer member(s), which is/are positioned in adjacency to the image forming stations by the thrusting, away from the image forming stations so as to bring the blade opposing roller into following rotation in the opposite direction of the transport direction as allowing the blade opposing roller to be moved in the bias direction by the biasing force of the biasing member.

A method according to the second aspect of the invention is an image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and an upstream guide roller which is disposed inside the transfer belt on the upstream side of the M transfer member and on the downstream side of the blade opposing roller in the transport direction, the image forming method comprising: performing a color mode or a monochromatic mode, selectively, the color mode in which the transfer belt is thrust against the M image forming stations with positioning the M transfer members in adjacency to the image forming stations and with positioning the upstream guide roller so as to stretch the transfer belt by the upstream guide roller, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member, with moving (M−1) color transfer member(s) away from the image forming stations, and with moving the up stream guide roller inwardly of the transfer belt from the position in the color mode, the (M−1) color transfer member(s) defined by excluding the monochromatic transfer member from the M transfer members, so that only the toner image formed by the monochromatic image forming station is primarily transferred to the surface of the transfer belt to form monochromatic images; bringing the transfer belt into a thrust-condition, as needed after completion of the monochromatic mode, with positioning the upstream guide roller at the position in the color mode, the thrust-condition in which the transfer belt is thrust against the image forming stations; and releasing the transfer belt from the thrust-condition with being moved the upstream guide roller, which is positioned at the position in the color mode by the thrusting, inwardly of the transfer belt from the position in the color mode so as to bring the blade opposing roller into following rotation in the opposite direction of the transport direction as allowing the blade opposing roller to be moved in the bias direction by the biasing force of the biasing member.

An apparatus according to the third aspect of the invention is an image forming apparatus comprising: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and a controller which controls the positions of the M transfer members, wherein the controller performing a color mode or a monochromatic mode, the color mode in which the transfer belt is thrust against the M image forming stations with positioning the M transfer members in adjacency to the image forming stations, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member and with moving (M−1) color transfer member(s) away from the image forming stations, the (M−1) color transfer member(s) defined by excluding the monochromatic transfer member from the M transfer members, so that only the toner image formed by the monochromatic image forming station is primarily transferred to the surface of the transfer belt to form monochromatic images, and wherein the controller brings the transfer belt into a thrust-condition, as needed after completion of the monochromatic mode, with positioning N, where N is integer which is equal to or smaller than M−1 and which is equal to or larger than 1, color transfer member(s) out of the (M−1) color transfer members in adjacency to the image forming stations, the thrust-condition in which the transfer belt is thrust against the image forming stations, and the controller releases the transfer belt from the thrust-condition with moving the N color transfer member(s), which is/are positioned in adjacency to the image forming stations by the thrusting, away from the image forming stations so as to bring the blade opposing roller into following rotation in the opposite direction of the transport direction as allowing the blade opposing roller to be moved in the bias direction by the biasing force of the biasing member.

An apparatus according to the fourth aspect of the invention is an image forming apparatus comprising: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade which is unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; a positioner which brings the transfer belt into a thrust-condition with positioning the M transfer members in adjacency to the image forming stations, the thrust-condition in which the transfer belt is thrust against the image forming stations when the images of all the M image forming stations primarily transferred onto the surface of the transfer belt, and which releases the transfer belt from the thrust-condition, as needed, with moving the M transfer member from the image forming stations; and a limiting member which acts against a biasing force of the biasing member to prevent the blade opposing roller from moving in the bias direction, wherein the blade opposing roller is moved by the biasing force in the bias direction as applying tension to the transfer belt and is followingly rotated in the opposite direction of the transport direction in conjunction with the transfer belt being released form the thrust-condition with the M transfer members moved away from the image forming stations by the positioner, and the limiting member restricts the movement of the blade opposing roller in the bias direction so as to decrease the tension applied to the transfer belt by the blade opposing roller, when the blade opposing roller moves for a predetermined distance or more in the bias direction in conjunction with the transfer belt released form thrust-condition.

An apparatus according to the fifth aspect of the invention an image forming apparatus comprising: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade which is unified with the blade opposing roller for reciprocating unitarily with the blade opposing roller in the bias direction and holding whose distal end in contact against the blade opposing roller via the transfer belt so as to clean a surface of the transfer belt; K, where K is integer which is equal to or larger than 3, image forming stations which are arranged on the downstream side of the blade opposing roller and on the upstream side of the driving roller in the transport direction and which individually form toner images of mutually different colors; K transfer members disposed in one-on-one relation with the K image forming stations and each of which individually opposes the corresponding image forming station via the transfer belt; a positioner which brings the transfer belt into a thrust-condition with positioning the K transfer members in adjacency to the image forming stations, the thrust-condition in which the transfer belt is thrust against the image forming stations when the images of all the K image forming stations primarily transferred onto the surface of the transfer belt, and which releases the transfer belt from the thrust-condition, as needed, with moving a most-upstream-transfer-member and a most-downstream-transfer-member away from the image forming stations after moving the (K−2) transfer member from the image forming stations, the most-upstream-transfer-member being one of the K transfer members disposed at the most upstream position in the transport direction, the most-downstream-transfer-member being one of the K transfer members disposed at the most downstream position in the transport direction, the (K−2) transfer member(s) defined by excluding the most-upstream-transfer-member and the most-downstream-transfer-member from the K transfer members; and a limiting member which acts against a biasing force of the biasing member to prevent the blade opposing roller from moving in the bias direction, wherein the blade opposing roller is moved by the biasing force in the bias direction as applying tension to the transfer belt and is followingly rotated in the opposite direction of the transport direction in conjunction with the transfer belt being released form the thrust-condition with the most-upstream-transfer-member and most-downstream-transfer-member moved away from the image forming stations by the positioner, the limiting member restricts the movement of the blade opposing roller in the bias direction so as to decrease the tension applied to the transfer belt by the blade opposing roller, when the blade opposing roller moves for a predetermined distance or more in the bias direction in conjunction with the transfer belt released form thrust-condition.

A method according to the sixth aspect of the invention is an image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; and M transfer members disposed in one-on-one relation with the M image forming stations and each of which individually opposes the corresponding image forming station via the transfer belt, the image forming method comprising: bringing the transfer belt into the thrust-condition, in which the transfer belt is thrust against the image forming stations, with positioning the M transfer members in adjacency to the image forming stations, so that the toner images formed by the M image forming stations in the mutually different colors are primarily transferred to the surface of the transfer belt in a manner to be mutually superimposed to form color images; releasing the transfer belt from the thrust-condition, as needed, with moving the M transfer member away from the image forming stations so as to bring the blade opposing roller into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

A method according to the seventh aspect of the invention is an image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and a downstream guide roller which is disposed inside the transfer belt on the upstream side of the driving roller and on the downstream side of the M transfer members in the transfer direction, the image forming method comprising: bringing the transfer belt into the thrust-condition, in which the transfer belt is thrust against the image forming stations, with positioning the M transfer members in adjacency to the image forming stations and allowing the downstream guide roller stretch the transfer belt, so that the toner images formed by the M image forming stations in the mutually different colors are primarily transferred to the surface of the transfer belt in a manner to be mutually superimposed to form color images; releasing the transfer belt from the thrust-condition, as needed, with moving the M transfer member away from the image forming stations and moving the downstream guide roller inwardly of the transfer belt so as to bring the blade opposing roller into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

A method according to the eighth aspect of the invention is an image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; K, where K is integer which is equal to or larger than 3, image forming stations which are arranged on the downstream side of the blade opposing roller and on the upstream side of the driving roller in the transport direction and which individually form toner images of mutually different colors; and K transfer members disposed in one-on-one relation with the K image forming stations and each of which individually opposes the corresponding image forming station via the transfer belt, the image forming method comprising: bringing the transfer belt into the thrust-condition, in which the transfer belt is thrust against the image forming stations, with positioning the K transfer members in adjacency to the image forming stations, so that the toner images formed by the K image forming stations in the mutually different colors are primarily transferred to the surface of the transfer belt in a manner to be mutually superimposed to form color images; releasing the transfer belt from the thrust-condition, as needed after the image forming, with moving a most-upstream-transfer-member and a most-downstream-transfer-member away from the image forming stations after moving the (K−2) transfer member from the image forming stations, the most-upstream-transfer-member being one of the K transfer members disposed at the most upstream position in the transport direction, the most-downstream-transfer-member being one of the K transfer members disposed at the most downstream position in the transport direction, the (K−2) transfer member(s) defined by excluding the most-upstream-transfer-member and the most-downstream-transfer-member from the K transfer members, so that the blade opposing roller is brought into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

An apparatus according to the ninth aspect of the invention is an image forming apparatus comprising: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade which is unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and a controller which controls the positions of the M transfer members and the blade opposing roller, wherein the controller brings the transfer belt into the thrust-condition, in which the transfer belt is thrust against the image forming stations, with positioning the M transfer members in adjacency to the image forming stations, so that the toner images formed by the M image forming stations in the mutually different colors are primarily transferred to the surface of the transfer belt in a manner to be mutually superimposed to form color images, and as needed, the controller releases the transfer belt from the thrust-condition with moving the M transfer member away from the image forming stations so as to bring the blade opposing roller into following rotation in the opposite direction of the transport direction as allowing the blade opposing roller to be moved in the bias direction by the biasing force of the biasing member, and then eliminates the tension of the transfer belt applied by the blade opposing roller with moving the blade opposing roller for a predetermined distance in the opposite direction of the bias direction.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

First Embodiment

Figure 1:
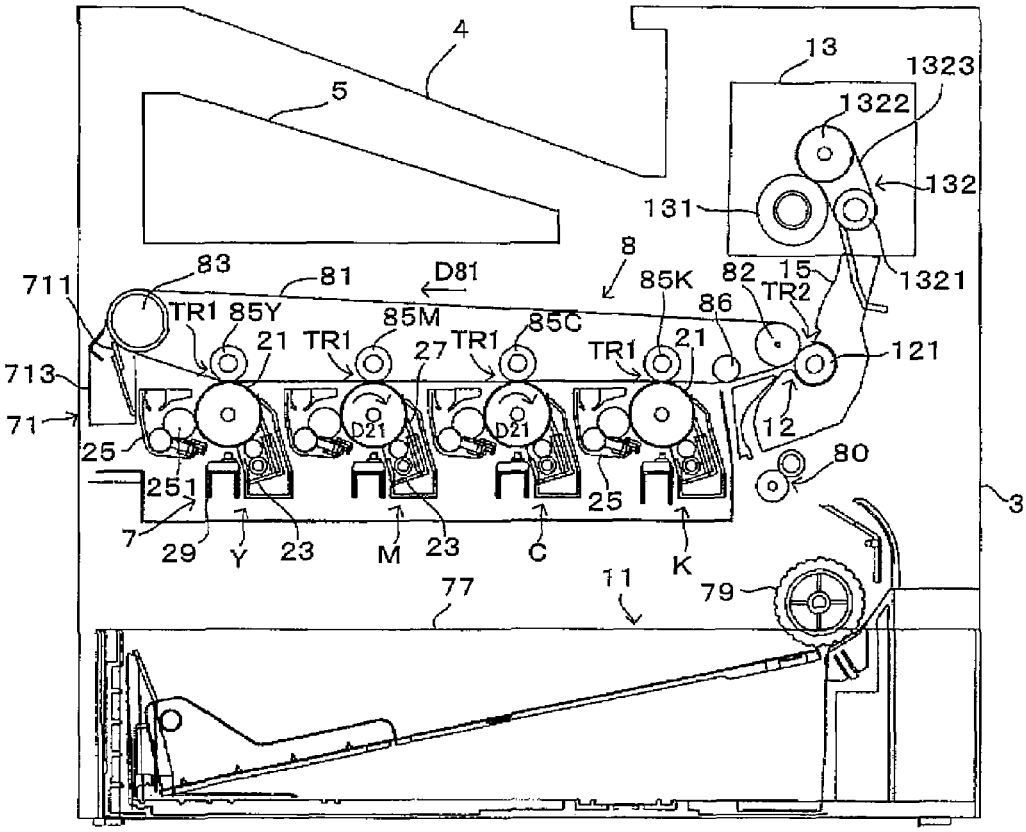
FIG. 1 is a diagram showing an image forming apparatus according to a first embodiment of the invention.
Figure 2:
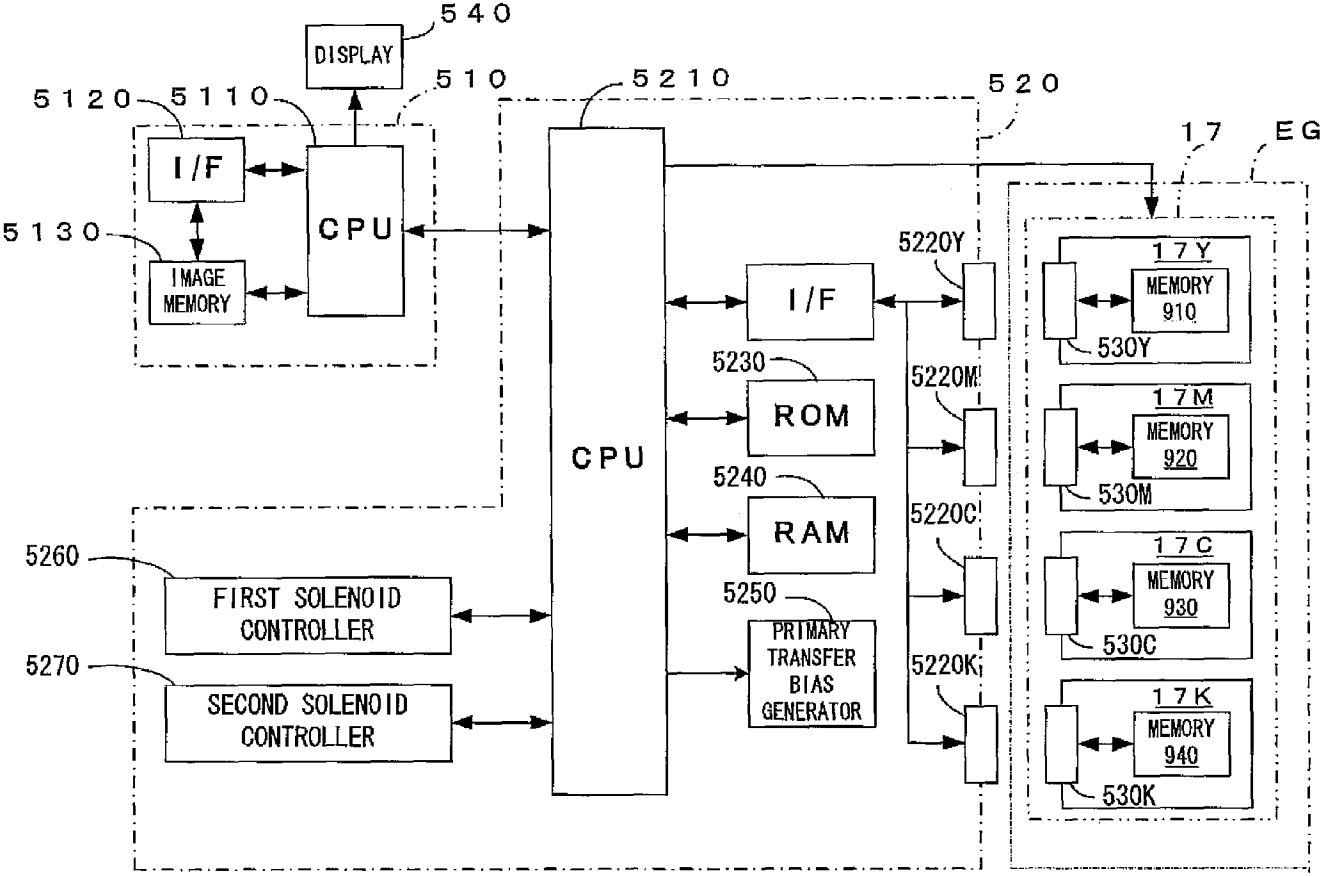
FIG. 2 is a block diagram showing an electrical arrangement of the image forming apparatus of FIG. 1.

FIG. 1 is a diagram showing an image forming apparatus according to a first embodiment of the invention. FIG. 2 is a block diagram showing an electrical arrangement of the image forming apparatus of FIG. 1. The apparatus is capable of selectively performing a color mode to form a color image by superimposing toners of four colors including black (K), cyan (C), magenta (M) and yellow (Y), or a monochromatic mode to form a monochromatic image using only the black toner (K). FIG. 1 corresponds to the execution of the color mode. The image forming apparatus operates as follows. When an external apparatus such as a host computer applies an image forming command to a main controller 510 of the image forming apparatus, the main controller 510 outputs a command, based on which an engine controller 520 controls individual parts of an engine EG for carrying out predetermined image forming operations, thereby forming an image corresponding to the image forming command on a sheet such as copy sheet, transfer sheet, paper and transparent sheet for OHP.

A housing body 3 of the image forming apparatus according to the first embodiment includes an electrical box 5 incorporating therein a power source circuit board, the main controller 510 and the engine controller 520. Furthermore, an image forming unit 7, a transfer belt unit 8 and a sheet feeding unit 11 are also disposed in the housing body 3. The housing body 3 further includes a secondary transfer unit 12, a fixing unit 13, and a sheet guiding member 15 on a right-hand side as seen in FIG. 1. The sheet feeding unit 11 is adapted to be removably mounted in an apparatus body 1. The sheet feeding unit 11 and the transfer belt unit 8 are each adapted to be dismounted from the apparatus body for repair or replacement.

The image forming unit 7 includes four image forming stations Y (for yellow), M (for magenta), C (for cyan) and K (for black) such as to form images of different colors. Each of the image forming stations Y, M, C, K includes a photosensitive drum 21 on which a toner image of each corresponding color is formed. Each of the photosensitive drums 21 is connected to its own driving motor so as to be driven into rotation at a predetermined speed in a direction of an arrow D21 in the figure. Disposed around the photosensitive drum 21 are a charger 23, an image writer 29, a developer 25 and a photosensitive member cleaner 27 which are arranged in the rotational direction. A charging operation, a latent image forming operation and a toner development operation are performed by these function portions. According to the first embodiment and second to seventh embodiments as will be described hereinlater, an image forming station K functions as a "monochromatic image forming station" of the invention. In the execution of the color mode, therefore, the toner images formed by the all image forming stations Y, M, C, K are mutually superimposed on a transfer belt 81 of the transfer belt unit 8 so as to form a color image. In the execution of the monochromatic mode, only the toner image formed by the image forming station K is used to form a monochromatic image. The individual image forming stations of the image forming unit 7 are constructed the same way and hence, FIG. 1 affixes reference characters to only some of the image forming stations for convenience purpose, omitting the reference characters of the other image forming stations.

The charger 23 includes a charging roller, a surface of which is formed from an elastic rubber. The charging roller is adapted to contact against a surface of the photosensitive drum 21 at a charging position so as to be followingly rotated. In conjunction with the rotating motion of the photosensitive drum 21, the charging roller is followingly rotated at a peripheral speed of photosensitive drum 21 in a driven direction. The charging roller is connected to a charging bias generator (not shown). As supplied with a charging bias from the charging bias generator, the charging roller electrically charges the surface of the photosensitive drum 21 at the charging position where the charger 23 contacts against the photosensitive drum 21.

The image writer 29 employs an array-type writing head wherein elements like liquid crystal shutters each including a light-emitting diode and a backlight are aligned in line(s) in an axial direction of the photosensitive drum 21 (perpendicular to the drawing surface). The image writer 29 is spaced from the photosensitive drum 21. These elements irradiates light on the surface of the photosensitive drum 21 charged by the charger 23, thereby forming a latent image on the surface thereof. The array-type writing head is more compact, having a shorter optical path length than a laser scanning optical system. Accordingly, this writing head may be disposed in closely spacing relation with the photosensitive drum 21, offering an advantage of permitting the overall size reduction of the apparatus.

According to the first embodiment, the photosensitive drum 21, charger 23, developer 25 and photosensitive member cleaner 27 of the respective image forming stations Y, M, C, K are unified as respective photosensitive cartridges 17Y, 17M, 17C, 17K (FIG. 2). The photosensitive cartridges 17Y, 17M, 17C, 17K are provided with non-volatile memories 910, 920, 930, 940, respectively, such as to store information related to the corresponding photosensitive cartridges. Transceivers 530Y, 530M, 530C, 530K disposed at the respective photosensitive cartridges are located in closely spacing relation with transceivers 5220Y, 5220M, 5220C, 5220K disposed at the apparatus body. Accordingly wireless communications may be carried out between a CPU 5210 of the engine controller 520 and the respective memories 910, 920, 930, 940. Thus, the information on the individual photosensitive cartridges is transmitted to the CPU 5210, while the information stored in the individual memories 910, 920, 930, 940 is updated and re-stored.

The developer 25 includes a developing roller 251 for carrying the toner on its surface. The developing roller 251 is electrically connected to a developing bias generator (not shown) which supplies a developing bias to the developing roller. At a development position where the developing roller 251 contacts against the photosensitive drum 21, the developing bias acts to transfer charged toner from the developing roller 251 to the photosensitive drum 21, whereby an electrostatic latent image formed by the image writer 29 is developed into a toner image.

The toner image so developed at the development position is transported in the rotational direction D21 of the photosensitive drum 21. Subsequently, the toner image is primarily transferred to the transfer belt 81 at a primary transfer position TR1, to be described in details hereinlater, where the transfer belt 81 contacts against the photosensitive drum 21.

In this embodiment, the photosensitive member cleaner 27 contacts against the surface of the photosensitive drum 21 as disposed on the downstream side of the primary transfer position TR1 and upstream side of the charger 23 in the rotational direction D21 of the photosensitive drum 21. The photosensitive member cleaner 27 contacts against the surface of the photosensitive drum thereby removing the toner remaining on the surface of the photosensitive drum 21 after the primary image transfer.

The transfer belt unit 8 includes: a driving roller 82; a follower roller 83 (blade opposing roller) disposed on a left-hand side of the driving roller 82 as seen in FIG. 1; and the transfer belt 81 stretched around these rollers and driven into circulation in a direction of an arrow D81 (transport direction) shown in the figure. The transfer belt unit 8 further includes four primary transfer rollers 85Y, 85M, 85C, 85K (transfer members) which are disposed inside the transfer belt 81 in a manner oppose the respective photosensitive drums 21 of the image forming stations Y, M, C, K in one-on-one relation when the photosensitive cartridges are mounted in the apparatus. Each of these primary transfer rollers 85 is electrically connected to a primary transferring-bias generator 5250. In the execution of the color mode, as will be described hereinlater, all the primary transfer rollers 85Y, 85M, 85C, 85K are positioned in adjacency to the image forming stations Y, M, C, K as shown in FIG. 1 so as to thrust the transfer belt 81 against the respective photosensitive drums 21 of the image forming stations Y, M, C, K. Thus, the primary transfer positions TR1 are established between the respective photosensitive drums 21 and the transfer belt 81. The primary transferring-bias generator 5250 applies a primary transferring bias to each of the primary transfer rollers 85 in a proper timing, thereby allowing the toner images formed on the respective surfaces of the photosensitive drums 21 to be transferred to the surface of the transfer belt 81 at the corresponding primary transfer positions TR1. Thus is formed the color image.

In the execution of the monochromatic mode as will be described hereinlater, color primary transfer rollers 85Y, 85M, 85C (color transfer members) of the four primary transfer rollers 85 are moved away from the individually opposing image forming stations Y, M, C, while only a monochromatic primary transfer roller 85K (monochromatic transfer member) is contacted against the image forming station K, whereby the transfer belt 81 is pressed only against the image forming station K. Consequently, the primary transfer position TR1 is established only between the monochromatic primary transfer roller 85K and the image forming station K. The primary transferring bias from the primary transferring-bias generator 5250 is applied to the monochromatic primary transfer roller 85K in a proper timing, thereby allowing the toner image formed on the surface of the photosensitive drum 21 to be transferred to the surface of the transfer belt 81 at the primary transfer position TR1. Thus is formed the monochromatic image.

The transfer belt unit 8 further includes a downstream guide roller 86 disposed on the downstream side of the monochromatic primary transfer roller 85K and the upstream side of the driving roller 82. The downstream guide roller 86 is designed to contact against the transfer belt 81 on an internal common tangent line of the photosensitive drum 21 and the primary transfer roller 85K at the primary transfer position TR1. The internal common tangent line is tangent both to the monochromatic primary transfer roller 85K and the photosensitive drum 21 of the image forming station K at the primary transfer position TR1 at which the monochromatic primary transfer roller 85K contacts against the photosensitive drum 21 of the image forming station K.

The driving roller 82 not only drives the transfer belt 81 into circulation in the direction of the arrow D81 shown in the figure but also serves as a backup roller for a secondary transfer roller 121. A rubber layer having a thickness on the order of 3 mm and a volume resistivity of 1000 kΩ·cm or less is formed on a periphery of the driving roller 82. The driving roller is grounded via a metal shaft, thus providing a conductive path of a secondary transferring bias which is supplied from an unillustrated secondary transferring-bias generator via the secondary transfer roller 121. The driving roller 82 is provided with the rubber layer having high friction and high impact absorption such that impact caused by a sheet advanced into a contact area (secondary transfer position TR2) between the driving roller 82 and the secondary transfer roller 121 may be less transmitted to the transfer belt 81. Thus is prevented the degradation of image quality.

The sheet feeding unit 11 includes: a sheet feeder having a sheet feeding cassette 77 capable of holding sheets in stack; and a pickup roller 79 for feeding one sheet at a time from the sheet feeding cassette 77. The sheet fed from the sheet feeder by means of the pickup roller 79 is adjusted for sheet feeding timing by means of a pair of registration rollers 80. Thereafter, the sheet is transported along the sheet guiding member 15 to the secondary transfer position TR2.

The secondary transfer roller 121 is adapted to move to or away from the transfer belt 81. The secondary transfer roller is driven by a secondary-transfer-roller driving mechanism (not shown) to be brought into or out of contact against the transfer belt 81. The fixing unit 13 includes: a heating roller 131 incorporating therein a heating element such as a halogen heater and free to rotate; and a pressing portion 132 for pressingly biasing the heating roller 131. The sheet having an image secondarily transferred to a surface thereof is guided to a nip portion by the sheet guiding member 15, the nip portion defined by the heating roller 131 and a pressing belt 1323 of the pressing portion 132. At the nip portion, the image is thermally fused to the sheet at a predetermined temperature. The pressing portion 132 includes two rollers 1321, 1322, and the pressing belt 1323 stretched around these rollers. The pressing belt 1323 has a belt stretch surface thereof defined between the two rollers 1321, 1322. The belt stretch surface is pressed against a periphery of the heating roller 131 so that the heating roller 131 and the pressing belt 1323 define a large nip portion. The sheet thus subjected to the thermal fusing process is transported to a discharge tray 4 disposed at an upper portion of the housing body 3.

In this apparatus, a cleaner 71 opposes the blade opposing roller 83. The cleaner 71 includes a cleaner blade 711 and a waste toner box 713. The cleaner blade 711 holds its distal end contacted against the blade opposing roller 83 via the transfer belt 81, thereby removing the contaminant, such as the toner and powdery paper, remaining on the transfer belt after the secondary image transfer. The contaminant so removed is collected in the waste toner box 713. The cleaner blade 711 and the waste box 713 are unified with the blade opposing roller 83. Therefore, when the blade opposing roller 83 is moved, the cleaner blade 711 and the waste toner box 713 are also moved along with the blade opposing roller 83, as will be described hereinlater.

As shown in FIG. 2, the apparatus is provided with a display 540 which is controlled by a CPU 5110 of the main controller 510. The display 540 comprises a liquid crystal display, for example. In response to a control command from the CPU 5110, the display 540 displays a given message informing a user about how to operate the apparatus, the progress of the image forming operation, an occurrence of abnormality in the apparatus, time to replace any one of the units, or the like.

In FIG. 2, an image memory is indicated at 5130, which is disposed in the main controller 510 in order to store an image supplied from the external apparatus such as a host computer via an interface 5120. On the other hand, indicated at 5230 is a ROM for storing an operation program executed by the CPU 5210, and control data and such used by the CPU to control the engine EG. Indicated at 5240 is a RAM for temporarily storing the operation results given by the CPU 5210 and other data items.

Figure 3:
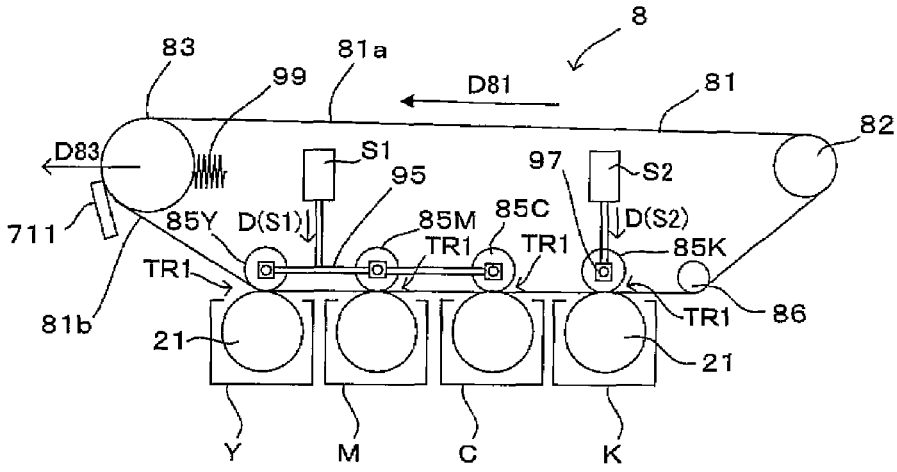
FIG. 3 is a diagram showing an operation of switching the apparatus of the first embodiment between the color mode and the monochromatic mode.
Figure 4:
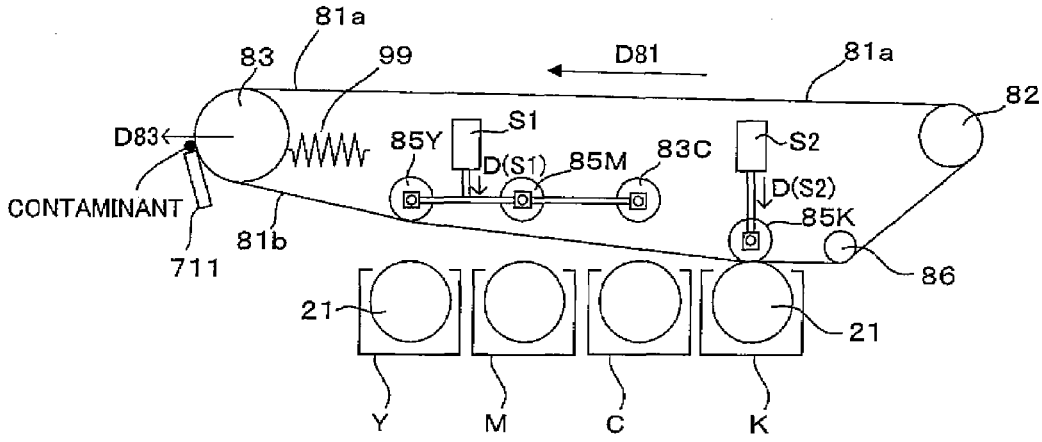
FIG. 4 is a diagram showing an operation of switching the apparatus of the first embodiment between the color mode and the monochromatic mode.

FIG. 3 and FIG. 4 are diagrams showing an operation of switching the apparatus of the first embodiment between the color mode and the monochromatic mode. According to the first embodiment, the blade opposing roller 83 is biased by a tension spring 99 in a direction D83 to be moved away from the driving roller 82 and is free to reciprocate in the bias direction D83. Therefore, the blade opposing roller 83 functions as a so-called tension roller for tensioning the transfer belt 81. Upstream three color primary transfer rollers 85Y, 85M, 85C (color transfer members) in the transport direction D81 are rotatably supported by a first support member 95, whereas the first support member 95 is fixedly supported by a first solenoid S1. The first solenoid S1 is electrically connected to a first solenoid controller 5260 shown in FIG. 2. Therefore, the first support member 95 and the primary transfer rollers 85Y, 85M, 85C may be reciprocally moved in a stroke direction D(S1) of the first solenoid S1 by applying a proper signal to the first solenoid S1 from the first solenoid controller 5260. The monochromatic primary transfer roller 85K (monochromatic transfer member) at the most downstream position in the transport direction D81 is rotatably supported by a second support member 97. The second support member 97 is fixedly supported by a second solenoid S2. The second solenoid S2 is electrically connected to a second solenoid controller 5270 in FIG. 2. Therefore, the second support member 97 and the primary transfer roller 85K may be reciprocally moved in a stroke direction D(S2) of the second solenoid S2 by applying a proper signal to the second solenoid S2 from the second solenoid controller 5270. Thus, the first solenoid controller 5260 and the second solenoid controller 5270 according to the first embodiment function as a "controller" of the invention.

In the execution of the color mode, the first solenoid controller 5260 and the second solenoid controller 5270 apply a contacting signal to the solenoids S1, S2. As shown in FIG. 3, the four primary transfer rollers 85Y, 85M, 85C, 85K are moved against the biasing force applied to the blade opposing roller 83 so as to be positioned in adjacency to the four image forming stations Y, M, C, K. And the four primary transfer rollers 85Y, 85M, 85C, 85K thrust the transfer belt 81 against the photosensitive drums 21 of the image forming stations Y, M, C, K, the transfer belt being tensioned by the blade opposing roller 83. Thus, the primary transfer positions TR1 are established. Then, as described above, the toner images formed by the respective image forming stations Y, M, C, K are primarily transferred to the surface of the transfer belt 81 at the primary transfer positions TR1.

In the execution of the monochromatic mode, on the other hand, the first solenoid controller 5260 applies a releasing signal to the solenoid S1, whereas the second solenoid controller 5270 applies the contacting signal to the solenoid S2. As shown in FIG. 4, the monochromatic primary transfer roller 85K (monochromatic transfer member) is positioned in adjacency to the monochromatic image forming station K, while the color primary transfer rollers 85Y, 85M, 85C (color transfer members) are moved away from the respective opposite image forming stations Y, M, C. During the execution of the monochromatic mode, therefore, the transfer belt 81 is released from a thrust-condition in which the transfer belt 81 is thrust against the image forming stations Y, M, C by the color primary transfer rollers 85Y, 85M, 85C. Therefore the transfer belt 81 is spaced away from the image forming stations Y, M, C as pulled by the blade opposing roller 83 biased by the tension spring 99. As a result, the transfer belt 81 is contacted against only the monochromatic image forming station K during the execution of the monochromatic mode.

As shown in FIG. 3 and FIG. 4, the invention is constituted such that the distal end of the cleaner blade 711 is contacted against the blade opposing roller via the transfer belt 81 for cleaning the surface of the transfer belt 81 in both of the color mode and the monochromatic mode. The image forming apparatus of this constitution may encounter the following problem. During the monochromatic mode, the contaminant may adhere to the distal end of the cleaner blade 711 to produce a clearance between the transfer belt 81 and the distal end of the cleaner blade 711, as shown in FIG. 4, so that the surface of the transfer belt 81 may not be cleaned adequately. Hence, the first embodiment is adapted to perform, as needed, the following "thrusting step" and "releasing step" after the execution of the monochromatic mode.

Figure 5:
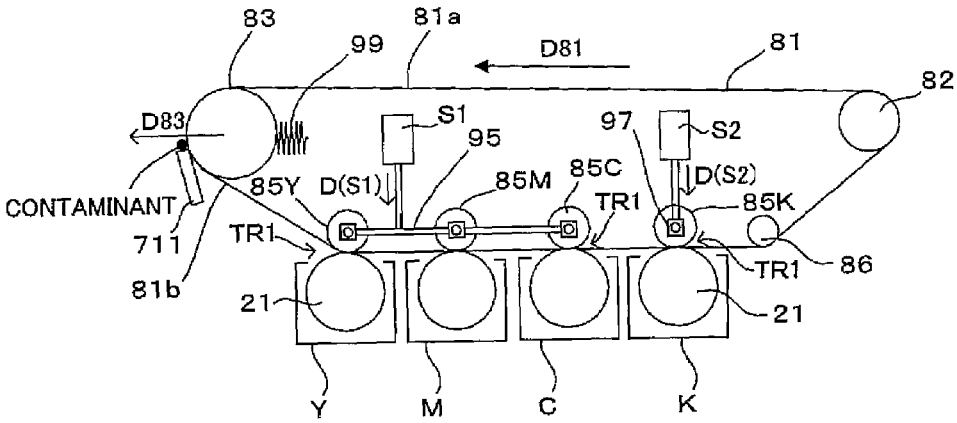
FIG. 5 is a diagram showing the thrusting step according to the first embodiment.

FIG. 5 is a diagram showing the thrusting step according to the first embodiment. In the thrusting step, the first solenoid controller 5260 applies the contacting signal to the solenoid S1 if it is needed after the completion of the monochromatic mode shown in FIG. 4. Receiving the contacting signal, the solenoid S1 brings the color primary transfer rollers 85Y, 85M, 85C (color transfer members) into contact against the respective opposite image forming stations Y, M, C. At this time, the color primary transfer rollers 85Y, 85M, 85C thrust the transfer belt 81 against the image forming stations Y, M, C as pulling the transfer belt 81 against the biasing force applied to the blade opposing roller 83. The blade opposing roller 83, in turn, is moved in the opposite direction of the bias direction D83 according to the pulling of the transfer belt 81 by the color primary transfer rollers 85Y, 85M, 85C, so as to approach the driving roller 82. At this time, the contaminant stay adhered to the distal end of the cleaner blade 711. In this manner, the primary transfer belt 81 is thrust against the image forming stations Y, M, C by the thrusting step, which is followed by the releasing step as below.

Figure 6:
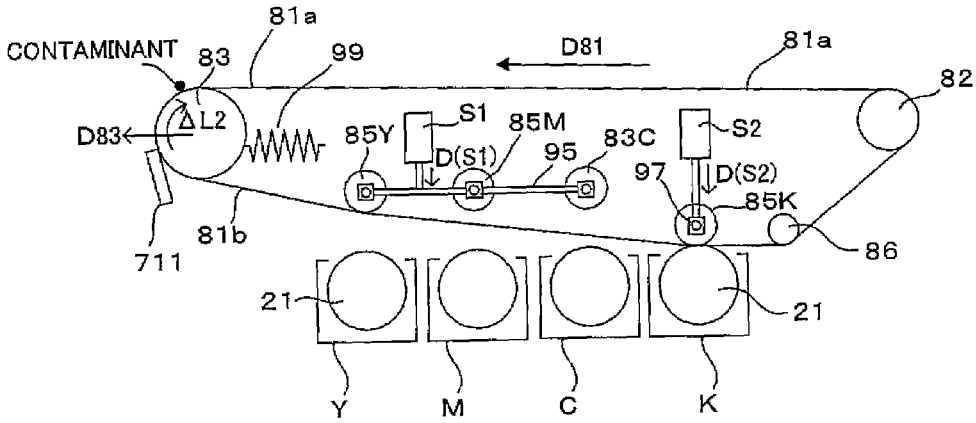
FIG. 6 is a diagram showing the releasing step according to the first embodiment.

FIG. 6 is a diagram showing the releasing step according to the first embodiment. In the releasing step, the first solenoid controller 5260 applies the releasing signal to the solenoid S1. Receiving the releasing signal, the solenoid S1 moves the color transfer members 85Y, 85M, 85C away from the image forming stations Y, M, C, thereby releasing the transfer belt 81 from a thrust-condition in which the transfer belt 81 is thrust against the image forming stations Y, M, C by the color primary transfer rollers 85Y, 85M, 85C. In conjunction of the transfer belt 81 released from the thrust-condition at this time, the blade opposing roller 83 is moved in the bias direction D83 by the biasing force of the tension spring 99 as pulling the transfer belt 81. As a result, the transfer belt 81 is spaced away from the image forming stations Y, M, C.

Since the blade opposing roller 83 is moved in the direction to be spaced away from the driving roller 82, such an operation of releasing the transfer belt 81 increases a circumferential length L1 (circumferential length L1 on the opposite side from the image forming stations) of a transfer belt portion 81*a* extending from the driving roller 82 to the blade opposing roller in the transport direction D81 of the transfer belt 81. In the meantime, a circumferential length L2 (circumferential length L2 on the image forming station side) of a transfer belt portion 81*b* extending from the driving roller 82 to the blade opposing roller 83 in the opposite direction of the transport direction D81 of the transfer belt 81 is decreased.

At this time, the driving roller 82 is at standstill, while the transfer belt 81 is not moved toward the driving roller 82 because the surface of the driving roller 82 has the high friction as described above. On the other hand, the blade opposing roller 83 is the follower roller, which is rotated in the opposite direction of the transport direction D81 of the transfer belt 81 as pulled by the transfer belt 81. The blade opposing roller is rotated by a quantity corresponding to the increase of the circumferential length L1 on the opposite side from the image forming stations. On the other hand, the cleaner blade 711 is unified with the blade opposing roller 83 as described above, so that the cleaner blade 711 is also moved along with the blade opposing roller 82 so moved. Therefore, relative positions between the cleaner blade 711 and the blade opposing roller 83 are unchanged. When the blade opposing roller 83 is rotated in the opposite direction of the transport direction D81 by a variation ΔL2 of the circumferential length L2 on the image forming station side, the transfer belt 81 is moved for a distance corresponding to the variation ΔL2 in the opposite direction of the transport direction D81 with respect to a contact position where the distal end of the cleaner blade 711 is contacted against the transfer belt 81. Accordingly, the contaminant adhered to the distal end of the cleaner blade 711 in the state shown in FIG. 4 and FIG. 5 is moved by the variation ΔL2 of the circumferential length in the opposite direction of the transport direction D81 by moving the primary transfer rollers 85Y, 85M, 85C away from the image forming stations Y, M, C, as shown in FIG. 6. In consequence, the contaminant adhered to the distal end of the cleaner blade 711 is separated therefrom.

According to the first embodiment as described above, the "thrusting step" is performed as needed after the completion of the monochromatic mode, so that the transfer belt 81 may be once thrust against the image forming stations Y, M, C, K. Subsequently, the "releasing step" is performed to release the transfer belt 81 from the thrust-condition thereby allowing the transfer belt 81 to be moved in the opposite direction of the transport direction D81 with respect to the contact position where the cleaner blade 711 is contacted against the transfer belt 81. Even when the contaminant is adhered to the distal end of the cleaner blade 711, the contaminant may be separated by moving the transfer belt 81. Therefore, a drive system is simplified, negating the need for an additional driving mechanism for rotating the transfer belt 81 in the opposite direction of the transport direction D81. In short, the first embodiment is based on a more simplified structure for providing an effective separation of the contaminant adhered to the distal end of the cleaner blade 711, thus accomplishing the reduction of cost and size of the apparatus.

In the first embodiment, the monochromatic primary transfer roller 85K (monochromatic transfer member) of the four primary transfer rollers 85Y, 85M, 85C, 85K is disposed at the most downstream position in the transport direction D81. As compared with a case where the monochromatic primary transfer roller 85K is disposed any other position than the most downstream position in the transport direction D81, this location of the monochromatic primary transfer roller is more preferred from the view point of protection of the image forming stations Y, M, C, K, the primary transfer rollers 85 and the transfer belt 81. The reason will be described as below.

In the case where the monochromatic primary transfer roller 85K is disposed any other position than the most downstream position in the transport direction D81, at least one color primary transfer roller is disposed downstream from the monochromatic primary transfer roller 85K in the transport direction. Such a color primary transfer roller is moved away from the image forming station when the apparatus is switched from the color mode to the monochromatic mode. As the color primary transfer roller is moved away from the image forming station, the portion of the transfer belt 81 extending downstream from the monochromatic primary transfer roller 85K in the transport direction D81 is also moved away from the image forming station. At this time, a circumferential length of a portion of the transfer belt 81, extending from the driving roller 82 to the monochromatic primary transfer roller 85K in the opposite direction of the transport direction D81, is decreased. In correspondence to the variation of such a circumferential length, the blade opposing roller 83 as the tension roller is moved in the bias direction D83 as pulling the transfer belt 81. Accordingly, the transfer belt portion 81, which extends between the downstream side of the monochromatic primary transfer roller 85K and the upstream side of the driving roller 82 in the transport direction D81, is moved away from the image forming station as pulled by the blade opposing roller 83.

During the operation of releasing the transfer belt 81 from the image forming stations, the monochromatic primary transfer roller 85K is contacted against the image forming station K via the transfer belt 81. When moved away from the image forming station, therefore, the transfer belt portion extended between the downstream side of the monochromatic primary transfer roller 85K and the upstream side of the driving roller 83 in the transport direction D81 is moved toward the upstream side of the monochromatic primary transfer roller in the transport direction D81 as passing through space between the monochromatic primary transfer roller 85K and the monochromatic image forming station K contacting each other. Therefore, a problem may occur that the image forming station K or the monochromatic primary transfer roller 85K and the transfer belt 81 abrade against each other, thus causing damage on each other. In the case where the monochromatic primary transfer roller 85K is disposed on the most downstream position of those of the four primary transfer rollers 85Y, 85M, 85C, 85K in the transport direction D81, on the other hand, the transfer belt portion 81 extending between the downstream side of the monochromatic primary transfer roller 86K and the upstream side of the driving roller 82 in the transport direction D81 is never subjected to movement away from the image forming station when the apparatus is switched from the color mode to the monochromatic mode. Hence, the embodiment is preferred in that the above problem is obviated.

Second Embodiment

In the case where the contaminant is separated from the distal end of the cleaner blade 711 by moving the transfer belt 81 in the opposite direction of the transport direction D81 in the contact position where the distal end of the cleaner blade 711 is contacted against the transfer belt 81, as suggested by the first embodiment, the effect to separate the contaminant becomes greater as the quantity of movement of the transfer belt 81 is increased. In the above embodiment, in conjunction with the primary transfer roller moved away from the image forming station, the circumferential length L1 of the transfer belt portion on the opposite side from the image forming station is increased whereas the circumferential length L2 of the transfer belt portion on the image forming station side is decreased. That is, the circumferential length of the transfer belt portion on the opposite side from the image forming stations is increased by the decrease (ΔL2) of circumferential length of the transfer belt portion on the image forming station side. Such a variation ΔL2 of the circumferential length of the transfer belt portion corresponds to the quantity of movement of the transfer belt 81 in the opposite direction of the transport direction in the contact position where the distal end of the cleaner blade 711 is contacted against the transfer belt 711. Thus, the greater the variation ΔL2 of the circumferential length of the transfer belt portion on the image forming station side, the greater the quantity of movement of the transfer belt in the opposite direction of the transfer direction D81. On the other hand, such a variation ΔL2 of the circumferential length of the transfer belt portion on the image forming station side depends upon how much the transfer belt 81 is moved away from the image forming stations Y, M, C, K.

Therefore, a constitution may be made as suggested by a second embodiment described as below. It is noted here that a basic arrangement of the apparatus is the same as that of the first embodiment. Hence, only characteristic parts of the second embodiment are described here, while the other parts thereof are represented by the equivalent characters, respectively, the description of which is dispensed with.

Figure 7:
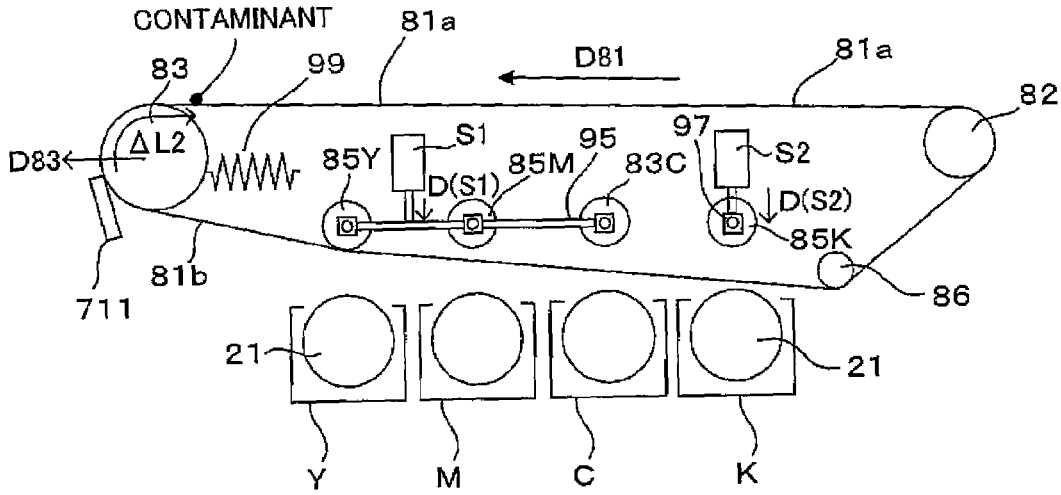
FIG. 7 is a diagram showing the releasing step according to the second embodiment.

In the releasing step according to the above first embodiment, the upstream three primary transfer rollers 85Y, 85M, 85C (color transfer members) in the transport direction D81, out of the four primary transfer rollers, are exclusively moved away from the image forming stations Y, M, C by means of the first solenoid S1. In a "releasing step" according to the second embodiment, on the other hand, the second solenoid S2 operates to move the primary transfer roller 85K away from the image forming station K, as shown in FIG. 7, in synchronism with the operation of moving the primary transfer rollers away from the image forming stations by means of the first solenoid S1. Thus, the first solenoid controller 5260 and the second solenoid controller 5270 according to the second embodiment function as the "controller" of the invention. Specifically, the first solenoid controller 5260 (FIG. 2) outputs the releasing signal to the first solenoid S1 while at the same time, the second solenoid controller 5270 (FIG. 2) outputs the releasing signal to the second solenoid S2, so that all the primary transfer rollers 85Y, 85M, 85C, 85K are moved away from the image forming stations Y, M, C, K. This provides a greater variation ΔL2 of the circumferential length L2 on the image forming station side, as compared with the case where only the upstream three primary transfer rollers 85Y, 85M, 85C in the transport direction are moved away from the image forming stations Y, M, C. This results in a greater quantity of movement of the transfer belt 81 in the opposite direction of the transport direction in the contact position where the distal end of the cleaner blade 711 is contacted against the transfer belt. Hence, the embodiment is preferred in that the contaminant adhered to the distal end of the cleaner blade 711 is more assuredly removed.

Third Embodiment

Next, an apparatus according to a third embodiment of the invention will be described. It is noted that a basic arrangement of the apparatus is the same as that of the first embodiment and hence, only characteristic parts of the third embodiment are described here while the other parts thereof are represented by the equivalent characters, respectively, the description of which is dispensed with.

Figure 8:
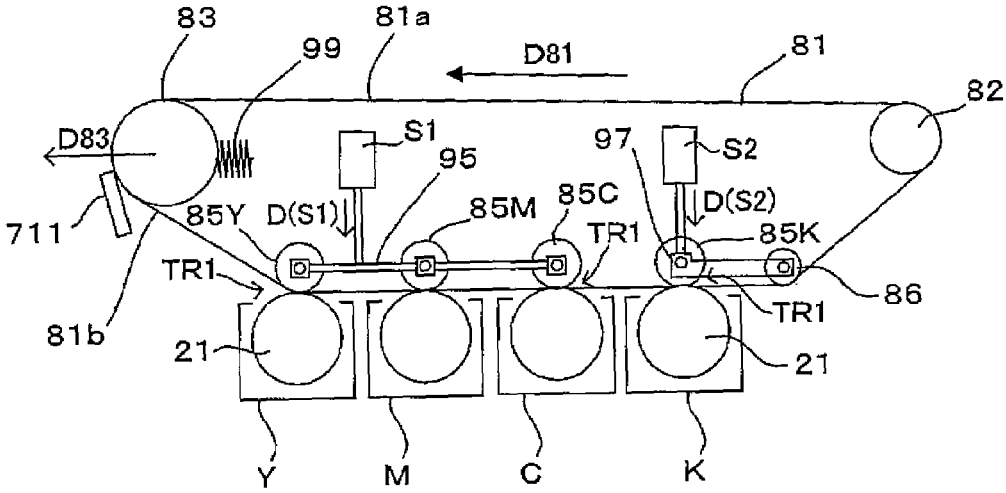
FIG. 8 is a diagram showing an operation of switching the apparatus of the third embodiment between the color mode and the monochromatic mode.
Figure 9:
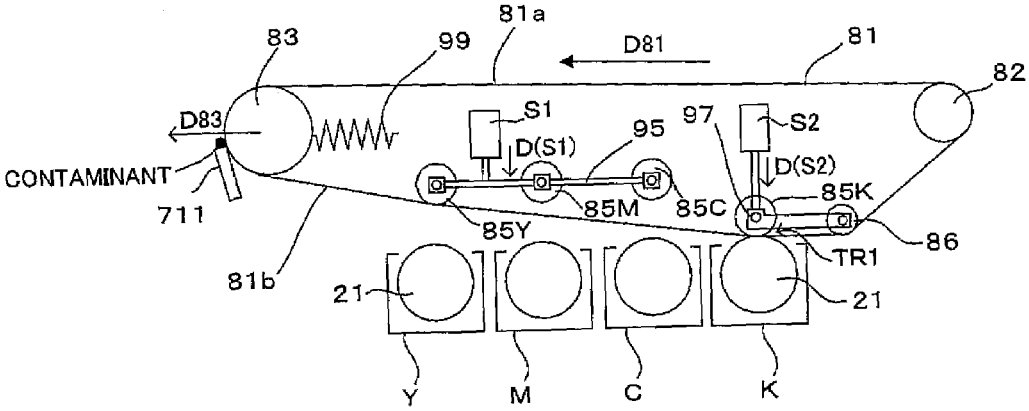
FIG. 9 is a diagram showing an operation of switching the apparatus of the third embodiment between the color mode and the monochromatic mode.

FIG. 8 and FIG. 9 are diagrams showing an operation of switching the apparatus of the third embodiment between the color mode and the monochromatic mode. According to the third embodiment, the monochromatic primary transfer roller 85K (monochromatic transfer member) and the downstream guide roller 86 disposed at the most downstream position in the transport direction D81 are rotatably supported by the second support member 97. The second support member 97 is fixedly supported by the second solenoid S2. The second solenoid S2 is electrically connected to the second solenoid controller 5270 shown in FIG. 2. Therefore, the second support member 97, the primary transfer roller 85K and the downstream guide roller 86 may be reciprocally moved in the stroke direction D(S2) of the second solenoid S2 by applying a proper signal to the second solenoid S2 from the second solenoid controller 5270.

In the execution of the color mode, the first solenoid controller 5260 and the second solenoid controller 5270 apply the contacting signal to the solenoids S1, S2. As shown in FIG. 8, the four primary transfer rollers 85Y, 85M, 85C, 85K are moved against the biasing force applied to the blade opposing roller 83 so as to be positioned in adjacency to the four image forming stations Y, M, C, K. And the four primary transfer rollers 85Y, 85M, 85C, 85K thrust the transfer belt 81 against the photosensitive drums 21 of the image forming stations Y, M, C, K, the transfer belt being tensioned by the blade opposing roller 83. Thus, the primary transfer positions TR1 are established. Then, as described above, the toner images formed by the respective image forming stations Y, M, C, K are primarily transferred to the surface of the transfer belt 81 at the primary transfer positions TR1.

In the execution of the monochromatic mode, on the other hand, the first solenoid controller 5260 applies the releasing signal to the solenoid S1, whereas the second solenoid controller 5270 applies the contacting signal to the solenoid S2. As shown in FIG. 9, the monochromatic primary transfer roller 85K (monochromatic transfer member) is positioned in adjacency to the monochromatic image forming station K, while the color primary transfer rollers 85Y, 85M, 85C (color transfer members) are moved away from the respective opposite image forming stations Y, M, C. During the monochromatic mode, the transfer belt 81 is released from a thrust-condition in which the transfer belt 81 is thrust against the image forming stations Y, M, C by the color primary transfer rollers 85Y, 85M, 85C. Therefore the transfer belt 81 is spaced away from the image forming stations Y, M, C as being pulled by the blade opposing roller 83 biased by the tension spring 99. Consequently, the transfer belt 81 is contacted against only the monochromatic image forming station K during the monochromatic mode.

As shown in FIG. 8 and FIG. 9, the invention is constituted such that the distal end of the cleaner blade 711 is contacted against the blade opposing roller via the transfer belt 81 for cleaning the surface of the transfer belt 81 in both of the color mode and the monochromatic mode. The image forming apparatus of this constitution may encounter the following problem. During the monochromatic mode, the contaminant may adhere to the distal end of the cleaner blade 711 to produce a clearance between the transfer belt 81 and the distal end of the cleaner blade 711, as shown in FIG. 9, so that the surface of the transfer belt 81 may not be cleaned adequately. Hence, the third embodiment is adapted to perform the following "thrusting step" and "releasing step" if these steps are needed after the execution of the monochromatic mode.

Figure 10:
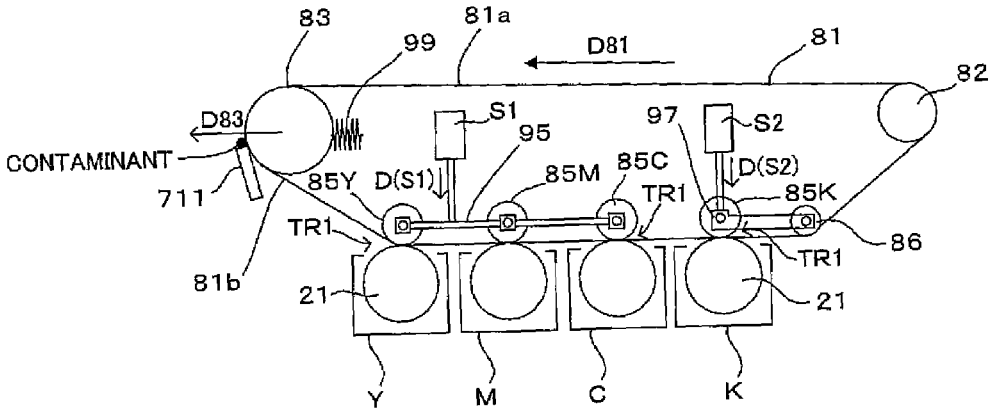
FIG. 10 is a diagram showing the thrusting step according to the third embodiment.

FIG. 10 is a diagram showing the thrusting step according to the third embodiment. The thrusting step is performed as follows. After completion of the monochromatic mode shown in FIG. 9, the first solenoid controller 5260 applies, as needed, the contacting signal to the solenoid S1. Receiving the contacting signal, the solenoid S1 brings the color primary transfer rollers 85Y, 85M, 85C (color transfer members) into contact against the respective opposite image forming stations Y, M, C. At this time, the color primary transfer rollers 85Y, 85M, 85C thrust the transfer belt 81 against the image forming stations Y, M, C as pulling the transfer belt 81 against the biasing force applied to the blade opposing roller 83. The blade opposing roller 83, in turn, is moved in the opposite direction of the bias direction D83 to approach the driving roller 82 according to the pulling of the transfer belt 81 by the color primary transfer rollers 85Y, 85M, 85C. At this time, the contaminant stays adhered to the distal end of the cleaner blade 711. In this manner, the transfer belt 81 is thrust against the image forming stations Y, M, C by the thrusting step, which is followed by the releasing step as below.

Figure 11:
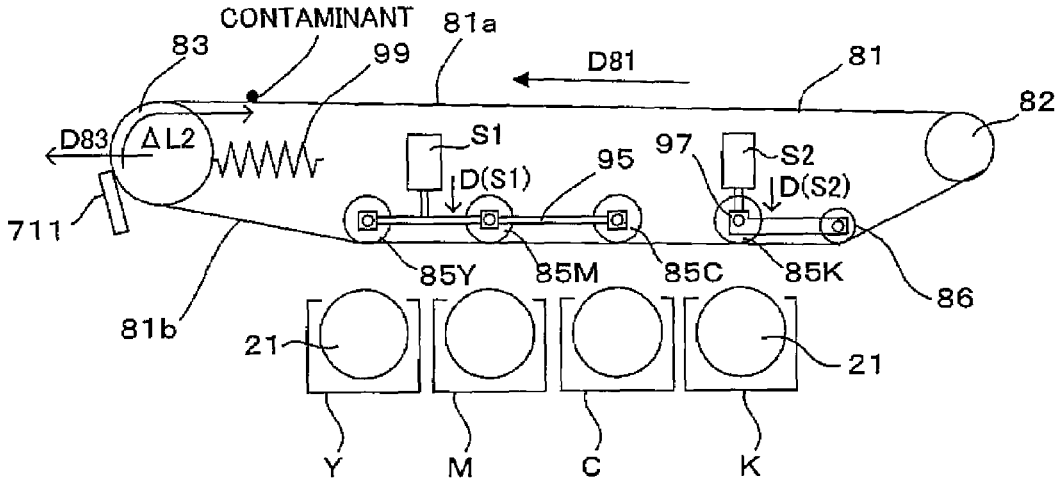
FIG. 11 is a diagram showing the releasing step according to the third embodiment.

FIG. 11 is a diagram showing the releasing step according to the third embodiment. In the releasing step according to the third embodiment, the second solenoid S2 moves the primary transfer roller 85K away from the image forming station K in synchronism with the operation of moving away the primary transfer rollers by means of the first solenoid S1, as shown in FIG. 11. Specifically, the first solenoid controller 5260 (FIG. 2) outputs the releasing signal to the first solenoid S1 while at the same time, the second solenoid controller 5270 (FIG. 2) outputs the releasing signal to the second solenoid S2, so that all the primary transfer rollers 85Y, 85M, 85C, 85K are moved away from the image forming stations Y, M, C, K. In the meantime, the downstream guide roller 86 is also moved inwardly of the transfer belt 81. Thus, the first solenoid controller 5260 and the second solenoid controller 5270 according to the third embodiment function as the "controller" of the invention. It is therefore possible to provide a greater variation ΔL2 of the circumferential length L2 on the image forming station side, as compared with the case where only the primary transfer rollers 85Y, 85M, 85C are moved away from the image forming stations Y, M, C. This results in a greater quantity of movement of the transfer belt 81 in the opposite direction of the transport direction in the contact position where the distal end of the cleaner blade 711 is contacted against the transfer belt. Therefore, the embodiment is preferred in that the contaminant adhered to the distal end of the cleaner blade 711 is more assuredly removed.

Fourth Embodiment

Next, an apparatus according to a fourth embodiment of the invention will be described. It is noted that a basic arrangement of the apparatus is the same as that of the first embodiment and hence, only characteristic parts of the fourth embodiment are described here while the other parts thereof are represented by the equivalent characters, respectively, the description of which is dispensed with.

Figure 12:
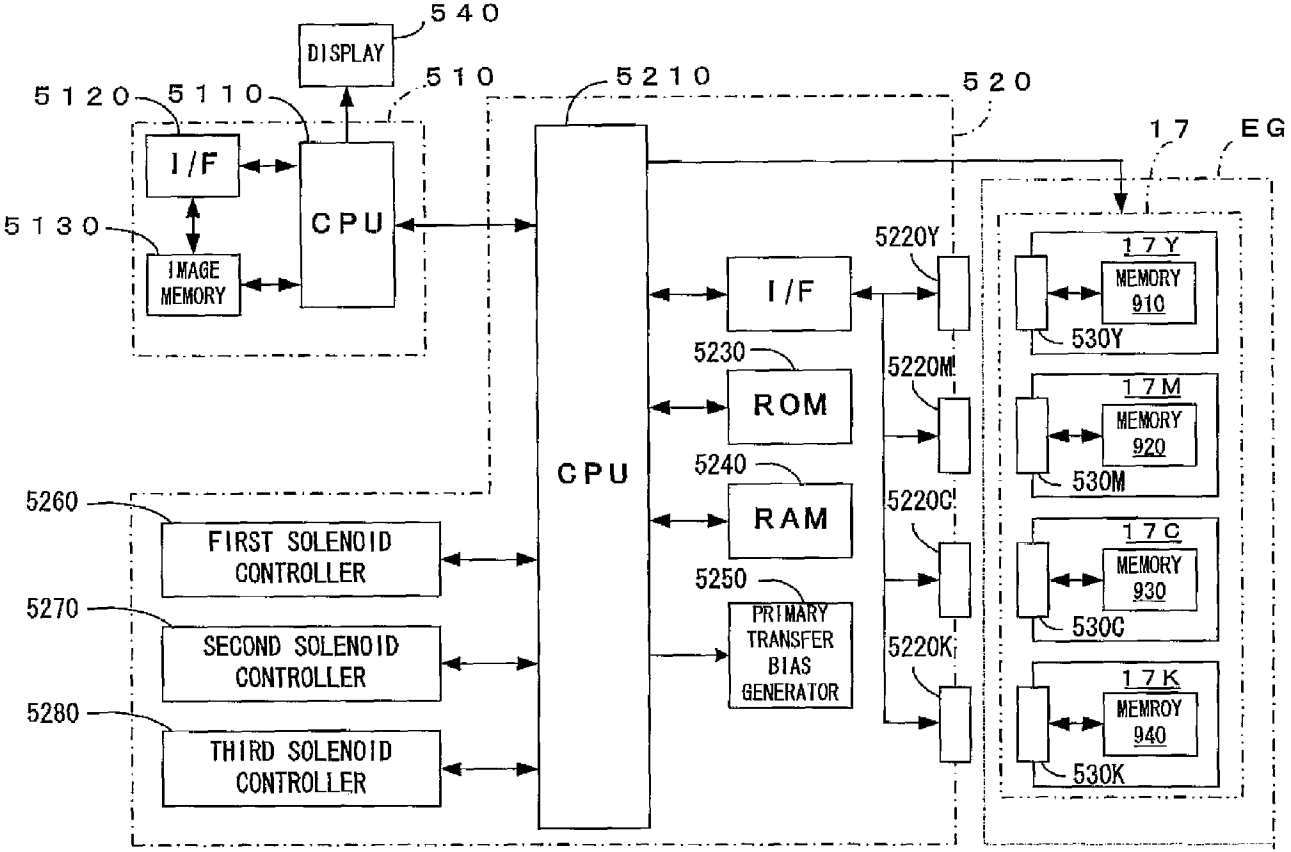
FIG. 12 is a block diagram showing an electrical arrangement of the apparatus according to the fourth embodiment.

FIG. 12 is a block diagram showing an electrical arrangement of the apparatus according to the fourth embodiment. FIG. 13 to FIG. 16 are diagrams showing the operations of the apparatus of the fourth embodiment. In the fourth embodiment, as well, the blade opposing roller 83 is biased by the tension spring 99 in the direction D83 to be moved away from the driving roller 82 and is free to reciprocate in the bias direction D83. The cleaner blade 711 is unified with the blade opposing roller 83, so that the cleaner blade is capable of reciprocating unitarily with the blade opposing roller 83. The primary transfer roller 85Y (most upstream color transfer member) disposed at the most upstream position in the transport direction D81 is rotatably supported by the first support member 95, whereas the first support member 95 is fixedly supported by the first solenoid S1. The first solenoid S1 is electrically connected to the first solenoid controller 5260 shown in FIG. 12. Accordingly, the first support member 95 and the primary transfer roller 85Y may be reciprocally moved in the stroke direction D(S1) of the first solenoid S1 by applying a proper signal to the first solenoid S1 from the first solenoid controller 5260.

Two primary color transfer rollers 85M, 85C (color transfer members) disposed at the second and third upstream positions in the transport direction D81 are rotatably supported by the second support member 97, whereas the second support member 97 is fixedly supported by the second solenoid S2. The second solenoid S2 is electrically connected to the second solenoid controller 5270 shown in FIG. 2. Accordingly, the second support member 97 and the primary transfer rollers 85M, 85C may be reciprocally moved in the stroke direction D(S2) of the second solenoid S2 by applying a proper signal to the second solenoid S2 from the second solenoid controller 5270.

Furthermore, the monochromatic primary transfer roller 85K (monochromatic transfer member) disposed at the most downstream position in the transport direction D81 is rotatably supported by a third support member 98, whereas the third support member 98 is fixedly supported by a third solenoid S3. The third solenoid S3 is electrically connected to a third solenoid controller 5280. Accordingly, the third support member 98 and the monochromatic primary transfer roller 85K may be reciprocally moved in a stroke direction D(S3) of the third solenoid S3 by applying a proper signal to the third solenoid S3 from the third solenoid controller 5280. Thus, the first solenoid controller 5260, the second solenoid controller 5270 and the third solenoid controller 5280 according to the fourth embodiment function as the "controller" of the invention.

Figure 13:
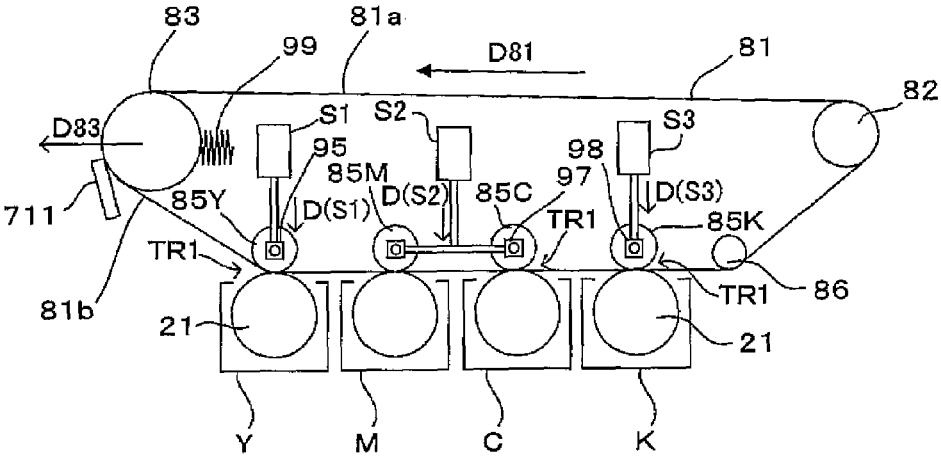
FIG. 13 is a diagram showing the operations of the apparatus of the fourth embodiment.

In the execution of the color mode, the first solenoid controller 5260, the second solenoid controller 5270 and the third solenoid controller 5280 apply the contacting signal to the solenoids S1, S2, S3. As shown in FIG. 13, the four primary transfer rollers 85Y, 85M, 85C, 85K are moved against the biasing force applied to the blade opposing roller 83 so as to be positioned in adjacency to the four image forming stations Y, M, C, K. And the four primary transfer rollers 85Y, 85M, 85C, 85K thrust the transfer belt 81 against the photosensitive drums 21 of the image forming stations Y, M, C, K, the transfer belt being tensioned by the blade opposing roller 83. Thus, the primary transfer positions TR1 are established. Then, as described above, the toner images formed by the respective image forming stations Y, M, C, K are primarily transferred to the surface of the transfer belt 81 at the primary transfer positions TR1.

Figure 14:
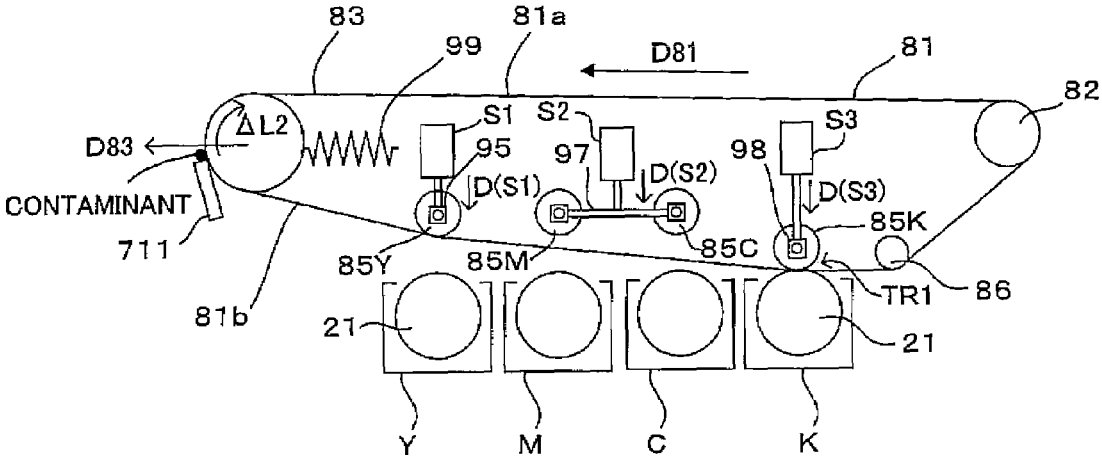
FIG. 14 is a diagram showing the operations of the apparatus of the fourth embodiment.

In the execution of the monochromatic mode, on the other hand, the first solenoid controller 5260 and the second solenoid controller 5270 apply the releasing signal to the solenoids S1, S2, whereas the third solenoid controller 5280 applies the contacting signal to the solenoid S3. As shown in FIG. 14, the monochromatic primary transfer roller 85K (monochromatic transfer member) is positioned in adjacency to the monochromatic image forming station K, while the primary color transfer rollers 85Y, 85M, 85C (color transfer members) are moved away from the respective opposite image forming stations Y, M, C. During the monochromatic mode, the transfer belt 81 is released from a thrust-condition in which the transfer belt 81 is thrust against the image forming stations Y, M, C by the color primary transfer rollers 85Y, 85M, 85C. Hence, the transfer belt 81 is spaced away from the image forming stations Y, M, C as being pulled by the blade opposing roller 83 biased by the tension spring 99. Consequently, the transfer belt 81 is thrust against only the monochromatic image forming station K during the monochromatic mode.

As shown in FIG. 13 and FIG. 14, the invention is constituted such that the distal end of the cleaner blade 711 is contacted against the blade opposing roller via the transfer belt 81 for cleaning the surface of the transfer belt 81 in both of the color mode and the monochromatic mode. The image forming apparatus of this constitution may encounter the following problem. During the monochromatic mode, the contaminant may adhere to the distal end of the cleaner blade 711 to produce the clearance between the transfer belt 81 and the distal end of the cleaner blade 711, as shown in FIG. 14, so that the surface of the transfer belt 81 may not be cleaned adequately. Hence, the fourth embodiment is adapted to perform, as needed, the following "thrusting step" and "releasing step" after the execution of the monochromatic mode.

Figure 15:
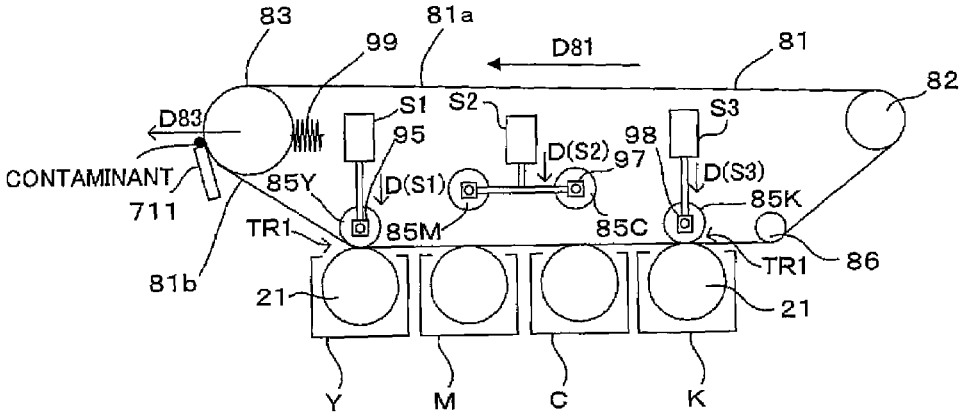
FIG. 15 is a diagram showing the operations of the apparatus of the fourth embodiment.

FIG. 15 is a diagram showing the thrusting step according to the fourth embodiment. The thrusting step is performed as follows. After the completion of the monochromatic mode shown in FIG. 14, the first solenoid controller 5260 applies, as needed, the contacting signal to the solenoid S1. Receiving the contacting signal, the solenoid S1 brings the color primary transfer roller 85Y (most upstream color transfer member) into contact against the image forming station Y At this time, the color primary transfer roller 85Y thrusts the transfer belt 81 against the image forming stations Y, M, C as pulling the transfer belt 81 against the biasing force applied to the blade opposing roller 83. The blade opposing roller 83, in turn, is moved in the opposite direction of the bias direction D83 to approach the driving roller 82 according to the pulling of the transfer belt 81 by the color primary transfer roller 85Y At this time, the contaminant stays adhered to the distal end of the cleaner blade 711. In this manner, the transfer belt 81 is thrust against the image forming stations Y, M, C by the thrusting step, which is followed by the releasing step as below.

Figure 16:
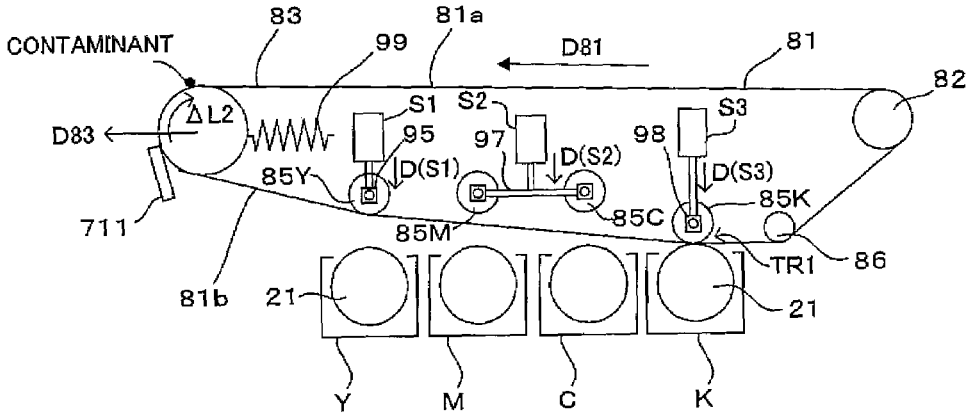
FIG. 16 is a diagram showing the operations of the apparatus of the fourth embodiment.

FIG. 16 is a diagram showing the releasing step according to the fourth embodiment. In the releasing step according to the fourth embodiment, the first solenoid controller 5260 (FIG. 12) applies the releasing signal to the solenoid S1, so as to move the first transfer roller 85Y away from the image forming station Y, as shown in FIG. 16. At this time, the blade opposing roller 83 is moved in the bias direction D83 as pulling the transfer belt 81 away from the image forming stations Y, M, C. At the same time, the blade opposing roller is followingly rotated in the opposite direction of the transport direction D81. Hence, the transfer belt 81 is moved in the opposite direction of the transport direction D81 in the contact position of the cleaner blade 711. Accordingly, the contaminant adhered to the distal end of the cleaner blade 711 is moved to the upstream side in the transport direction D81 by ΔL2.

According to the fourth embodiment as described above, the "thrusting step" is performed as needed after the completion of the monochromatic mode, thereby thrusting the transfer belt 81 against the image forming stations Y, M, C by means of the primary transfer roller 81Y Subsequently, the "releasing step" is performed to release the transfer belt 81 form the thrust-condition so that the transfer belt 81 is moved in the opposite direction of the transport direction D81 in the contact position where the cleaner blade 711 is contacted against the transfer belt 81. Even when the contaminant is adhered to the distal end of the cleaner blade 711, the contaminant may be separated in conjunction with the movement of the transfer belt 81. Therefore, the drive system is simplified, negating the need for the additional driving mechanism for rotating the transfer belt 81 in the opposite direction of the transport direction D81. In short, the forth embodiment is based on the more simplified structure for providing the effective separation of the contaminant adhered to the distal end of the cleaner blade 711, thus accomplishing the reduction of cost and size of the apparatus.

In the fourth embodiment, the operation of releasing the transfer belt 81 from the image forming stations Y, M, C as the "releasing step" is accomplished only by moving away the primary transfer roller 85Y (most upstream color transfer member). That is, the primary transfer rollers 85M, 85C are already spaced away from the image forming stations M, C when the operation of releasing the transfer belt 81 is started. Therefore, the operation of releasing the transfer belt 81 as the "releasing step" is not obstructed by the primary transfer rollers 85M, 85C. This leads to a quick release of the transfer belt 81 from the image forming stations Y, M, C, so that the transfer belt 81 may be quickly moved in the opposite direction of the transport direction D81 in the contact position of the distal end of the cleaner blade 711. Hence, the embodiment is preferred in that the contaminant adhered to the distal end of the cleaner blade 711 is more assuredly separated.

Fifth Embodiment

In the case where the contaminant is separated from the distal end of the cleaner blade 711 by moving the transfer belt 81 in the opposite direction of the transport direction D81 in the contact position where the distal end of the cleaner blade 711 is contacted against the transfer belt 81, as suggested by the fourth embodiment, the greater the quantity of movement of the transfer belt 81, the greater the effect to separate the contaminant. Hence, a constitution may be made as suggested by a fifth embodiment described as below. It is noted here that a basic arrangement of the apparatus is the same as that of the first or fourth embodiment. Hence, only characteristic parts of the fifth embodiment are described while the other parts thereof are represented by the equivalent characters, respectively, the description of which is dispensed with.

Figure 17:
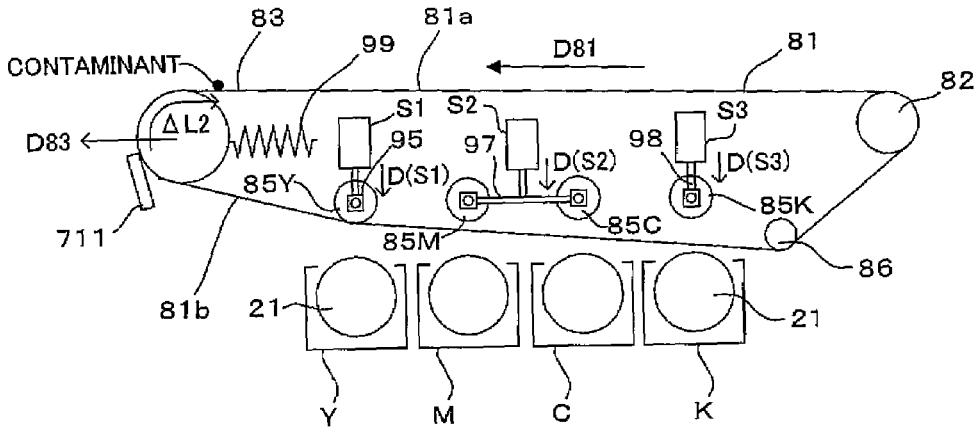
FIG. 17 is a diagram showing the operations of the apparatus of the fifth embodiment.

According to the above fourth embodiment, the first solenoid S1 is operated to move the primary transfer roller 85Y (most upstream color transfer member) away from the image forming station Y in the releasing step. In a "releasing step" according to the fifth embodiment, on the other hand, the third solenoid S3 moves the primary transfer roller 85K away from the image forming station K in synchronism with the releasing operation by means of the first solenoid S1 (FIG. 17). Thus, the first solenoid controller 5260, the second solenoid controller 5270 and the third solenoid controller 5280 according to the fifth embodiment function as the "controller" of the invention. Specifically, the first solenoid controller 5260 (FIG. 12) outputs the releasing signal to the first solenoid S1 while at the same time, the third solenoid controller 5280 (FIG. 12) outputs the releasing signal to the third solenoid S3, whereby the primary transfer rollers 85Y, 85K are moved away from the image forming stations Y, K. Thus is provided a greater variation ΔL2 of the circumferential length L2 on the image forming station side, as compared with the fourth embodiment. This results in a greater quantity of movement of the transfer belt 81 in the opposite direction of the transport direction D81 in the contact position where the distal end of the cleaner blade 711 is contacted against the transfer belt 81. Hence, the embodiment is preferred in that the contaminant adhered to the distal end of the cleaner blade 711 is more assuredly removed.

Sixth Embodiment

Next, an image forming apparatus according to a sixth embodiment will be described. It is noted here that a basic arrangement of the apparatus is the same as that of the first embodiment and hence, only characteristic parts of the sixth embodiment are described while the other parts thereof are represented by the equivalent characters, respectively, the description of which is dispensed with.

FIG. 18 to FIG. 21 are diagrams showing the operations of the apparatus according to the sixth embodiment. According to the sixth embodiment, the blade opposing roller 83 is biased by the tension spring 99 in the direction D83 to be moved away from the driving roller 82 and is free to reciprocate in the bias direction D83. The cleaner blade 711 is unified with the blade opposing roller 83, so that the cleaner blade is capable of reciprocating unitarily with the blade opposing roller 83. The apparatus of the sixth embodiment does not include the downstream guide roller 86, which is disposed in the first to the fifth embodiments. However, the apparatus is provided with an upstream guide roller 87 which is disposed on the downstream side of the blade opposing roller 83 in the transport direction D81 and on the upstream side of the primary transfer roller 85Y in the transport direction D81. Such an upstream guide roller 87 is located inside the transfer belt 81. In a state where the four primary transfer rollers 85Y, 85M, 85C, 85K are positioned in adjacency to the image forming stations Y, M, C, K, the upstream guide roller is so positioned as to contact the transfer belt 81 on an internal common tangent line of the primary transfer roller 85Y and the image forming station Y, thereby tensioning the transfer belt 81.

The upstream guide roller 87 is rotatably supported by the first support member 95, whereas the first support member 95 is fixedly supported by the first solenoid S1. The first solenoid S1 is electrically connected to the first solenoid controller 5260 shown in FIG. 12. Therefore, the first support member 95 and the upstream guide roller 87 may be reciprocally moved in the stroke direction D(S1) of the first solenoid S1 by applying a proper signal to the first solenoid S1 from the first solenoid controller 5260.

The primary color transfer rollers 85Y, 85M, 85C (color transfer members) are rotatably supported by the second support member 97, whereas the second support member 97 is fixedly supported by the second solenoid S2. The second solenoid S2 is electrically connected to the second solenoid controller 5270 shown in FIG. 12. Therefore, the second support member 97 and the primary transfer rollers 85Y, 85M, 85C (color transfer members) may be reciprocally moved in the stroke direction D(S2) of the second solenoid S2 by applying a proper signal to the second solenoid S2 from the second solenoid controller 5270.

The primary transfer roller 85K (monochromatic transfer member) is rotatably supported by the third support member 98, whereas the third support member 98 is fixedly supported by the third solenoid S3. The third solenoid S3 is electrically connected to the third solenoid controller 5280 shown in FIG. 12. Therefore, the third support member 98 and the primary transfer roller 85K (monochromatic transfer member) may be reciprocally moved in the stroke direction D(S3) of the third solenoid S3 by applying a proper signal to the third solenoid S3 from the third solenoid controller 5280. Thus, the first solenoid controller 5260, the second solenoid controller 5270 and the third solenoid controller 5280 according to the sixth embodiment function as the "controller" of the invention.

Figure 18:
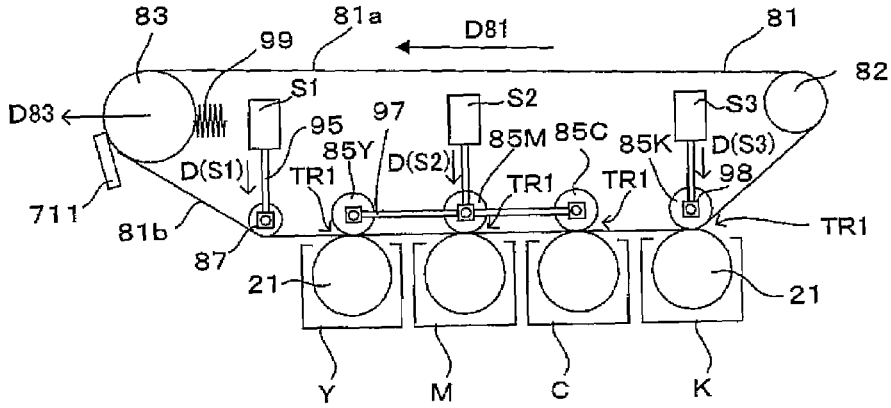
FIG. 18 is a diagram showing the operations of the apparatus according to the sixth embodiment.

In the execution of the color mode, the first solenoid controller 5260, the second solenoid controller 5270 and the third solenoid controller 5280 apply the contacting signal to the solenoids S1, S2, S3. As shown in FIG. 18, the four primary transfer rollers 85Y, 85M, 85C, 85K are positioned in adjacency to the four image forming stations Y, M, C, K, while the upstream guide roller 87 tensions the transfer belt 81, whereby the transfer belt 81 is thrust against the photosensitive drums of the image forming stations Y, M, C, K. Thus, the primary transfer positions TR1 are established. Then, as described above, the toner images formed by the respective image forming stations Y, M, C, K are primarily transferred to the surface of the transfer belt 81 at the primary transfer positions TR1.

Figure 19:
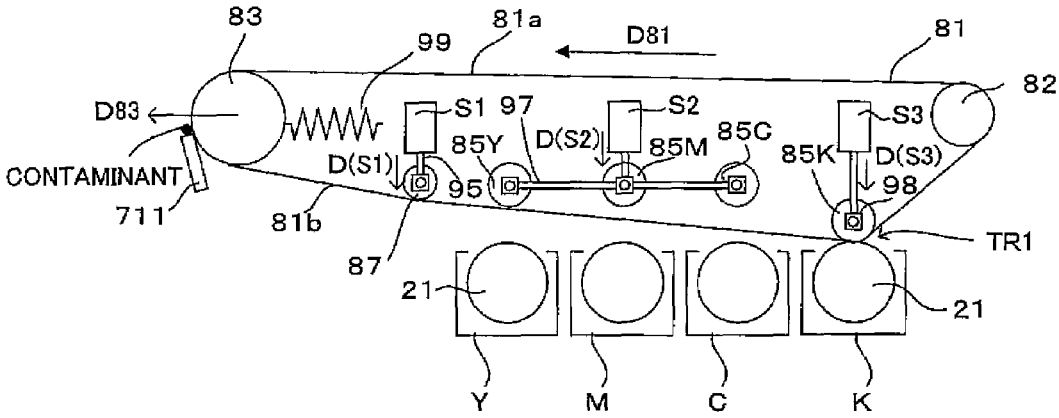
FIG. 19 is a diagram showing the operations of the apparatus according to the sixth embodiment.

In the execution of the monochromatic mode, on the other hand, the first solenoid controller 5260 and the second solenoid controller 5270 apply the releasing signal to the solenoids S1, S2, whereas the third solenoid controller 5280 applies the contacting signal to the solenoid S3. As shown in FIG. 19, the monochromatic primary transfer roller 85K (monochromatic transfer member) is positioned in adjacency to the monochromatic image forming station K, while the primary color transfer rollers 85Y, 85M, 85C (color transfer members) are moved away from the respective opposite image forming stations Y, M, C and the upstream guide roller 87 is moved inwardly of the transfer belt 81. During the monochromatic mode, therefore, the transfer belt 81 is released from a thrust-condition in which the transfer belt 81 is thrust against the image forming stations Y, M, C by the color primary transfer rollers 85Y, 85M, 85C. Hence, the transfer belt 81 is spaced away from the image forming stations Y, M, C as being pulled by the blade opposing roller 83 biased by the tension spring 99. Consequently, the transfer belt 81 is thrust against only the monochromatic image forming station K during the monochromatic mode.

As shown in FIG. 18 and FIG. 19, the invention is constituted such that the distal end of the cleaner blade 711 is contacted against the blade opposing roller via the transfer belt 81 for cleaning the surface of the transfer belt 81 in both of the color mode and the monochromatic mode. The image forming apparatus of this constitution may encounter the following problem. During the monochromatic mode, the contaminant may adhere to the distal end of the cleaner blade 711 to produce the clearance between the transfer belt 81 and the distal end of the cleaner blade 711, as shown in FIG. 18, so that the surface of the transfer belt 81 may not be cleaned adequately. Hence, the sixth embodiment is adapted to perform, as needed, the following "thrusting step" and "releasing step" after the execution of the monochromatic mode.

Figure 20:
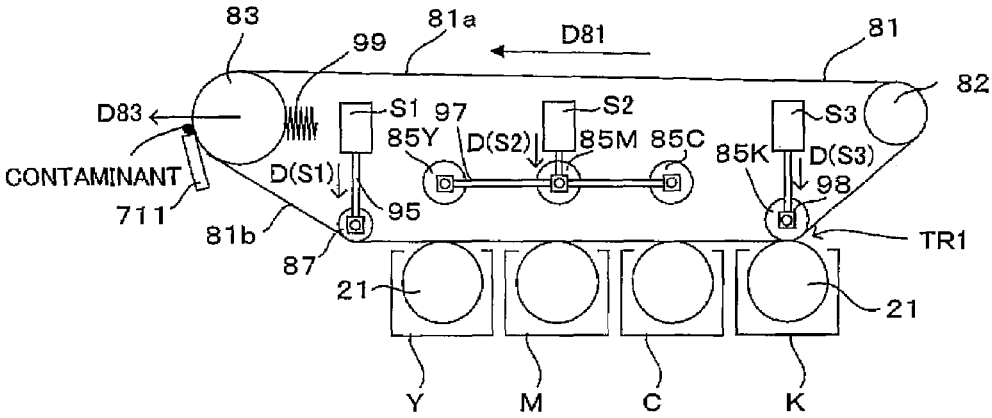
FIG. 20 is a diagram showing the operations of the apparatus according to the sixth embodiment.

FIG. 20 is a diagram showing the thrusting step according to the sixth embodiment. In the thrusting step, the first solenoid controller 5260 applies, as needed, the contacting signal to the solenoid S1 after the completion of the monochromatic mode shown in FIG. 19. Receiving the contacting signal, the solenoid S1 positions the upstream guide roller 87 to a position of the color mode. At this time, the upstream guide roller 87 tensions the transfer belt 81 as pulling the transfer belt 81 against the biasing force applied to the blade opposing roller 83, and also thrusts the transfer belt 81 against the image forming stations Y, M, C. The blade opposing roller 83, in turn, is moved in the opposite direction of the bias direction D83 to approach the driving roller 82 according to the pulling of the transfer belt 81 by the upstream guide roller 87. At this time, the contaminant stays adhered to the distal end of the cleaner blade 711. In this manner, the transfer belt 81 is thrust against the image forming stations Y, M, C by the thrusting step, which is followed by the releasing step as below.

Figure 21:
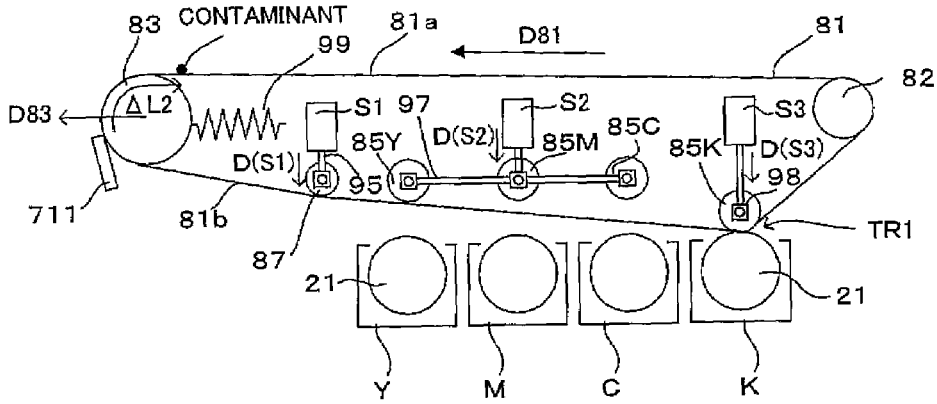
FIG. 21 is a diagram showing the operations of the apparatus according to the sixth embodiment.

FIG. 21 is a diagram showing the releasing step according to the sixth embodiment. In the releasing step of the sixth embodiment, the first solenoid controller 5260 (FIG. 12) outputs the releasing signal to the first solenoid S1, so as to move the upstream guide roller 87 inwardly of the transfer belt 81, as shown in FIG. 21. At this time, the blade opposing roller 83 is moved in the bias direction D83 as pulling the transfer belt 81 away from the image forming stations Y, M, C. At the same time, the blade opposing roller is followingly rotated in the opposite direction of the transport direction D81. Hence, the transfer belt 81 is moved in the opposite direction of the transport direction D81 in the contact position of the cleaner blade 711. Thus, the contaminant adhered to the distal end of the cleaner blade 711 is moved to the upstream side in the transport direction D81 by ΔL2.

According to the sixth embodiment as described above, the "thrusting step" is performed as needed after the completion of the monochromatic mode, thereby once allowing the upstream guide roller 87 to thrust the transfer belt 81 against the image forming stations Y, M, C, K. Subsequently, the "releasing step" is performed to release the transfer belt 81 from the thrust-condition so that the transfer belt 81 is moved in the opposite direction of the transport direction D81 in the contact position where the cleaner blade 711 is contacted against the transfer belt 81. Even when the contaminant is adhered to the distal end of the cleaner blade 711, the contaminant may be separated by moving the transfer belt 81. Therefore, the drive system is simplified, negating the need for the additional driving mechanism for rotating the transfer belt 81 in the opposite direction of the transport direction D81. In short, the sixth embodiment is based on the more simplified structure for providing the effective separation of the contaminant adhered to the distal end of the cleaner blade 711, thus accomplishing the reduction of cost and size of the apparatus.

In the sixth embodiment, the operation of releasing the transfer belt 81 from the image forming stations as the "releasing step" is accomplished only by moving away the upstream guide roller 87. That is, the primary transfer rollers 85Y, 85M, 85C are already spaced away from the image forming stations Y, M, C when the operation of releasing the transfer belt 81 is started. Hence, the operation of releasing the transfer belt 81 as the "releasing step" is not obstructed by the primary transfer rollers 85Y, 85M, 85C. This leads to the quick release of the transfer belt 81 from the image forming stations Y, M, C, so that the transfer belt 81 may be quickly moved in the opposite direction of the transport direction D81 in the contact position of the distal end of the cleaner blade 711. Therefore, the embodiment is preferred in that the contaminant adhered to the distal end of the cleaner blade 711 is more assuredly separated.

Seventh Embodiment

In the case where the contaminant is separated from the distal end of the cleaner blade 711 by moving the transfer belt 81 in the opposite direction of the transport direction D81 in the contact position where the distal end of the cleaner blade 711 is contacted against the transfer belt 81, as suggested by the sixth embodiment, the greater the quantity of movement of the transfer belt 81, the greater the effect to separate the contaminant. Accordingly, a constitution may be made as suggested by a seventh embodiment described as below. It is noted here that a basic arrangement of the apparatus is the same as that of the first or sixth embodiment and hence, only characteristic parts of the seventh embodiment are described while the other parts thereof are represented by the equivalent characters, respectively, the description of which is dispensed with.

Figure 22:
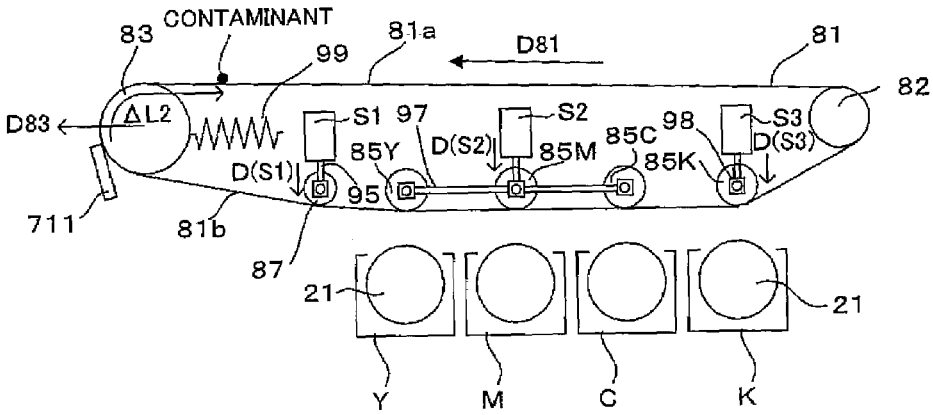
FIG. 22 is a diagram showing the operations of the apparatus according to the seventh embodiment.

In the above sixth embodiment, the first solenoid S1 is operated to move the upstream guide roller 87 inwardly of the transfer belt 81 in the releasing step. In a "releasing step" according to the seventh embodiment, on the other hand, the third solenoid S3 moves the primary transfer roller 85K away from the image forming station K in synchronism with the releasing operation by means of the first solenoid S1, as shown in FIG. 22. That is, the first solenoid controller 5260, the second solenoid controller 5270 and the third solenoid controller 5280 according to the seventh embodiment function as the "controller" of the invention. Specifically, the first solenoid controller 5260 outputs the releasing signal to the first solenoid S1 while at the same time, the third solenoid controller 5280 (FIG. 12) outputs the releasing signal to the third solenoid S3, whereby the upstream guide roller 87 is moved inwardly of the transfer belt 81 and the primary transfer roller 85K is moved away from the image forming station K. Thus is provided a greater variation ΔL2 of the circumferential length L2 of the transfer belt on the image forming station side, as compared with the sixth embodiment. This results in a greater quantity of movement of the transfer belt 81 in the opposite direction of the transport direction D81 in the contact position where the distal end of the cleaner blade 711 is contacted against the transfer belt 81. Therefore, the embodiment is preferred in that the contaminant adhered to the distal end of the cleaner blade 711 is more assuredly removed.

Eighth Embodiment

A transfer belt unit 8 according to an eighth embodiment includes: the driving roller 82; the follower roller 83 (blade opposing roller) disposed on the left-hand side of the driving roller 82 as seen in FIG. 1; and the transfer belt 81 stretched around these rollers and driven into circulation in the direction of the arrow D81 (transport direction) in the figure. The transfer belt unit 8 further includes the four primary transfer rollers 85Y, 85M, 85C, 85K (transfer member) which are disposed inside the transfer belt 81 and which oppose the respective photosensitive drums 21 of the image forming stations Y, M, C, K in one-on-one relation when the photosensitive cartridges are mounted in the apparatus. As shown in FIG. 1, these primary transfer rollers 85 are positioned in adjacency to the respective opposite image forming stations Y, M, C, K, thereby thrusting the transfer belt 81 against the respective photosensitive drums 21 of the image forming stations Y, M, C, K. As a result, the primary transfer positions TR1 are established between the respective photosensitive drums 21 and the transfer belt 81. The primary transfer rollers are each electrically connected to the primary transferring-bias generator 5250. These primary transfer rollers 85 are contacted against the respective opposite photosensitive drums 21 via the transfer belt 81. In the meantime, the primary transferring-bias generator 5250 applies the primary transferring bias to each of the primary transfer rollers 85 in a proper timing. Thus, the toner images formed on the respective surfaces of the photosensitive drums 21 may be transferred onto the surface of the transfer belt 81 at the primary transfer positions TR1 where the respective photosensitive drums 21 are contacted against the transfer belt 81.

The transfer belt unit 8 further includes the guide roller 86 (downstream guide roller) disposed on the downstream side of the primary transfer roller 85K (most-downstream-transfer-member) and on the upstream side of the driving roller 82, the roller 85K disposed at the most downstream position of those of the four primary transfer rollers 85Y, 85M, 85C, 85K in the transport direction D81. The downstream guide roller 86 is adapted to contact the transfer belt 81 on an internal common tangent line of the primary transfer roller 85K and the photosensitive drum 21 of the image forming station K at the primary transfer position TR1. The internal common tangent line is tangent both to the monochromatic primary transfer position TR1 at which the monochromatic primary transfer roller 85K contacts against the photosensitive drum 21 of the image forming station K. While the primary transfer rollers 85, the follower roller 83 (blade opposing roller) and the downstream guide roller 86 possess a moving mechanism, respectively, a specific description of which will be made hereinlater.

Figure 23:
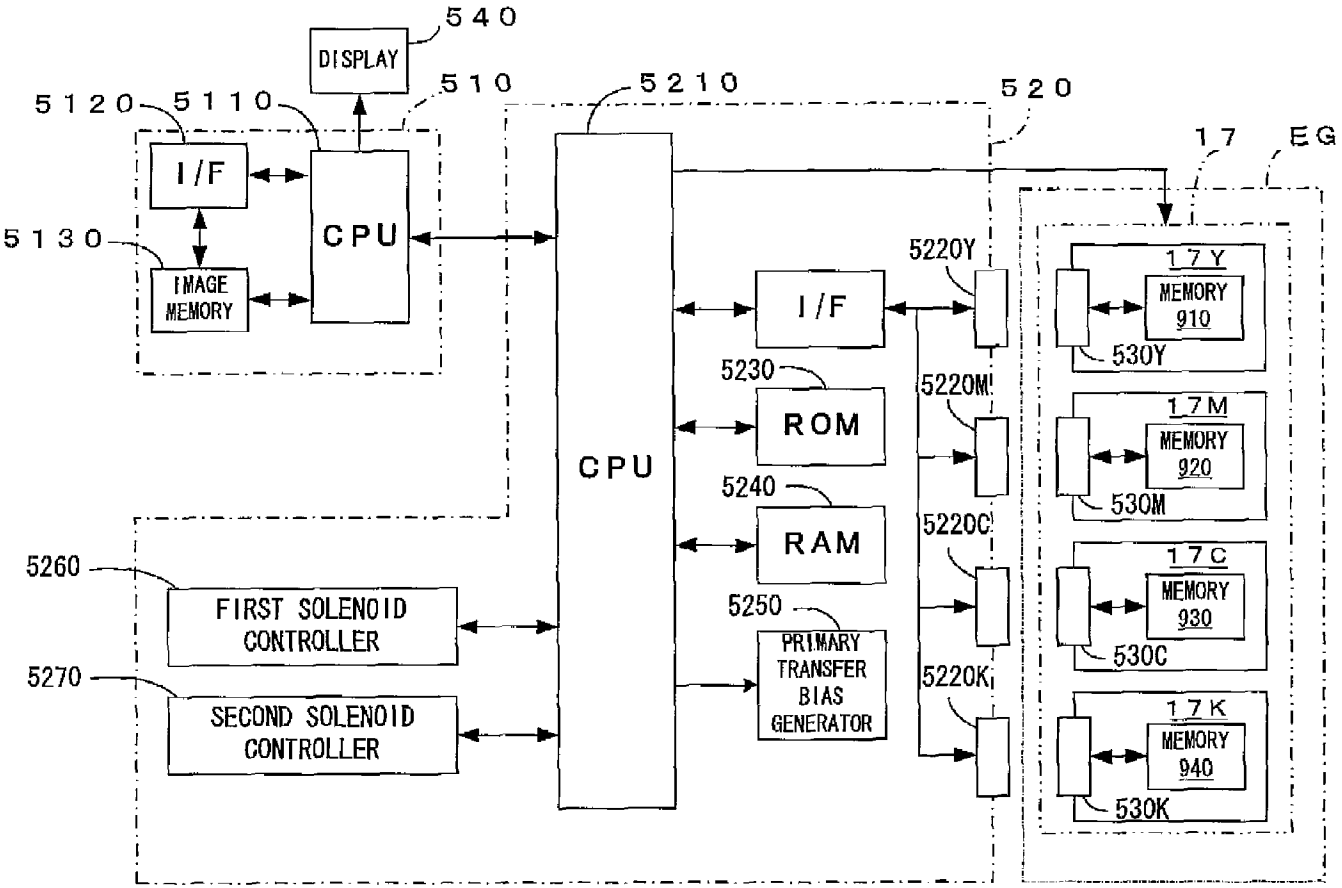
FIG. 23 is a block diagram showing an electrical arrangement of the embodiment.
Figure 24:
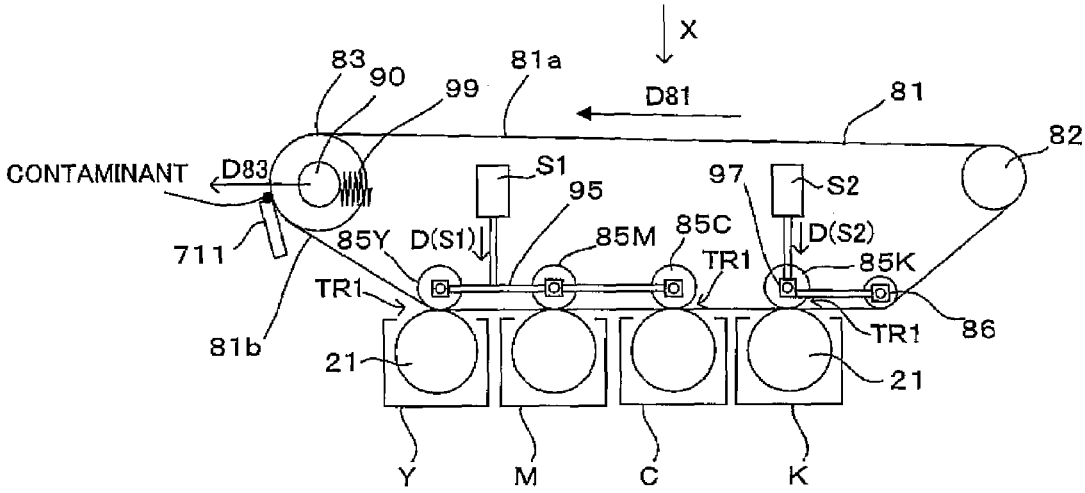
FIG. 24 is a diagram showing the moving mechanisms of the blade opposing roller, the primary transfer and the downstream guide roller according to the embodiment.

FIG. 23 is a block diagram showing an electrical arrangement of the embodiment. FIG. 24 is a diagram showing the moving mechanisms of the blade opposing roller 83, the primary transfer rollers 85Y, 85M, 85C, 85K and the downstream guide roller 86 according to the embodiment. The upstream three color primary transfer rollers 85Y, 85M, 85C in the transport direction D81 are rotatably supported by the first support member 95, whereas the first support member 95 is fixedly supported by the first solenoid S1. The first solenoid S1 is electrically connected to the first solenoid controller 5260 shown in FIG. 23. Hence, the first support member 95 and the primary transfer rollers 85Y, 85M, 85C may be reciprocally moved in the stroke direction D(S1) of the first solenoid S1 by applying a proper signal to the first solenoid S1 from the first solenoid controller 5260. On the other hand, the primary transfer roller 85K at the most downstream position in the transport direction D81 and the downstream guide roller 86 are rotatably supported by the second support member 97. The second support member 97 is fixedly supported by the second solenoid S2. The second solenoid S2 is electrically connected to the second solenoid controller 5270 shown in FIG. 23. Hence, the second support member 97 and the primary transfer roller 85K may be reciprocally moved in the stroke direction D(S2) of the second solenoid S2 by applying a proper signal to the second solenoid S2 from the second solenoid controller 5270. As will be specifically described hereinlater, the blade opposing roller 83 is biased in the bias direction D83 and is free to reciprocate in the bias direction D83.

According to the eighth embodiment as shown in FIG. 24, the four primary transfer rollers 85Y, 85M, 85C, 85K are positioned in adjacency to the four image forming stations Y, M, C, K, thereby thrusting the transfer belt 81 against the photosensitive drums 21 of the image forming stations Y, M, C, K as acting against the biasing force applied to the blade opposing roller 83. Thus, the primary transfer positions TR1 are established.

Figure 25:
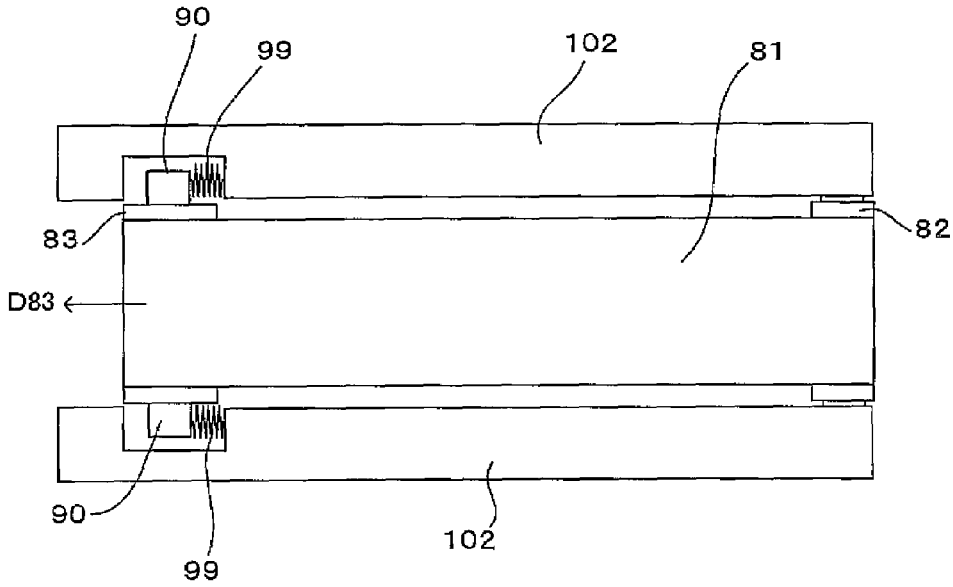
FIG. 25 is a diagram showing the moving mechanism of the blade opposing roller as seen in an X-direction shown in FIG. 24.

FIG. 25 is a diagram showing the moving mechanism of the blade opposing roller 83 as seen in an X-direction shown in FIG. 24. FIG. 25 corresponds to a state where the transfer belt 81 is thrust against the image forming stations Y, M, C, K. The blade opposing roller 83 is pivotably supported about two movable pivots 90 disposed at opposite ends of the blade opposing roller 83. The two movable pivots 90 are free to reciprocate in a transverse direction as seen in FIG. 24. Furthermore, the movable pivots 90 are biased by tension springs in a direction (bias direction D83) to be moved away from the driving roller 82, the tension spring having one end thereof connected to a frame 102 fixed to the housing body. Thus, the blade opposing roller 83 is adapted to reciprocate in the bias direction D83 as biased in the bias direction D83. Therefore, the blade opposing roller 83 functions as a so-called tension roller for applying a given tension to the transfer belt 81. Thus, the movable pivots 90 and the tension springs 99 according to the eighth embodiment function as a "biasing member" of the invention.

In such a state shown in FIG. 24, FIG. 25, when the first solenoid controller 5360 sends the releasing signal to the solenoid S1 whereas the second solenoid controller 5270 sends the releasing signal to the solenoid S2 so that the primary transfer rollers 85Y, 85M, 85C, 85K are moved away from the image forming stations Y, M, C, K whereas the downstream guide roller 86 is moved inwardly of the transfer belt 81, the transfer belt 81 is released from the a thrust-condition in which the transfer belt 81 is thrust against the image forming stations Y, M, C, K by the color primary transfer rollers 85Y, 85M, 85C, 85K. As the primary transfer rollers 85Y, 85M, 85C, 85K and the downstream guide roller 86 are moved, therefore, the blade opposing roller 83 is moved in the bias direction D83 as pulling the transfer belt 81 with a given tension. Consequently, the transfer belt 81 is spaced away from the image forming stations Y, M, C, K. Thus, the first solenoid controller 5260, the second solenoid controller 5270, the first solenoid S1, the second solenoid S2, the first support member 95 and the second support member 97 according to the eighth embodiment function as a "positioner" of the invention. As will be described as below, the blade opposing roller 83 is moved for a predetermined distance in the bias direction D83 before halt.

Figure 26:
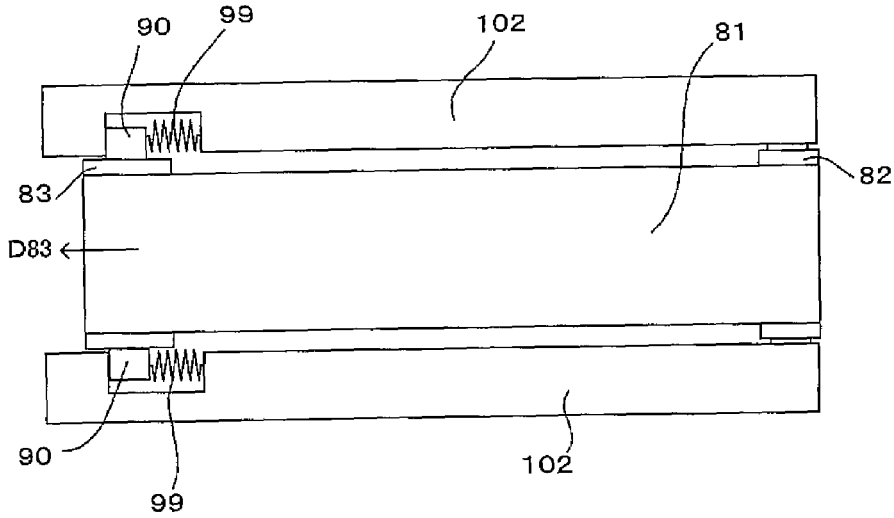
FIG. 26 is a diagram showing the moving mechanism of the blade opposing roller in a halt condition into which the blade opposing roller moved for the predetermined distance in the bias direction.
Figure 27:
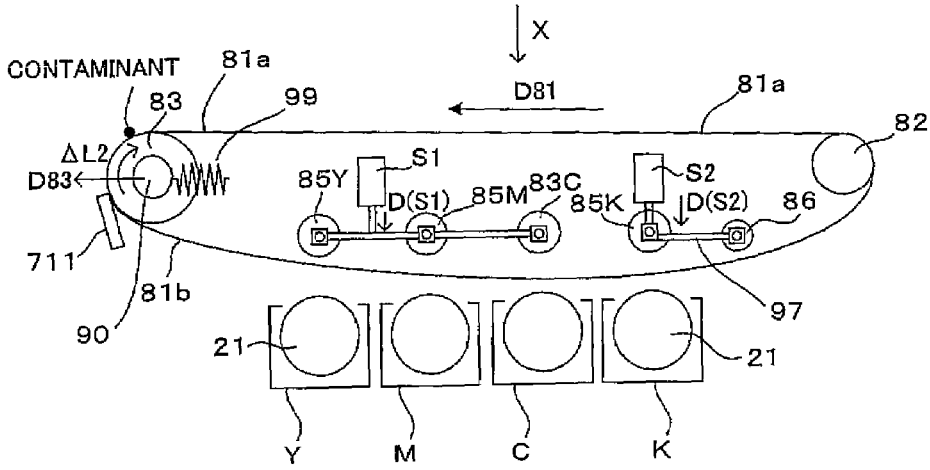
FIG. 27 is a diagram showing the moving mechanism of the blade opposing roller in a halt condition into which the blade opposing roller moved for the predetermined distance in the bias direction.

FIG. 26 and FIG. 27 are diagrams showing the moving mechanism of the blade opposing roller 83 in a halt condition into which the blade opposing roller 83 moved for the predetermined distance in the bias direction. FIG. 26 shows the moving mechanism as seen in the X-direction shown in FIG. 27. As shown in FIG. 26, the movable pivots 90 for pivotably supporting the blade opposing roller 83 are moved for the predetermined distance in the bias direction D83 in conjunction with the transfer belt 81 released from the thrust-condition, before coming into abutment against the frame 102 (abutment member). The frame 102 is fixed to the housing body. Hence, the movable pivots 90 are prevented from moving any farther in the bias direction D83 so as to be halted. Accordingly, the blade opposing roller 83 pivotably supported about such movable pivots 90 is also brought into halt. After the blade opposing roller 83 is thus halted, the blade opposing roller 83 is no more capable of tensioning the transfer belt 81 by pulling the transfer belt 81 in the bias direction D83. As a result, the transfer belt 81 is decreased in tension, as shown in FIG. 27. Thus, the frame 102 according to the eighth embodiment functions as a "limiting member" of the invention.

As the primary transfer rollers 85Y, 85M, 85C, 85K and the downstream guide roller 86 are moved by the "positioner" as described above, the blade opposing roller 83 is moved in the bias direction D83 as pulling the transfer belt 81 with the given tension. The blade opposing roller 83 is moved in the direction to be spaced away from the driving roller 82. During the period of releasing operation between the start of movement of the transfer belt 81 and the halt thereof the circumferential length L1 (circumferential length L1 on the opposite side from the image forming station) of the transfer belt portion 81*a* extending from the driving roller 82 to the blade opposing roller in the transport direction D81 of the transfer belt 81 is increased, while the circumferential length L2 (circumferential length L2 on the image forming station side) of the transfer belt portion 81*b* extending from the driving roller 82 to the blade opposing roller 83 in the opposite direction of the transport direction D81 of the transfer belt 81 is decreased.

The transfer belt 81 is tensioned during such a releasing operation, so that the transfer belt 81 is moved away from the image forming stations Y, M, C, K as tensioned by the driving roller 82. During the operation of releasing the transfer belt 81, therefore, a relatively high frictional force exists between the driving roller 82 and the transfer belt 81. At this time, the driving roller is at standstill. Therefore, the transfer belt 81 does not move relative to the driving roller 82. On the other hand, the blade opposing roller 83 is the follower roller. Hence, the blade opposing roller is rotated by a quantity corresponding to the increase of the circumferential length L1, as pulled by the transfer belt 81, in the opposite direction of the transport direction D81. As described above, the cleaner blade 711 is unified with the blade opposing roller 83, so that the cleaner blade 711 is also moved unitarily with the blade opposing roller 83 so moved. Therefore, the relative position between the cleaner blade 711 and the blade opposing roller 83 is unchanged. Therefore, when the blade opposing roller 83 is rotated in the opposite direction of the transport direction D81 by the variation ΔL2 of the circumferential length L2 on the image forming station side, the transfer belt 81 is moved in the opposite direction of the transport direction D81 by the variation ΔL2 of the circumferential length in the contact position where the distal end of the cleaner blade 711 is contacted against the transfer belt 81. Accordingly, the contaminant adhered to the distal end of the cleaner blade 711 in the state of FIG. 24 is moved in the opposite direction of the transport direction D81 by the variation ΔL2 of the circumferential length, as shown in FIG. 27, by moving the primary transfer rollers 85Y, 85M, 85C, 85K away from the image forming stations Y, M, C, K by means of the "positioner". Thus is separated the contaminant adhered to the distal end of the cleaner blade 711.

The apparatus according to the eighth embodiment is adapted to remove the contaminant adhered to the distal end of the cleaner blade 711 simply by operating, as needed, the "positioner" to move the primary transfer rollers 85Y, 85M, 85C, 85K away from the image forming stations Y, M, C, K and to move the downstream guide roller 86 inwardly of the transfer belt 81. Hence, the drive system is simplified, negating the need for the additional driving mechanism for rotating the transfer belt 81 in the opposite direction of the transport direction D81. In short, the apparatus of the eighth embodiment is based on the more simplified structure for providing the effective separation of the contaminant adhered to the distal end of the cleaner blade 711, thus accomplishing the reduction of cost and size thereof.

When the blade opposing roller 83 is moved for the predetermined distance in the bias direction D83 as the aforementioned "positioner" releases the transfer belt 81 from the thrust-condition, the movable pivots 90 are abutted against the frame 102 (abutment member, limiting member) so that the blade opposing roller 83 is halted. This results in a decreased tension of the transfer belt 81. Therefore, even in a case where the apparatus is not operated for image forming operations and left in shutdown for long hours, the transfer belt may be prevented from sustaining unwanted curling so that the transfer belt may be increased in service life.

According to the eighth embodiment as described above, when the "positioner" is operated to release the transfer belt 81 from the thrust-condition, the transfer belt 81 is first moved away as being applied with the given tension and thereafter, the tension of the transfer belt 81 is decreased to prevent the transfer belt 81 from sustaining the unwanted curling. The apparatus of the eighth embodiment not only provides the effective separation of the contaminant adhered to the distal end of the cleaner blade by means of the more simplified structure, but also achieves the extended service life of the transfer belt 81. Thus, the apparatus accomplishes the reduction of cost and size thereof.

Ninth Embodiment

In the case where the contaminant adhered to the distal end of the cleaner blade 711 is separated by moving the transfer belt 81 in the opposite direction of the transfer direction D81 in the contact position of the cleaner blade 711, as described above, it is preferred to quickly move the transfer belt 81. Hence, the image forming apparatus may be arranged as suggested by a ninth embodiment described as below. It is noted here that a basic arrangement of the apparatus is the same as that of the eighth embodiment and hence, only characteristic parts of the ninth embodiment are described while the other parts thereof are represented by the equivalent characters, respectively, the description of which is dispensed with.

Figure 28:
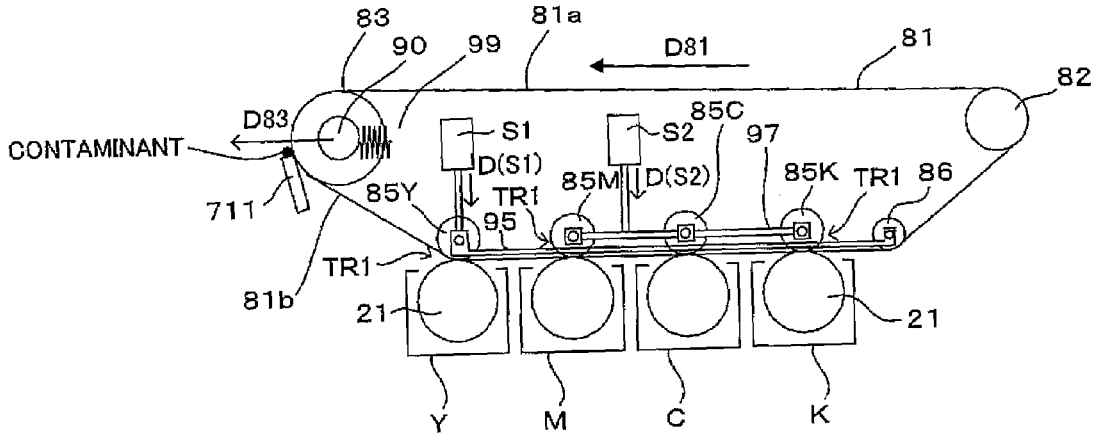
FIG. 28 is a diagram showing the operations of the apparatus of the ninth embodiment.
Figure 29:
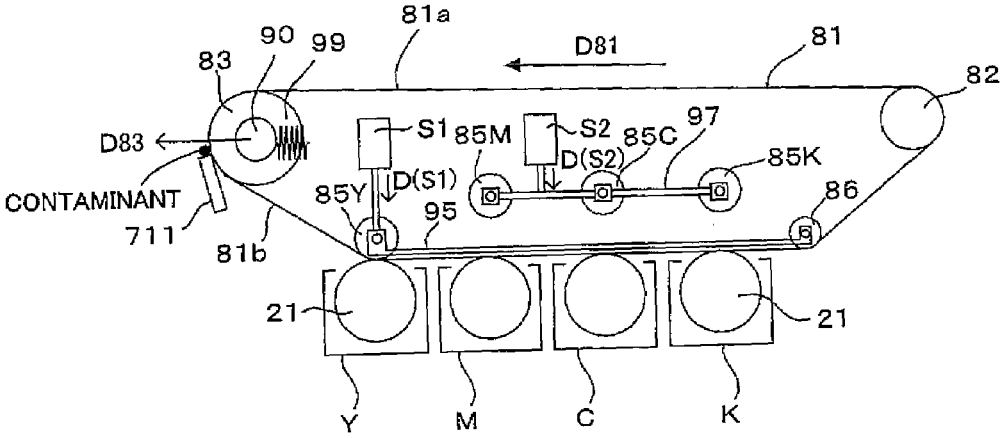
FIG. 29 is a diagram showing the operations of the apparatus of the ninth embodiment.
Figure 30:
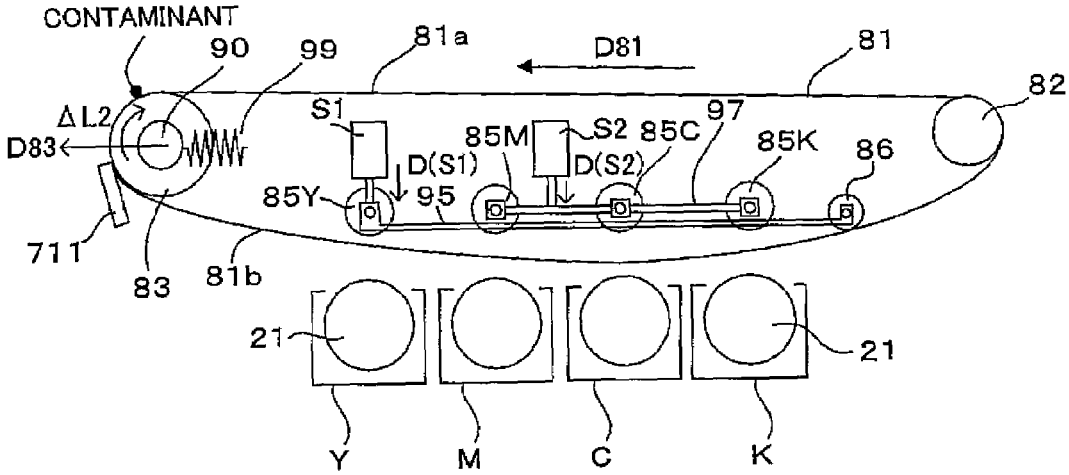
FIG. 30 is a diagram showing the operations of the apparatus of the ninth embodiment.

FIG. 28 to FIG. 30 are diagrams showing the operations of the apparatus of the ninth embodiment. In the ninth embodiment, as well, the moving mechanism of the blade opposing roller 83 has the structure shown in FIG. 25 and FIG. 26. That is, the movable pivots 90 and the tension springs 99 function as the "biasing member" of the invention, whereas the frame 102 functions as the "limiting member" of the invention. Accordingly, the blade opposing roller 83 is biased in the bias direction D83 to be moved away from the driving roller 82 and is adapted to reciprocate in the bias direction D83. The cleaner blade 711 is unified with the blade opposing roller 83, so that the cleaner blade 711 is capable of reciprocating unitarily with the blade opposing roller 83. The primary transfer roller 85Y (most-upstream-transfer-member) at the most upstream position in the transport direction D81 and the downstream guide roller 86 are rotatably supported by the first support member 95, whereas the first support member 95 is fixedly supported by the first solenoid S1. The first solenoid S1 is electrically connected to the first solenoid controller 5260 of FIG. 23. Therefore, the first support member 95 and the primary transfer roller 85Y may be reciprocally moved in the stroke direction D(S1) of the first solenoid S1 by applying a proper signal to the first solenoid S1 from the first solenoid controller 5260. On the other hand, the three primary transfer rollers 85M, 85C, 85K at the second to fourth upstream positions in the transport direction D81 are rotatably supported by the second support member 97. The second support member 97 is fixedly supported by the second solenoid S2. The second solenoid S2 is electrically connected to the second solenoid controller 5270 of FIG. 23. Therefore, the second support member 97 and the primary transfer rollers 85M, 85C, 85K may be reciprocally moved in the stroke direction D(S2) of the second solenoid S2 by applying a proper signal to the second solenoid S2 from the second solenoid controller 5270.

In the ninth embodiment as well, the four primary transfer rollers 85Y, 85M, 85C, 85K are positioned in adjacency to the four image forming stations Y, M, C, K for thrusting the transfer belt 81 against the photosensitive drums 21 of the image forming stations Y, M, C, K, whereby the primary transfer positions TR1 are established, as shown in FIG. 28.

According to the ninth embodiment, except the primary transfer roller 85Y (most-upstream-transfer-member) disposed at the most upstream position in the transport direction D81, the three primary transfer rollers 85M, 85C, 85K of the four primary transfer rollers 85Y, 85M, 85C, 85K in the state shown in FIG. 28 are moved away from the image forming stations M, C, K by means of the second solenoid S2. Specifically, the second solenoid controller 5270 (FIG. 23) outputs the releasing signal to the second solenoid S2 so as to move the three primary transfer rollers 85M, 85C, 85K away from the image forming stations M, C, K. At this time, as shown in FIG. 29, the transfer belt 81 is not released from the thrust-condition simply by moving the three primary transfer rollers 85M, 85C, 85K away from the image forming stations M, C, K. The transfer belt is still thrust against the image forming stations Y, M, C, K by the primary transfer roller 85Y and the downstream guide roller 86.

According to the ninth embodiment, the apparatus in the state shown in FIG. 29 subsequently operates the first solenoid controller 5260 (FIG. 23) to output the releasing signal to the first solenoid S1, thereby moving the primary transfer roller 85Y away from the image forming station Y and moving the downstream guide roller 86 inwardly of the transfer belt 81 (FIG. 30). The transfer belt 81 is released from the thrust-condition, in which the transfer belt 81 is thrust against the image forming stations Y, M, C, K, only after the primary transfer roller 85Y is moved away and the downstream guide roller 86 is moved inwardly. Thus, the first solenoid controller 5260, the first solenoid S1, the first support member 95, the second solenoid controller 5270, the second solenoid S2 and the second support member 97 according to the ninth embodiment function as the "positioner" of the invention.

According to the ninth embodiment as described above, the three primary transfer rollers 85M, 85C, 85K except for the primary transfer roller 85Y (most-upstream-transfer-member) are first moved away from the image forming stations M, C, K, before the primary transfer roller 85Y is moved away from the image forming station Y Therefore, the transfer belt 81 is released from the thrust-condition in which the transfer belt 81 is thrust against the image forming stations Y, M, C, K only after the primary transfer roller 85Y is moved away from the image forming station and the downstream guide roller is moved inwardly. The primary transfer rollers 85M, 85C, 85K are already spaced away from the image forming stations M, C, K when the blade opposing roller 83 is allowed to move as the transfer belt81 is released from the thrust-condition, thereby moving the transfer belt 81 away from the image forming stations Y, M, C, K. Hence, the operation of releasing the transfer belt 81 is not obstructed by the primary transfer rollers 85M, 85C, 85K and may be accomplished quickly. As a result, the transfer belt 81 may be moved quickly in the opposite direction of the transport direction D81 in the contact position where the distal end of the cleaner blade 711 is contacted against the transfer belt 81. That is, the embodiment is preferred in that the contaminant adhered to the distal end of the cleaner blade 711 is more assuredly separated.

In the ninth embodiment as well, when the blade opposing roller 83 is allowed to move for the predetermined distance in the bias direction D83 as the aforesaid positioner releases the transfer belt 81 from the thrust-condition, the movable pivots 90 are abutted against the frame 102 (abutment member, limiting member) so as to halt the blade opposing roller 83. This results in the decreased tension of the transfer belt 81. Therefore, even in the case where the apparatus is not operated for image forming operations and left in shutdown for long hours, the transfer belt 81 may be prevented from sustaining the unwanted curling so that the transfer belt 81 may be increased in service life.

In the ninth embodiment as well, when the "positioner" releases the transfer belt 81 from the thrust-condition, the transfer belt 81 is first moved away as being applied with the given tension. Subsequently, the transfer belt 81 is decreased in tension so as to be prevented from sustaining the unwanted curling. Thus, the embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Tenth Embodiment

All the foregoing embodiments are provided with the downstream guide roller 86. However, an image forming apparatus omitting the downstream guide roller 86 may be arranged as suggested by the tenth embodiment as below. It is noted here that a basic arrangement of the apparatus is the same as that of the eighth embodiment and hence, only characteristic parts of the tenth embodiment are described while the other parts thereof are represented by the equivalent characters, respectively, the description of which is dispensed with.

Figure 31:
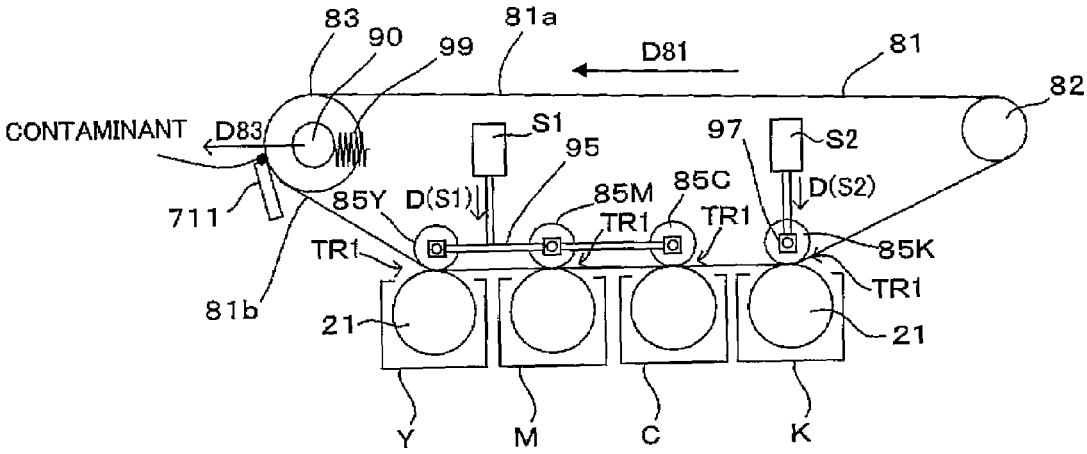
FIG. 31 is a diagram showing the operations of the apparatus of the tenth embodiment.
Figure 32:
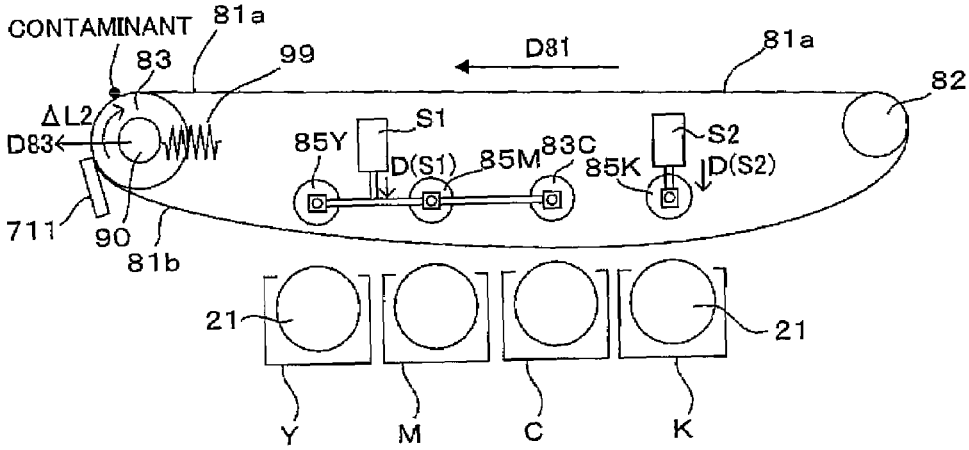
FIG. 32 is a diagram showing the operations of the apparatus of the tenth embodiment.

FIG. 31 and FIG. 32 are diagrams showing the operations of the apparatus of the tenth embodiment. In the tenth embodiment as well, the moving mechanism of the blade opposing roller 83 has the structure shown in FIG. 25 and FIG. 26. That is, the movable pivots 90 and the tension springs 99 function as the "biasing member" of the invention, whereas the frame 102 functions as the "limiting member" of the invention. In the tenth embodiment as well, the blade opposing roller 83 is biased by the tension springs 99 in the bias direction D83 to be moved away from the driving roller 82 and is adapted to reciprocate in the bias direction D83. The cleaner blade 711 is unified with the blade opposing roller 83, so that the cleaner blade 711 is capable of reciprocating unitarily with the blade opposing roller 83. The apparatus of the tenth embodiment is constituted to omit the downstream guide roller 86 which is provided in the eighth and ninth embodiments described above. The primary transfer rollers 85Y, 85M, 85C are rotatably supported by the first support member 95, whereas the first support member 95 is fixedly supported by the first solenoid S1. The first solenoid S1 is electrically connected to the first solenoid controller 5260 of FIG. 23. Hence, the first support member 95 and the primary transfer rollers 85Y, 85M, 85C may be reciprocally moved in the stroke direction D(S1) of the first solenoid S1 by applying a proper signal to the first solenoid S1 from the first solenoid controller 5260. On the other hand, the primary transfer roller 85K is rotatably supported by the second support member 97. The second support member 97 is fixedly supported by the second solenoid S2. The second solenoid S2 is electrically connected to the second solenoid controller 5270 of FIG. 23. Hence, the second support member 97 and the primary transfer roller 85K may be reciprocally moved in the stroke direction D(S2) of the second solenoid S2 by applying a proper signal to the second solenoid S2 from the second solenoid controller 5270.

In the tenth embodiment as well, the four primary transfer rollers 85Y, 85M, 85C, 85K are positioned in adjacency to the four image forming stations Y, M, C, K for thrusting the transfer belt 81 against the photosensitive drums 21 of the image forming stations Y, M, C, K, whereby the primary transfer positions TR1 are established, as shown in FIG. 31.

According to the tenth embodiment, the four primary transfer rollers 85Y, 85M, 85C, 85K in a state shown in FIG. 31 are moved away from the four image forming stations Y, M, C, K (FIG. 32) by applying the releasing signal to the solenoids S1, S2 from the first solenoid controller 5260 and the second solenoid controller 5270. Thus, the first solenoid controller 5260, the first solenoid S1, the first support member 95, the second solenoid controller 5270, the second solenoid S2 and the second support member 97 according to the tenth embodiment function as the "positioner" of the invention.

As described above, the blade opposing roller 83 of the tenth embodiment is also biased by the "biasing member" in the bias direction D83. Therefore, when the four primary transfer rollers 85Y, 85M, 85C, 85K are moved away from the four image forming stations Y, M, C, K to release the transfer belt 81 from the thrust-condition, the blade opposing roller 83 is moved in the bias direction D83 as pulling the transfer belt 81. Consequently, the transfer belt 81 is moved for the distance $\Delta L2$ in the opposite direction of the transport direction D81 in the contact position of the cleaner blade 711, so that the contaminant adhered to the distal end of the cleaner blade is separated therefrom.

As described above, the apparatus according to the tenth embodiment is adapted to remove the contaminant adhered to the distal end of the cleaner blade 711 simply by operating the "positioner" to move the primary transfer rollers 85Y, 85M, 85C, 85K away from the image forming stations Y, M, C, K. Thus, the drive system is simplified, negating the need for the additional driving mechanism for rotating the transfer belt 81 in the opposite direction of the transport direction D81. In short, the apparatus of the tenth embodiment is based on the more simplified structure for providing the effective separation of the contaminant adhered to the distal end of the cleaner blade 711, thus accomplishing the reduction of cost and size thereof.

In the tenth embodiment as well, when the blade opposing roller 83 is moved for the predetermined distance in the bias direction D83 as the aforesaid "positioner" releases the transfer belt from the thrust-condition, the movable pivots 90 are abutted against the frame 102 (abutment member, limiting member) so that the blade opposing roller 83 is halted. This results in a decreased tension of the transfer belt 81. Therefore, even in a case where the apparatus is not operated for image forming operations and left in shutdown for long hours, the transfer belt may be prevented from sustaining unwanted curling so that the transfer belt may be increased in service life.

In the tenth embodiment as well, when the "positioner" is operated to release the transfer belt 81 from the thrust-condition, the transfer belt 81 is first moved away as being applied with the given tension. Subsequently, the transfer belt 81 is decreased in tension so as to be prevented from sustaining the unwanted curling. The embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Eleventh Embodiment

In the case where the contaminant adhered to the distal end of the cleaner blade 711 is separated by moving the transfer belt 81 in the opposite direction of the transfer direction D81 in the contact position of the cleaner blade 711, as described above, it is preferred to quickly move the transfer belt 81. Hence, the constitution omitting the downstream guide roller similarly to that of the tenth embodiment may be arranged as follows. It is noted here that a basic arrangement of the apparatus is the same as that of the eighth embodiment and hence, only characteristic parts of the eleventh embodiment are described while the other parts thereof are represented by the equivalent characters, respectively, the description of which is dispensed with.

Figure 33:
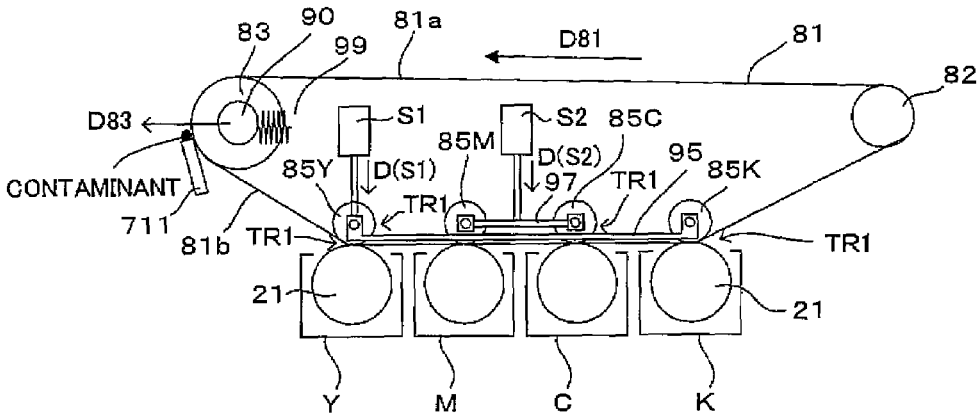
FIG. 33 is a diagram showing the operations of the apparatus of the eleventh embodiment.
Figure 34:
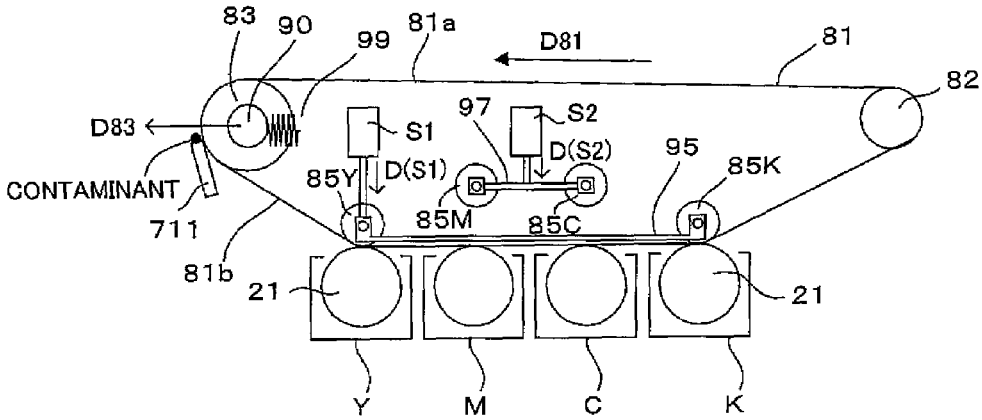
FIG. 34 is a diagram showing the operations of the apparatus of the eleventh embodiment.
Figure 35:
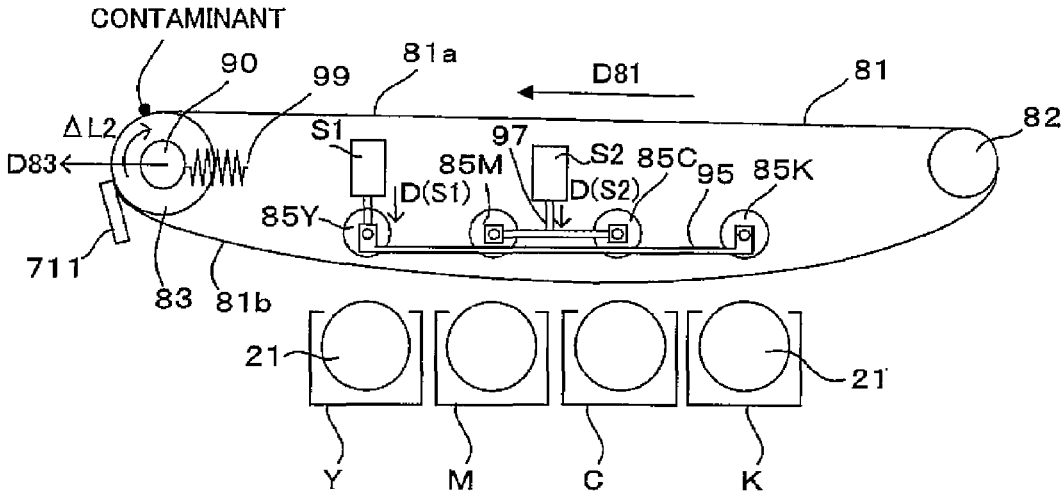
FIG. 35 is a diagram showing the operations of the apparatus of the eleventh embodiment.

FIG. 33 to FIG. 35 are diagrams showing the operations of the apparatus of the eleventh embodiment. In the eleventh embodiment as well, the moving mechanism of the blade opposing roller 83 has the arrangement shown in FIG. 25 and FIG. 26. That is, the movable pivots 90 and the tension springs 99 function as the "biasing member" of the invention, whereas the frame 102 functions as the "limiting member" of the invention. In the eleventh embodiment as well, the blade opposing roller 83 is biased by the tension springs 99 in the direction D83 to be moved away from the driving roller 82 and is adapted to reciprocate in the bias direction D83. The cleaner blade 711 is unified with the blade opposing roller 83, so that the cleaner blade 711 is capable of reciprocating unitarily with the blade opposing roller 83. The apparatus of the eleventh embodiment is constituted to omit the downstream guide roller 86 which is provided in the eighth and ninth embodiments described above. The primary transfer roller 85Y(most-upstream-transfer-member) disposed at the most upstream position in the transport direction D81 and the primary transfer roller 85K disposed at the most downstream position are rotatably supported by the first support member 95, whereas the first support member 95 is fixedly supported by the first solenoid S1. The first solenoid S1 is electrically connected to the first solenoid controller 5260 of FIG. 23. Hence, the first support member 95 and the primary transfer rollers 85Y, 85K may be reciprocally moved in the stroke direction D(S1) of the first solenoid S1 by applying a proper signal to the first solenoid S1 from the first solenoid controller 5260. On the other hand, two primary transfer rollers 85M, 85C out of the four primary transfer rollers 85Y, 85M, 85C, 85K (except the primary transfer roller 85Y (most-upstream-transfer-member) disposed at the most upstream position in the transport direction D81 and the primary transfer roller 85K (most-downstream-transfer-member) disposed at the most downstream position) are rotatably supported by the second support member 97, whereas the second support member 97 is fixedly supported by the second solenoid S2. The second solenoid S2 is electrically connected to the second solenoid controller 5270 of FIG. 23. Hence, the second support member 97 and the primary transfer rollers 85M, 85C may be reciprocally moved in the stroke direction D(S2) of the second solenoid S2 by applying a proper signal to the second solenoid S2 from the second solenoid controller 5270.

In the eleventh embodiment as well, the four primary transfer rollers 85Y, 85M, 85C, 85K are positioned in adjacency to the four image forming stations Y, M, C, K for thrusting the transfer belt 81 against the photosensitive drums 21 of the image forming stations Y, M, C, K, whereby the primary transfer positions TR1 are established, as shown in FIG. 33.

According to the eleventh embodiment, except the primary transfer roller 85Y (most-upstream-transfer-member) at the most upstream position in the transport direction D81 and the primary transfer roller 85K (most-downstream-transfer-member) at the most downstream position, the two primary transfer rollers 85M, 85C of the four primary transfer rollers 85Y, 85M, 85C, 85K in the state shown in FIG. 33 are moved away from the image forming stations M, C by means of the second solenoid S2. Specifically, the second solenoid controller 5270 (FIG. 23) outputs the releasing signal to the second solenoid S2 so as to move the two primary transfer rollers 85M, 85C away from the image forming stations M, C. At this time, as shown in FIG. 34, the transfer belt 81 is not released from the thrust-condition simply by moving the two primary transfer rollers 85M, 85C away from the image forming stations M, C. The transfer belt is still thrust against the image forming stations Y, M, C, K by means of the primary transfer rollers 85Y, 85K.

In the state shown in FIG. 34, the eleventh embodiment operates the first solenoid controller 5260 (FIG. 23) to output the releasing signal to the first solenoid Si, so as to move the primary transfer rollers 85Y, 85K away from the image forming stations Y, K (FIG. 35). The transfer belt 81 is released from the thrust-condition, in which the transfer belt 81 is thrust against the image forming stations Y, M, C, K, only after the primary transfer rollers 85Y, 85K are moved away. Thus, the first solenoid controller 5260, the first solenoid S1, the first support member 95, the second solenoid controller 5270, the second solenoid S2 and the second support member 97 according to the eleventh embodiment function as the "positioner" of the invention.

According to the eleventh embodiment as described above, the two primary transfer rollers 85M, 85C except for the primary transfer rollers 85Y, 85K are first moved away from the image forming stations M, C, before the primary transfer rollers 85Y, 85K are moved away from the image forming stations Y, K. Therefore, the transfer belt 81 is released from the thrust-condition, in which the transfer belt 81 is thrust against the image forming stations Y, M, C, K, only after the primary transfer rollers 85Y, 85K are moved away from the image forming stations. The primary transfer rollers 85M, 85C are already spaced away from the image forming stations M, C when the blade opposing roller 83 is allowed to move as the transfer belt 81 is released from the thrust-condition, thereby moving the transfer belt 81 away from the image forming stations Y, M, C, K. Therefore, the operation of releasing the transfer belt 81 is not obstructed by the primary transfer rollers 85M, 85C. The operation of releasing the transfer belt 81 may be accomplished quickly. This permits the transfer belt 81 to be moved quickly in the opposite direction of the transport direction D81 in the contact position where the distal end of the cleaner blade 711 is contacted against the transfer belt 81. That is, the embodiment is preferred in that the contaminant adhered to the distal end of the cleaner blade 711 is more assuredly separated.

In the eleventh embodiment as well, when the blade opposing roller 83 is moved for the predetermined distance in the bias direction D83 as the aforesaid "positioner" releases the transfer belt 81 from the thrust-condition, the movable pivots 90 are abutted against the frame 102 (abutment member, limiting member) so that the blade opposing roller 83 is halted. This results in a decreased tension of the transfer belt 81. Therefore, even in a case where the apparatus is not operated for image forming operations and left in shutdown for long hours, the transfer belt may be prevented from sustaining unwanted curling so that the transfer belt 81 may be increased in service life.

In the eleventh embodiment as well, when the transfer belt 81 is released from the thrust-condition by the "positioner", the transfer belt 81 is first moved away as being applied with a given tension. Subsequently, the transfer belt 81 is decreased in tension so as to be prevented from sustaining the unwanted curling. The embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Twelfth Embodiment

While the "limiting member" of the above embodiment is constituted by the frame 102 (abutment member) fixed to the apparatus body, the "limiting member" may also be constituted as suggested by the following twelfth embodiment. It is noted here that a basic arrangement of the apparatus is the same as that of the eighth embodiment and hence, only characteristic parts of the twelfth embodiment are described while the other parts thereof are represented by the equivalent characters, respectively, the description of which is dispensed with.

Figure 36:
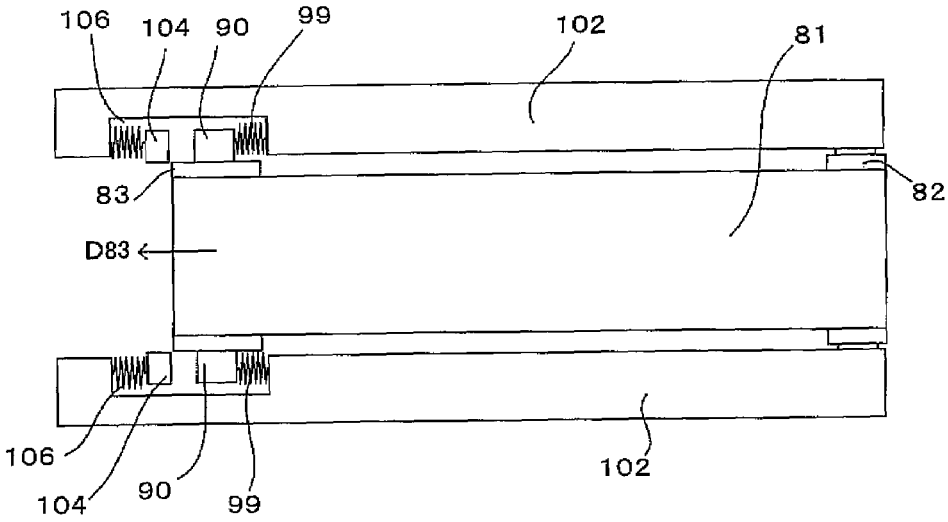
FIG. 36 is a diagram showing a moving mechanism of the blade opposing roller according to the twelfth embodiment.
Figure 37:
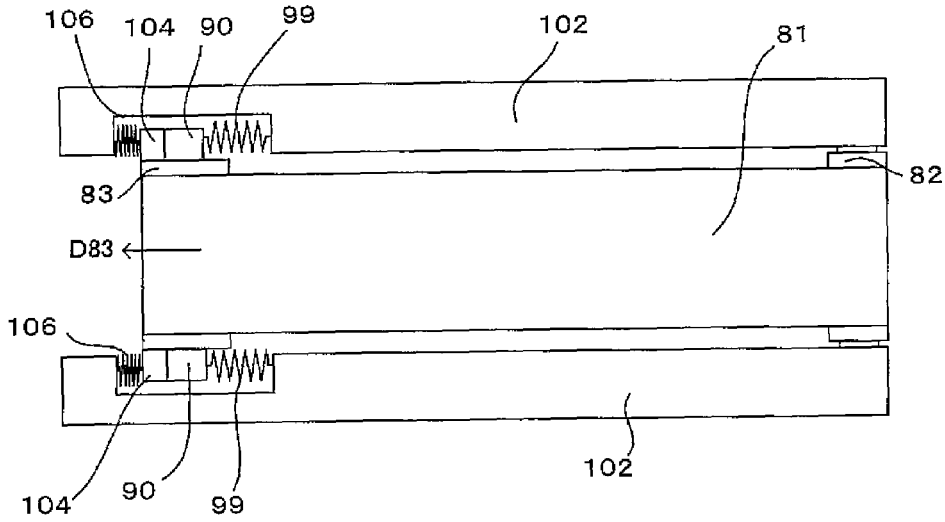
FIG. 37 is a diagram showing a moving mechanism of the blade opposing roller according to the twelfth embodiment.

FIG. 36 and FIG. 37 are diagrams showing a moving mechanism of the blade opposing roller 83 according to the twelfth embodiment. FIG. 36 and FIG. 37 both show the moving mechanism as seen in the X-direction shown in FIG. 24 or FIG. 27. FIG. 36 shows a state of the blade opposing roller 83 when the transfer belt 81 is thrust against the image forming stations Y, M, C, K. FIG. 37 shows a state of the blade opposing roller 83 when the transfer belt 81 is moved away from the image forming stations Y, M, C, K. The blade opposing roller 83 is pivotably supported by the two movable pivots 90 disposed at the opposite ends of the blade opposing roller 83. The two movable pivots 90 are free to reciprocate in a transverse direction as seen in FIG. 36 and FIG. 37. Furthermore, the movable pivot 90 are biased by the tension springs 99 in the direction (bias direction D83) to be moved away from the driving roller 82, the tension spring 99 having one end thereof connected to the frame 102 fixed to the housing body. As a result, the blade opposing roller 83 is biased in the bias direction D83 and is adapted to reciprocate in the bias direction D83. Hence, the blade opposing roller 83 functions as a so-called tension roller for applying a given tension to the transfer belt 81. According to the twelfth embodiment as well, the movable pivots 90 and the tension springs 99 function as the "biasing member" of the invention, which is constituted the same way as those of the foregoing embodiments. Accordingly, the blade opposing roller 83 of the twelfth embodiment is also allowed to move in the bias direction D83 as the transfer belt 81 is released from the thrust-condition.

As shown in FIG. 36, on the other hand, the twelfth embodiment is provided with two movable abutment members 104 free to reciprocate in the bias direction D83. The movable abutment members 104 are located at places spaced from the respective movable pivots 90 by a predetermined distance in the bias direction D83 in a state where the transfer belt 81 is thrust against the image forming stations Y, M, C, K. The movable abutment members 104 are each provided with a compression spring 106 on a downstream side thereof in the bias direction D83. These compression springs 106 are fixed to the housing body via the frame 102.

In a case where the moving mechanism of the blade opposing roller 83 is constituted as described above, when the transfer belt 81 is released from the thrust-condition in which the transfer belt 81 is thrust against the image forming stations Y, M, C, K, the movable pivots 90 and the blade opposing roller 83 pivotably supported about the movable pivots 90 are moved for a predetermined distance in the bias direction D83 as pulling the transfer belt 81 with a given tension. Thereafter, the movable pivots 90 abut against the movable abutment members 104. Such movable abutment members 104 are pressed by the movable pivots 90 in the bias direction D83, while the compression springs 106 are contracted. The compression springs 106, in turn, each apply a force to the movable abutment member 104 against the force of the tension spring 99. The force of the compression spring is of a magnitude corresponding to the quantity of contraction thereof and directed in the opposite direction of the bias direction D83. As result, the blade opposing roller 83 is applied with a reaction force against the biasing force, so as to be prevented from moving in the bias direction D83. Therefore, the tension applied from the blade opposing roller 83 to the transfer belt 81 is decreased. Thus, the movable abutment members 104 and the compression springs 106 according to the twelfth embodiment function as the "limiting member" of the invention.

According to the embodiment, the tension of the transfer belt 81 may also be decreased by the "limiting member" in this manner. Therefore, even in a case where the apparatus is not operated for image forming operations and left in shutdown for long hours, the transfer belt may be prevented from sustaining unwanted curling so that the transfer belt 81 may be increased in service life. Furthermore, in the case of the "limiting member" constituted as suggested by the twelfth embodiment, the degree of decrease of the tension of the transfer belt 81 may be adjusted by selecting a spring constant of the compression springs 106. In a case, for example, where the transfer belt 81 is excessively decreased in tension to be slackened, detrimentally contacting the other functional portions, such as the image forming stations, arranged around the transfer belt, the slack of the transfer belt 81 may be obviated by employing compression springs having a proper spring constant. Hence, the embodiment is preferred in that the transfer belt is prevented from being excessively decreased in tension so as not to come into the detrimental contact with the other functional portions. Particularly, in a case where the image forming stations Y, M, C, K are disposed downwardly of the transfer belt 81 in the direction of gravitational force just as in the eighth to eleventh embodiments, the apparatus may encounter the problem caused by the transfer belt 81 decreased in tension and going slack downward in the direction of gravitational force. However, the embodiment is preferred in that such a problem may be easily obviated by adjusting the spring constant of the compression springs.

Thirteenth Embodiment

Figure 38:
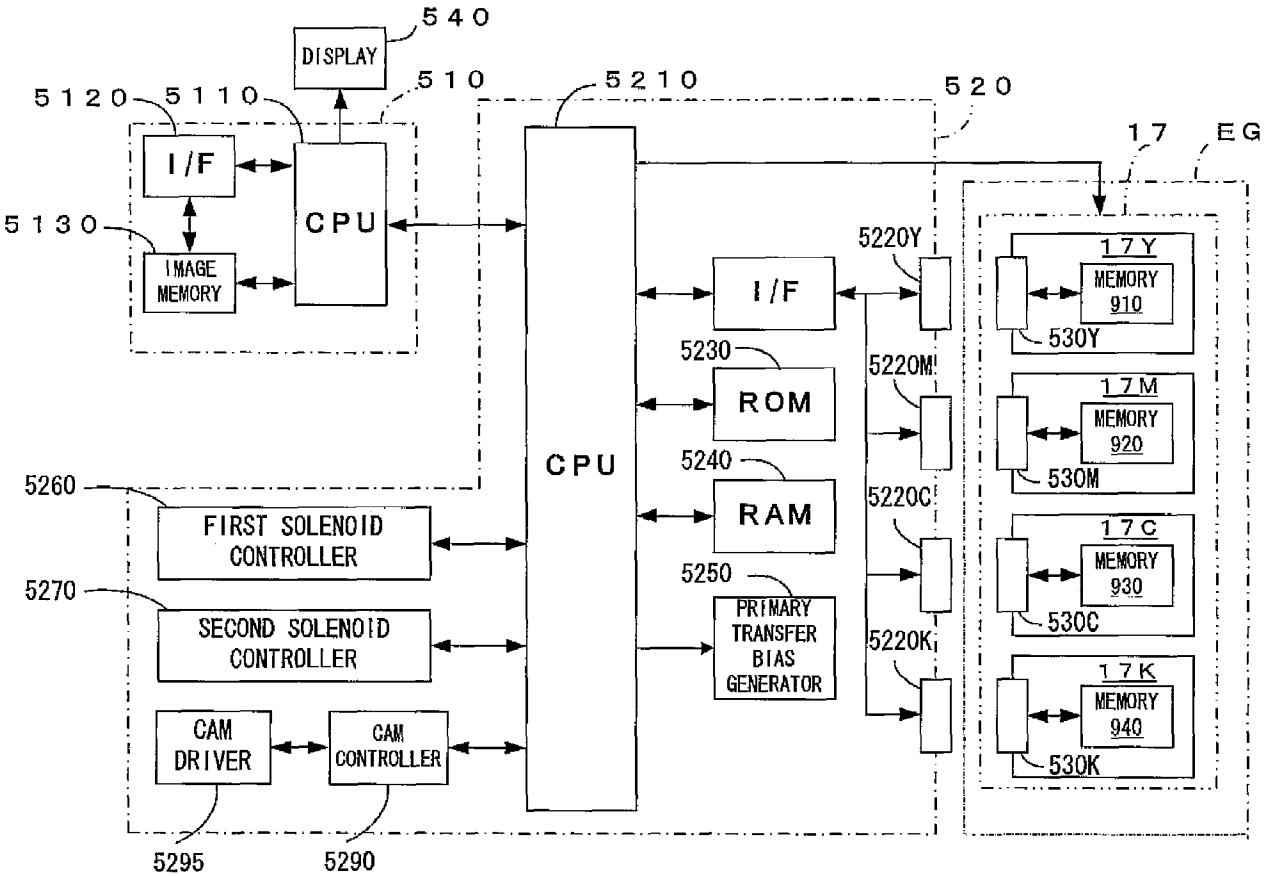
FIG. 38 is a block diagram showing an electrical arrangement of the embodiment.

A transfer belt unit 8 according to a thirteenth embodiment includes: the driving roller 82; the follower roller 83 (blade opposing roller) disposed on the left-hand side of the driving roller 82 as seen in FIG. 1; and the transfer belt 81 stretched around these rollers and driven into circulation in the direction of the arrow D81 (transport direction) in the figure. The transfer belt unit 8 further includes the four primary transfer rollers 85Y, 85M, 85C, 85K (transfer members) which are disposed inside the transfer belt 81 and which oppose the respective photosensitive drums 21 of the image forming stations Y, M, C, K in one-on-one relation when the photosensitive cartridges are mounted in the apparatus. As shown in FIG. 1, these primary transfer rollers 85 are positioned in adjacency to the respective opposite image forming stations Y, M, C, K, thereby thrusting the transfer belt 81 against the respective photosensitive drums 21 of the image forming stations Y, M, C, K. As a result, the primary transfer positions TR1 are established between the respective photosensitive drums 21 and the transfer belt 81. The primary transfer rollers are each electrically connected to the primary transferring-bias generator 5250 (FIG. 38). It is noted here that FIG. 38 is a block diagram showing an electrical arrangement of the embodiment. These primary transfer rollers 85 are contacted against the respective opposite photosensitive drums 21 via the transfer belt 81. In the meantime, the primary transferring-bias generator 5250 applies the primary transferring bias to each of the primary transfer rollers 85 in a proper timing, whereby the toner images formed on the respective surfaces of the photosensitive drums 21 may be transferred to the surface of the transfer belt 81 at the primary transfer positions TR1 where the respective photosensitive drums 21 are contacted against the transfer belt 81.

The transfer belt unit 8 further includes the guide roller 86 (downstream guide roller) disposed on the downstream side of the primary transfer roller 85K (most-downstream-transfer-member) and on the upstream side of the driving roller 82, the transfer roller 85K disposed at the most downstream position of those of the four primary transfer rollers 85Y, 85M, 85C, 85K in the transport direction D81. The downstream guide roller 86 is designed to contact the transfer belt 81 on an internal common tangent line of the primary transfer roller 85K and the photosensitive drum 21 at the primary transfer position TR1 defined by the primary transfer roller 85K contacting against the photosensitive drum 21 of the image forming station K. While the individual primary transfer rollers 85, the follower roller 83 (blade opposing roller) and the downstream guide roller 86 possess a moving mechanism, respectively, a specific description thereof will be made hereinlater.

Figure 39:
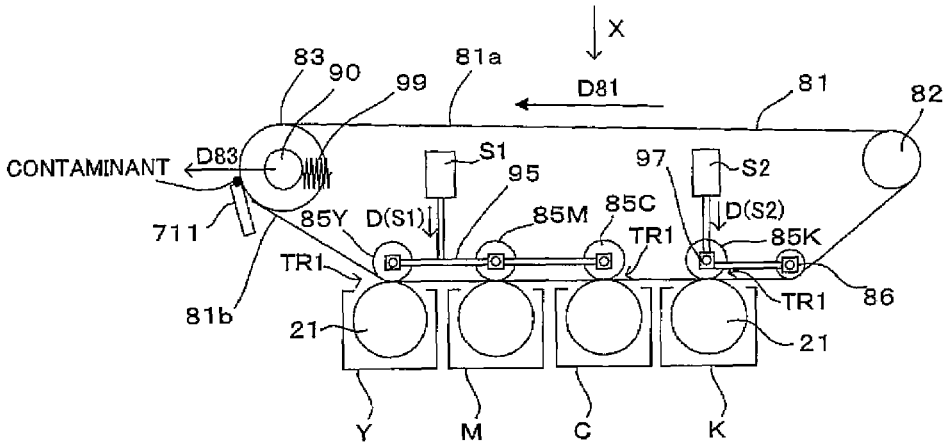
FIG. 39 is a diagram showing the moving mechanisms and operations of the blade opposing roller, the primary transfer and the downstream guide roller.

FIG. 39 is a diagram showing the moving mechanisms and operations of the blade opposing roller 83, the primary transfer rollers 85Y, 85M, 85C, 85K and the downstream guide roller 86. Upstream three primary transfer rollers 85Y, 85M, 85C in the transport direction D81 are rotatably supported by the first support member 95, whereas the first support member 95 is fixedly supported by the first solenoid S1. The first solenoid S1 is electrically connected to the first solenoid controller 5260 of FIG. 38. Hence, the first support member 95 and the primary transfer rollers 85Y, 85M, 85C may be reciprocally moved in the stroke direction D(S1) of the first solenoid S1 by applying a proper signal to the first solenoid S1 from the first solenoid controller 5260. On the other hand, the primary transfer roller 85K disposed at the most downstream position in the transport direction D81 and the downstream guide roller 86 are rotatably supported by the second support member 97. The second support member 97 is fixedly supported by the second solenoid S2. The second solenoid S2 is electrically connected to the second solenoid controller 5270 of FIG. 38. Hence, the second support member 97 and the primary transfer roller 85K may be reciprocally moved in the stroke direction D(S2) of the second solenoid S2 by applying a proper signal to the second solenoid S2 from the second solenoid controller 5270. As will be described hereinlater, the blade opposing roller 83 is biased in the bias direction D83 and is adapted to reciprocate in the bias direction D83.

In the thirteenth embodiment, the four primary transfer rollers 85Y, 85M, 85C, 85K are positioned in adjacency to the four image forming stations Y, M, C, K, so as to thrust the transfer belt 81 against the photosensitive drums 21 of the image forming stations Y, M, C, K against the biasing force applied to the blade opposing roller 83, whereby the primary transfer positions TR1 are established, as shown in FIG. 39.

Figure 40:
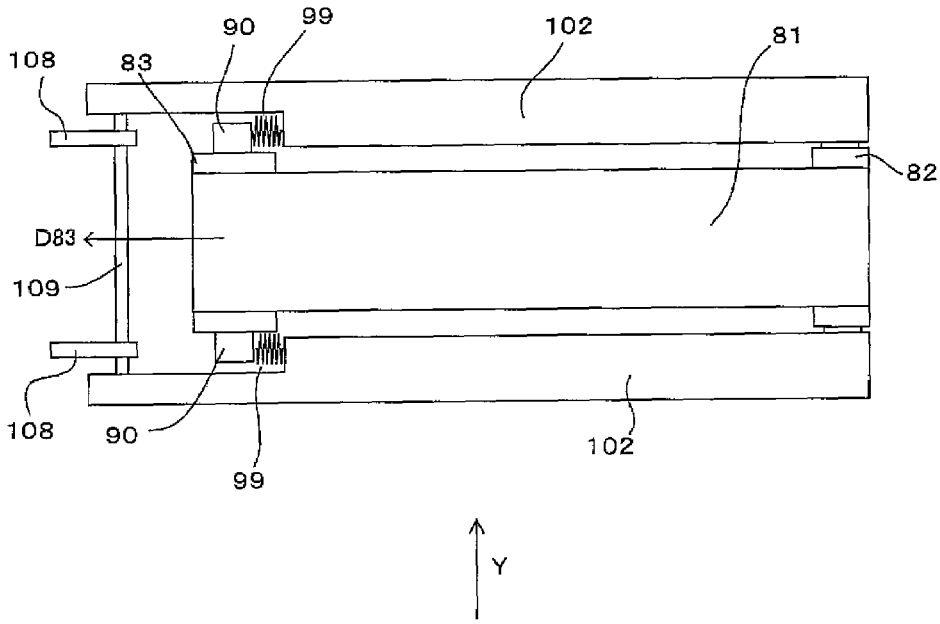
FIG. 40 is a diagram showing the moving mechanism of the blade opposing roller as seen in the X-direction shown in FIG. 39 and the operations thereof.

FIG. 40 is a diagram showing the moving mechanism of the blade opposing roller 83 as seen in the X-direction shown in FIG. 39 and the operations thereof. FIG. 40 corresponds to a state where the transfer belt 81 is thrust against the image forming stations Y, M, C, K. The blade opposing roller 83 is pivotably supported about the two movable pivots 90 disposed at the opposite ends of the blade opposing roller 83. The two movable pivots 90 are free to reciprocate in a transverse direction as seen in FIG. 39. Furthermore, the movable pivot 90 are biased by tension springs 99 in the direction (bias direction D83) to be moved away from the driving roller 82, the tension spring 99 having one end thereof connected to the frame 102 fixed to the housing body. Accordingly, the blade opposing roller 83 is biased in the bias direction D83 and is adapted to reciprocate in the bias direction D83. Therefore, the blade opposing roller 83 functions as a so-called tension roller for applying a given tension to the transfer belt 81. According to the thirteenth embodiment, the movable pivots 90 and the tension springs 99 function as the "biasing member" of the invention.

In such a state shown in FIG. 39, FIG. 40, the first solenoid controller 5360 sends the releasing signal to the solenoid S1 whereas the second solenoid controller 5270 sends the releasing signal to the solenoid S2, whereby the primary transfer rollers 85Y, 85M, 85C, 85K are moved away from the image forming stations Y, M, C, K whereas the downstream guide roller 86 is moved inwardly of the transfer belt 81 (releasing step). When such a releasing step is performed, the transfer belt 81 is released from the thrust-condition in which the transfer belt 81 is thrust against the image forming stations Y, M, C, K, by means of the primary transfer rollers 85Y, 85M, 85C, 85K.

Figure 41:
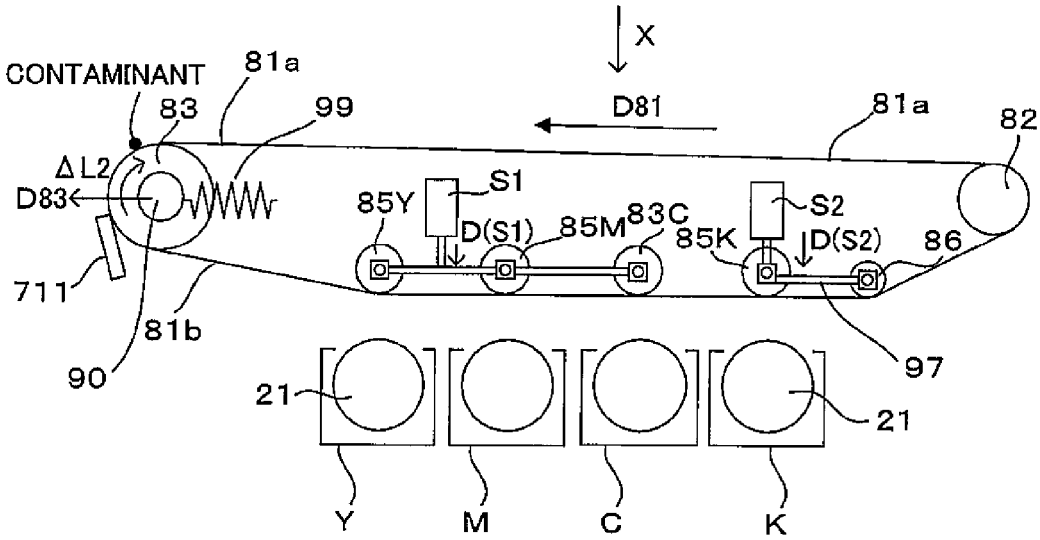
FIG. 41 is a diagram showing a state of the transfer belt unit when the aforesaid thrust-condition of the transfer belt is eliminated.

FIG. 41 is a diagram showing a state of the transfer belt unit 8 when the aforesaid thrust-condition of the transfer belt 81 is eliminated. When the transfer belt 81 is released from the thrust-condition, the blade opposing roller 83 is moved in the bias direction D83 as pulling the transfer belt 81 with a given tension. As a result, the transfer belt 81 is spaced away from the image forming stations Y, M, C, K, as shown in FIG. 41. The blade opposing roller 83 is halted at a position where the biasing force applied to the blade opposing roller 83 by the "biasing member" is balanced with the tension from the transfer belt 81.

In conjunction with the movement of the primary transfer rollers 85Y, 85M, 85C, 85K and the downstream guide roller 86, as described above, the blade opposing roller 83 is moved in the bias direction D83 as pulling the transfer belt 81 with the given tension. The blade opposing roller 83 is moved in the direction to be spaced away from the driving roller 82. Hence, during the period of releasing operation between the start of movement of the transfer belt 81 and the halt thereof, the circumferential length L1 (circumferential length L1 on the opposite side from the image forming station) of the transfer belt portion 81 a extending from the driving roller 82 to the blade opposing roller in the transport direction D81 of the transfer belt 81 is increased, whereas the circumferential length L2 (circumferential length L2 on the image forming station side) of the transfer belt portion 81*b* extending from the driving roller 82 to the blade opposing roller 83 in the opposite direction of the transport direction D81 of the transfer belt 81 is decreased.

Since the transfer belt 81 is tensioned during such a releasing operation, the transfer belt 81 is moved away from the image forming stations Y, M, C, K as tensioned by the driving roller 82. Therefore, a relatively high frictional force exists between the driving roller 82 and the transfer belt 81. At this time, the driving roller is at standstill. Accordingly, the transfer belt 81 does not move relative to the driving roller 82. On the other hand, the blade opposing roller 83 is the follower roller. Hence, the blade opposing roller 83 is rotated by a quantity corresponding to the increase of the circumferential length L1 on the opposite side from the image forming station, as pulled by the transfer belt 81 in the opposite direction of the transport direction D81. As described above, the cleaner blade 711 is unified with the blade opposing roller 83, so that the cleaner blade 711 is also moved unitarily with the blade opposing roller 83 so moved. Therefore, the relative position between the cleaner blade 711 and the blade opposing roller 83 is unchanged. When the blade opposing roller 83 is rotated in the opposite direction of the transport direction D81 by the variation ΔL2 of the circumferential length L2 on the image forming station side, the transfer belt 81 is moved in the opposite direction of the transport direction D81 by the variation ΔL2 of the above circumferential length in the contact position where the distal end of the cleaner blade 711 is contacted against the transfer belt 81. Accordingly, the contaminant adhered to the distal end of the cleaner blade 711 in the state of FIG. 39 is moved in the opposite direction of the transport direction D81 by the variation ΔL2 of the circumferential length, as shown in FIG. 41, by moving the primary transfer rollers 85Y, 85M, 85C, 85K away from the image forming stations Y, M, C, K and moving the downstream guide roller inwardly of the transfer belt 81 for releasing the transfer belt 81 from the thrust-condition. Thus is separated the contaminant adhered to the distal end of the cleaner blade 711.

The apparatus according to the thirteenth embodiment is adapted to remove the contaminant adhered to the distal end of the cleaner blade 711 simply by moving, as needed, the primary transfer rollers 85Y, 85M, 85C, 85K away from the image forming stations Y, M, C, K and moving the downstream guide roller 86 inwardly of the transfer belt 81. Thus, the drive system is simplified, negating the need for providing the additional driving mechanism for rotating the transfer belt 81 in the opposite direction of the transport direction D81. In short, the apparatus of the thirteenth embodiment adopts the more simplified structure for effectively separating the contaminant adhered to the distal end of the cleaner blade 711, thus accomplishing the reduction of cost and size thereof.

Figure 42:
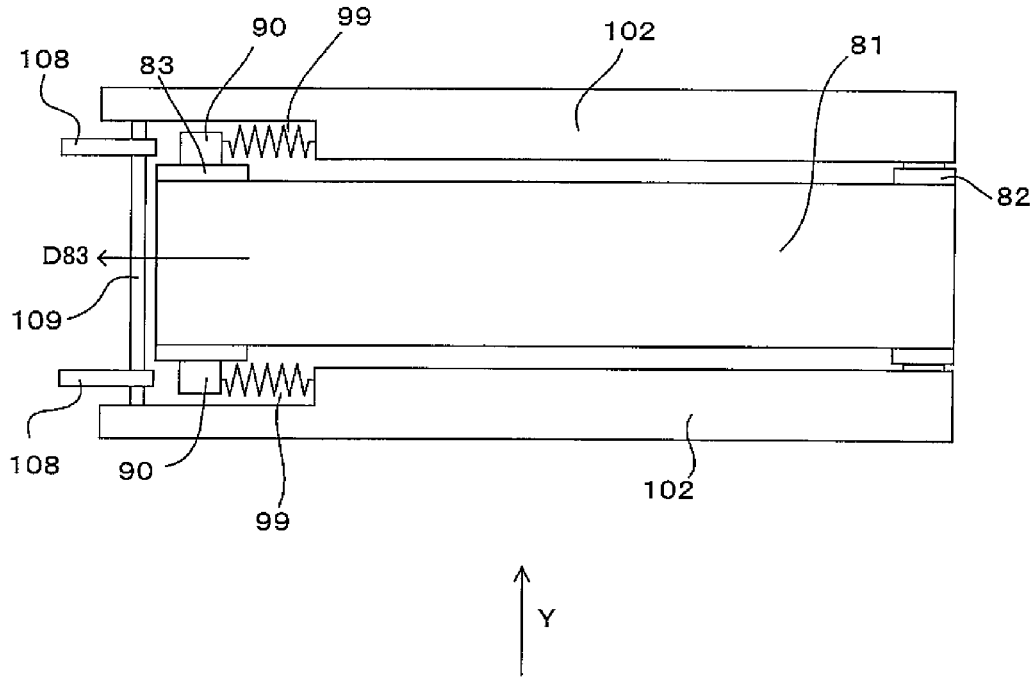
FIG. 42 is a diagram showing a state of the transfer belt unit immediately after the execution of the releasing step and the moving mechanism of the blade opposing roller as seen in the X-direction shown in FIG. 39 or FIG. 40.
Figure 44:
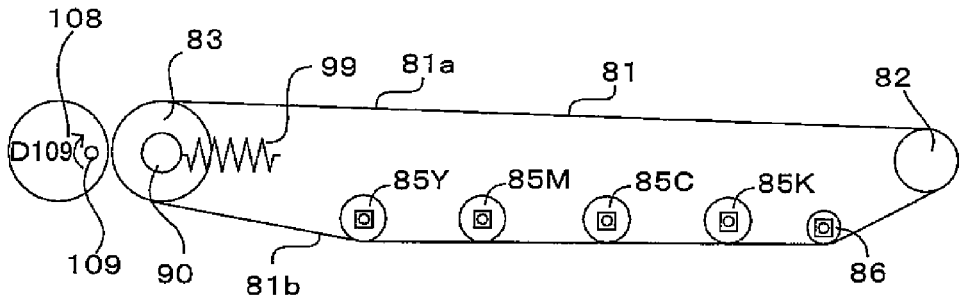
FIG. 44 is a diagram showing a positional relation between the transfer belt unit, and a camshaft and an eccentric cam as seen in a Y-direction shown in FIG. 42.

FIG. 42 is a diagram showing a state of the transfer belt unit 8 immediately after the execution of the releasing step and the moving mechanism of the blade opposing roller 83 as seen in the X-direction shown in FIG. 39 or FIG. 40. FIG. 44 is a diagram showing a positional relation between the transfer belt unit 8, and a camshaft 109 and an eccentric cam 108 as seen in a Y-direction shown in FIG. 42. The figures show the positional relation immediately after the execution of the releasing step. The two eccentric cams 108 fixedly supported by the camshaft 109 are disposed on the left-hand side of the blade opposing roller 83 as seen in FIG. 42 and are in opposing relation with the movable pivots 90 at the opposite ends of the blade opposing roller 83. The camshaft 109 is rotatably supported by the frame 102 and is adapted for rotation in a rotational direction D109 as driven by a cam driver 5295 (FIG. 38). The cam driver 5295 rotates the camshaft 109 through a predetermined angle based on a control signal from a cam controller. The cam controller 5290 may send the contacting signal to the cam driver 5295 for bringing the eccentric cams 108 into rotation about the camshaft 109 in the rotational direction D109, whereby the peripheries of the eccentric cams 108 are pressed against the movable pivots 90 for pressing the movable pivots 90 and the blade opposing roller 83 into movement in the opposite direction of the bias direction D83. Thus, the first solenoid controller 5260, the second solenoid controller 5270, the cam controller 5290 and the cam driver 5295 according the thirteenth embodiment function as the "controller" of the invention.

Figure 43:
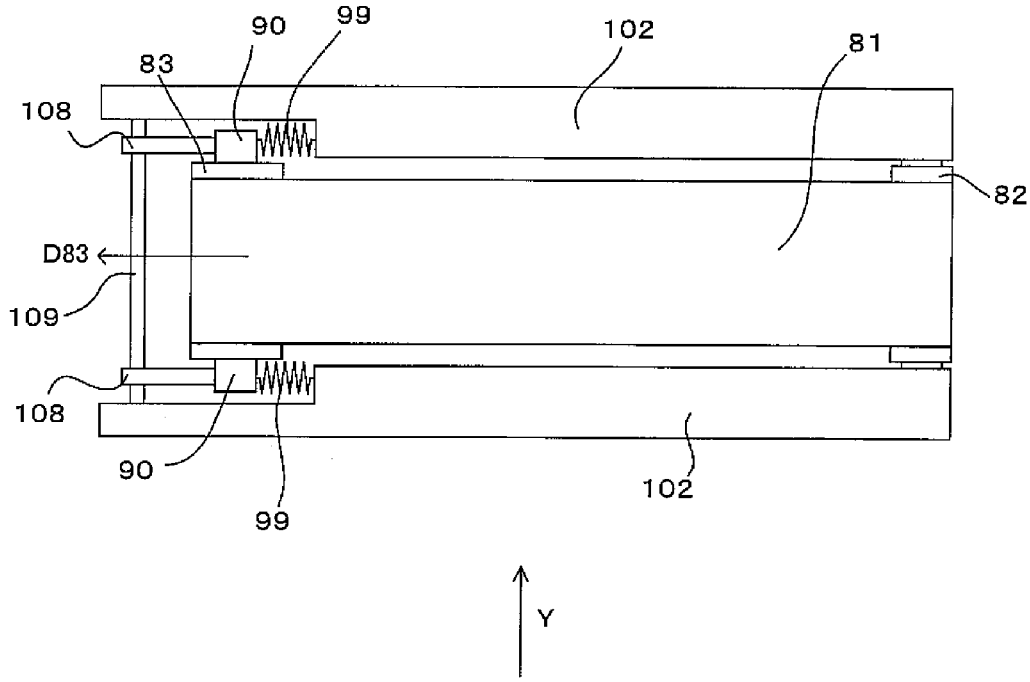
FIG. 43 is a diagram showing a state of the transfer belt unit undergoing the tension eliminating step and the moving mechanism of the blade opposing roller as seen in the X-direction shown in FIG. 39 or FIG. 41.
Figure 45:
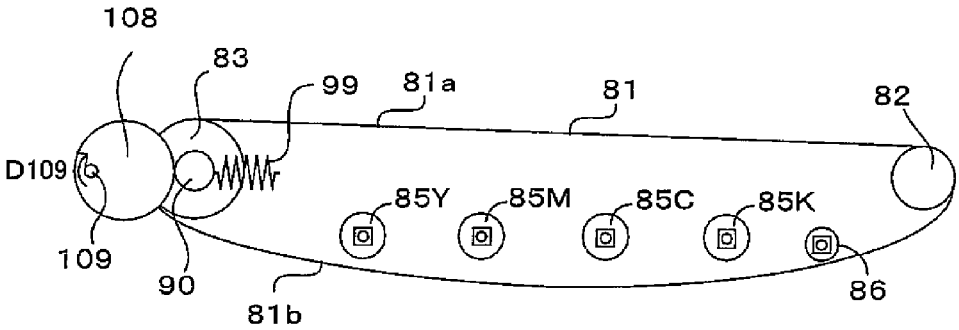
FIG. 45 is a diagram showing a positional relation between the transfer belt unit, and the camshaft and eccentric cam as seen in the Y-direction shown in shown FIG. 42.

According to the thirteenth embodiment, the cam controller 5290 outputs the contacting signal after the "releasing step", thereby moving the movable pivots 90 for a predetermined distance in the opposite direction of the bias direction D83 (tension eliminating step). FIG. 43 is a diagram showing a state of the transfer belt unit 8 undergoing the tension eliminating step and the moving mechanism of the blade opposing roller 83 as seen in the X-direction shown in FIG. 39 or FIG. 41. FIG. 45 is a diagram showing a positional relation between the transfer belt unit 8, and the camshaft 109 and eccentric cam 108 as seen in the Y-direction shown in shown FIG. 42. The figures show the positional relation immediately after the execution of the releasing step. As apparent from FIG. 43 and FIG. 45, the tension eliminating step is performed to press the periphery of the eccentric cam 108 against the movable pivot 90, thereby moving the blade opposing roller 83 for the predetermined distance in the opposite direction of the bias direction D83. The blade opposing roller 83 is moved in the direction to approach the driving roller 82. Accordingly, the tension of the transfer belt 81 is eliminated after the movement of the blade opposing roller as shown in FIG. 45, although the transfer belt 81 is tensioned (FIG. 44) prior to the movement of the blade opposing roller 83 in the opposite direction of the bias direction D83. Therefore, even in a case where the apparatus is not operated for image forming operations and left in shutdown for long hours, the transfer belt may be prevented from sustaining unwanted curling so that the transfer belt may be increased in service life.

In the thirteenth embodiment, when the "releasing step" is performed to release the transfer belt 81 from the thrust-condition, the transfer belt 81 is first moved away as being applied with a given tension, so as to separate the contaminant from the distal end of the cleaner blade. Subsequently, the "tension eliminating step" is performed to eliminate the tension of the transfer belt 81 whereby the transfer belt 81 is prevented from sustaining the unwanted curling. Thus, the embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Fourteenth Embodiment

In the case where the contaminant adhered to the distal end of the cleaner blade 711 is separated by moving the transfer belt 81 in the opposite direction of the transfer direction D81 in the contact position of the cleaner blade 711, as described above, it is preferred to quickly move the transfer belt 81. Hence, the image forming apparatus may be arranged as suggested by a fourteenth embodiment described as below. It is noted here that a basic arrangement of the apparatus is the same as that of the thirteenth embodiment and hence, only characteristic parts of the fourteenth embodiment are described while the other parts thereof are represented by the equivalent characters, respectively, the description of which is dispensed with.

Figure 46:
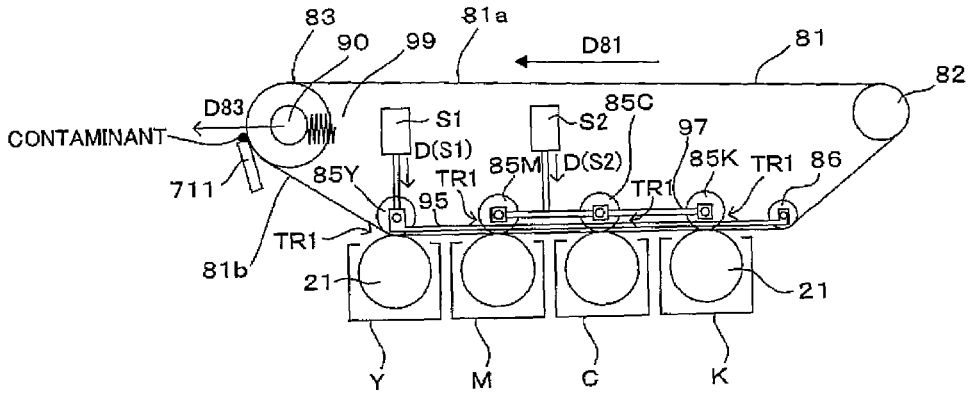
FIG. 46 is a diagram showing the operations of the apparatus of the fourteenth embodiment.
Figure 47:
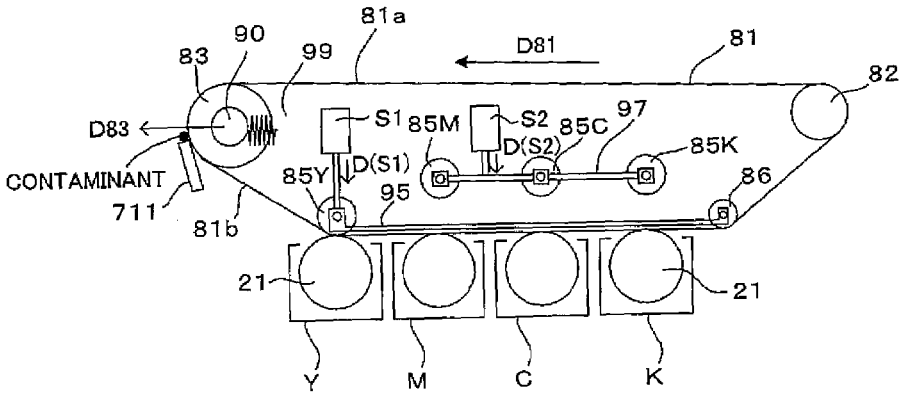
FIG. 47 is a diagram showing the operations of the apparatus of the fourteenth embodiment.
Figure 48:
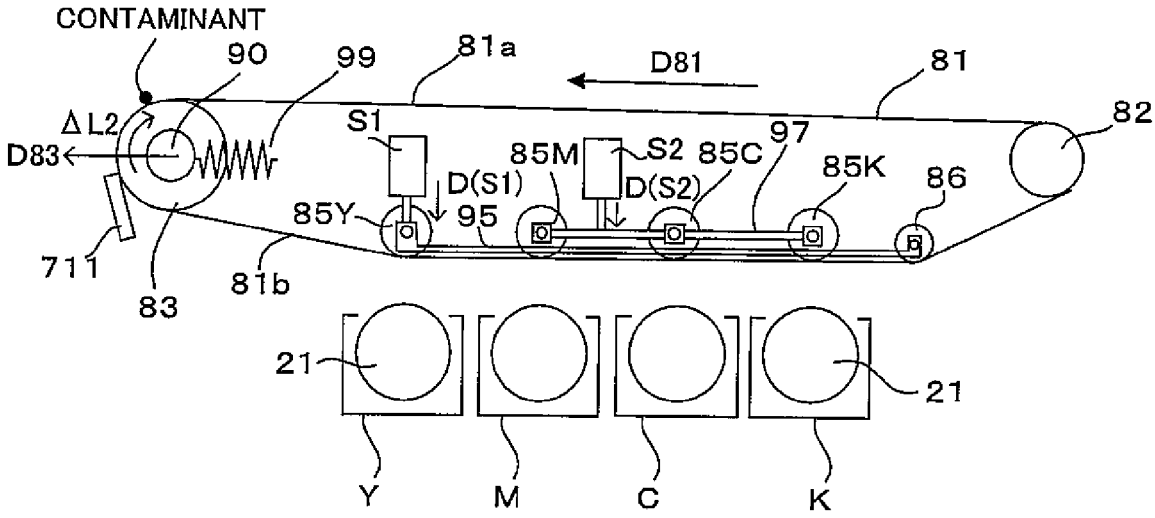
FIG. 48 is a diagrams showing the operations of the apparatus of the fourteenth embodiment.

FIG. 46 to FIG. 48 are diagrams showing the operations of the apparatus of the fourteenth embodiment. In the fourteenth embodiment, as well, the moving mechanism of the blade opposing roller 83 has the arrangement shown in FIG. 40, FIG. 42 and FIG. 43. That is, the movable pivots 90 and the tension springs 99 function as the "biasing member" of the invention. On the other hand, the cam controller 5290 may apply a proper signal to the cam driver 5295 for pressing the peripheries of the eccentric cams 108 against the movable pivots 90, so as to press the movable pivots 90 in the opposite direction of the bias direction D83, whereby the blade opposing roller 83 is moved for the predetermined distance in the opposite direction of the bias direction D83. The blade opposing roller 83 is biased in the direction to be moved away from the driving roller 82 and is adapted to reciprocate in the bias direction D83. The cleaner blade 711 is unified with the blade opposing roller 83 and is adapted to reciprocate unitarily with the blade opposing roller 83.

The primary transfer roller 85Y (most-upstream-transfer-member) at the most upstream position in the transport direction D81 and the downstream guide roller 86 are rotatably supported by the first support member 95, whereas the first support member 95 is fixedly supported by the first solenoid S1. The first solenoid S1 is electrically connected to the first solenoid controller 5260 of FIG. 38. Hence, the first support member 95 and the primary transfer roller 85Y may be reciprocally moved in the stroke direction D(S1) of the first solenoid S1 by applying a proper signal to the first solenoid S1 from the first solenoid controller 5260.

On the other hand, three primary transfer rollers 85M, 85C, 85K at the second to fourth positions from the upstream side in the transport direction D81 are rotatably supported by the second support member 97. The second support member 97 is fixedly supported by the second solenoid S2. The second solenoid S2 is electrically connected to the second solenoid controller 5270 of FIG. 38. Hence, the second support member 97 and the primary transfer rollers 85M, 85C, 85K may be reciprocally moved in the stroke direction D(S2) of the second solenoid S2 by applying a proper signal to the second solenoid S2 from the second solenoid controller 5270. Thus, the first solenoid controller 5260, the second solenoid controller 5270, the cam controller 5290 and the cam driver 5295 according to the fourteenth embodiment function as the "controller" of the invention.

In the fourteenth embodiment as well, the four primary transfer rollers 85Y, 85M, 85C, 85K are positioned in adjacency to the four image forming stations Y, M, C, K, so as to thrust the transfer belt 81 against the photosensitive drums 21 of the image forming stations Y, M, C, K, whereby the primary transfer positions TR1 are established, as shown in FIG. 46.

According to the fourteenth embodiment, the "releasing step" is performed as follows if it is needed after the execution of the image forming operations. The three primary transfer rollers 85M, 85C, 85K are first moved away from the image forming stations M, C, K, before the primary transfer roller 85Y is moved away from the image forming station Y while the downstream guide roller 86 is moved inwardly of the transfer belt 81 (releasing step). More specifically, except the primary transfer roller 85Y (most-upstream-transfer-member) disposed at the most upstream position in the transport direction D81, the three primary transfer rollers 85M, 85C, 85K of the four primary transfer rollers 85Y, 85M, 85C, 85K in a state shown in FIG. 46 are moved away from the image forming stations M, C, K by means of the second solenoid S2. That is, the second solenoid controller 5270 (FIG. 38) outputs the releasing signal to the second solenoid S2 so as to move the three primary transfer rollers 85M, 85C, 85K away from the image forming stations M, C, K. At this time, as shown in FIG. 47, the transfer belt 81 is not released from the thrust-condition simply by moving the three primary transfer rollers 85M, 85C, 85K away from the image forming stations M, C, K. The transfer belt is still thrust against the image forming stations Y, M, C, K by means of the primary transfer roller 85Y and the downstream guide roller 86.

In the fourteenth embodiment in the state shown in FIG. 47, the first solenoid controller 5260 (FIG. 38) outputs the releasing signal to the first solenoid S1, thereby moving the primary transfer roller 85Y away from the image forming station Y and moving the downstream guide roller 86 inwardly of the transfer belt 81 (FIG. 48). The transfer belt 81 is released from the thrust-condition, in which the transfer belt 81 is thrust against the image forming stations Y, M, C, K, only after the primary transfer roller 85Y is moved away and the downstream guide roller 86 is moved inwardly.

According to the fourteenth embodiment as described above, the three primary transfer rollers 85M, 85C, 85K, except the primary transfer roller 85Y (most-upstream-transfer-member), are first moved away from the image forming stations M, C, K. Thereafter, the primary transfer roller 85Y is moved away from the image forming station Y and the downstream guide roller 86 is moved inwardly. Therefore, the transfer belt 81 is released from the thrust-condition, in which the transfer belt 81 is thrust against the image forming stations Y, M, C, K, only after the primary transfer roller 85Y is moved away and the downstream guide roller is moved inwardly. The primary transfer rollers 85M, 85C, 85K are already spaced away from the image forming stations M, C, K when the blade opposing roller 83 is allowed to move as the transfer belt 81 is released from the thrust-condition, thereby moving the transfer belt 81 away from the image forming stations Y, M, C, K. Hence, the operation of releasing the transfer belt 81 is not obstructed by the primary transfer rollers 85M, 85C, 85K, so that the operation of releasing the transfer belt 81 may be accomplished quickly. This permits the transfer belt 81 to be moved quickly in the opposite direction of the transport direction D81 in the contact position where the distal end of the cleaner blade 711 is contacted against the transfer belt 81. That is, the embodiment is preferred in that the contaminant adhered to the distal end of the cleaner blade 711 is more assuredly separated.

In the fourteenth embodiment as well, the above releasing step is followed by the same tension eliminating step as that of the thirteenth embodiment. Therefore, even in a case where the apparatus is not operated for image forming operations and left in shutdown for long hours, the transfer belt may be prevented from sustaining unwanted curling so that the transfer belt may be increased in service life.

According to the fourteenth embodiment as described above, the "releasing step" is first performed to release the transfer belt 81 from the thrust-condition, thereby allowing the transfer belt 81 to be moved as being applied with the given tension. After the transfer belt 81 is released from the thrust-condition, the "tension eliminating step" is performed to eliminate the tension of the transfer belt 81 whereby the transfer belt 81 is prevented from sustaining the unwanted curling. Thus, the embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Fifteenth Embodiment

All the foregoing embodiments are provided with the downstream guide roller 86. However, an image forming apparatus omitting the downstream guide roller 86 may be arranged as suggested by the following fifteenth embodiment. It is noted here that a basic arrangement of the apparatus is the same as that of the thirteenth embodiment and hence, only characteristic parts of the fifteenth embodiment are described while the other parts thereof are represented by the equivalent characters, respectively, the description of which is dispensed with.

Figure 49:
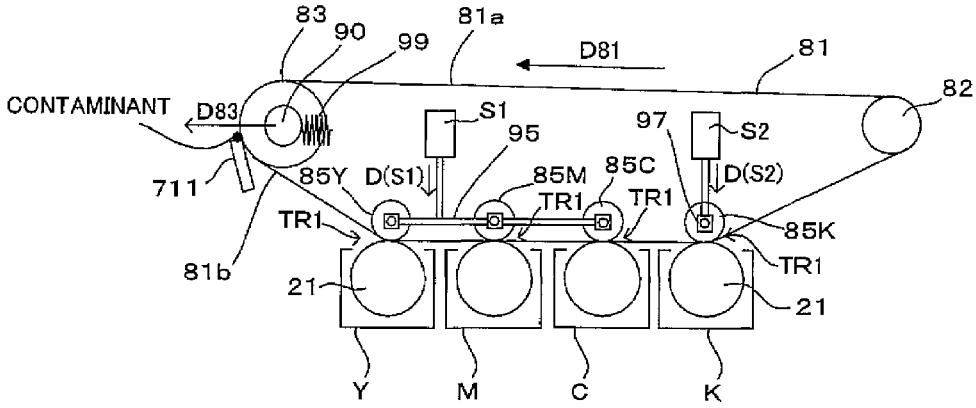
FIG. 49 are a diagram showing the operations of the apparatus of the fifteenth embodiment.
Figure 50:
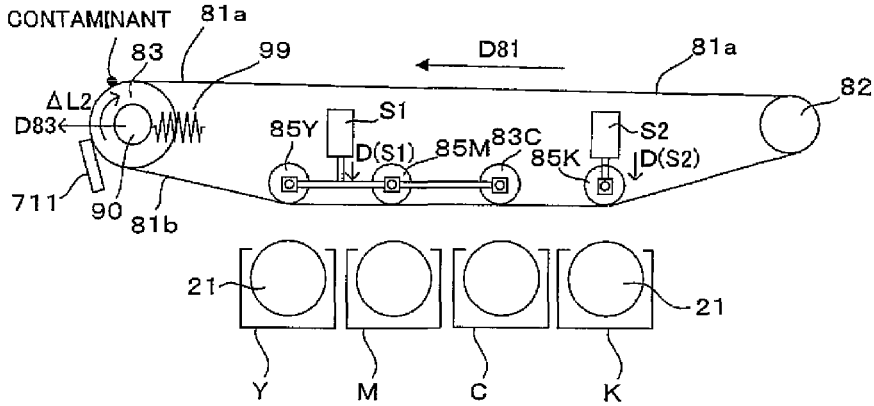
FIG. 50 are a diagram showing the operations of the apparatus of the fifteenth embodiment.

FIG. 49 and FIG. 50 are diagrams showing the operations of the apparatus of the fifteenth embodiment. In the fifteenth embodiment as well, the moving mechanism of the blade opposing roller 83 has the arrangement shown in FIG. 40, FIG. 42 and FIG. 43. That is, the movable pivots 90 and the tension springs 99 function as the "biasing member" of the invention. On the other hand, the cam controller 5290 applies a proper signal to the cam driver 5295 for pressing the peripheries of the eccentric cams 108 against the movable pivots 90, so as to press the movable pivots 90 in the opposite direction of the bias direction D83, whereby the blade opposing roller 83 is moved for the predetermined distance in the opposite direction of the bias direction D83. The blade opposing roller 83 according to the fifteenth embodiment is also biased by the tension springs 99 in the direction to be moved away from the driving roller 82 and is also adapted to reciprocate in the bias direction D83.

The cleaner blade 711 is unified with the blade opposing roller 83 and is adapted to reciprocate unitarily with the blade opposing roller 83. The apparatus of the fifteenth embodiment is constituted to omit the downstream guide roller 86 which is provided in the thirteenth and fourteenth embodiments described above. The primary transfer rollers 85Y, 85M, 85C are rotatably supported by the first support member 95, whereas the first support member 95 is fixedly supported by the first solenoid S1. The first solenoid S1 is electrically connected to the first solenoid controller 5260 of FIG. 38. Hence, the first support member 95 and the primary transfer rollers 85Y, 85M, 85C may be reciprocally moved in the stroke direction D(S1) of the first solenoid S1 by applying a proper signal to the first solenoid S1 from the first solenoid controller 5260.

On the other hand, the primary transfer roller 85K is rotatably supported by the second support member 97. The second support member 97 is fixedly supported by the second solenoid S2. The second solenoid S2 is electrically connected to the second solenoid controller 5270 of FIG. 38. Hence, the second support member 97 and the primary transfer roller 85K may be reciprocally moved in the stroke direction D(S2) of the second solenoid S2 by applying a proper signal to the second solenoid S2 from the second solenoid controller 5270. Thus, the first solenoid controller 5260, the second solenoid controller 5270, the cam controller 5290 and the cam driver 5295 according the fifteenth embodiment function as the "controller" of the invention.

In the fifteenth embodiment as well, the four primary transfer rollers 85Y, 85M, 85C, 85K are positioned in adjacency to the four image forming stations Y, M, C, K, so as to thrust the transfer belt 81 against the photosensitive drums 21 of the image forming stations Y, M, C, K, whereby the primary transfer positions TR1 are established, as shown in FIG. 49.

According to the fifteenth embodiment, the "releasing step" is performed as follows if it needed after the execution of the image forming operations. That is, the first solenoid controller 5260 and the second solenoid controller 5270 apply a release command to the solenoids S1, S2, respectively, thereby moving the four primary transfer rollers 85Y, 85M, 85C, 85K in a state shown in FIG. 49 away from the image forming stations Y, M, C, K (releasing step) (FIG. 50).

In the fifteenth embodiment as well, the blade opposing roller 83 is biased by the "biasing member" in the bias direction D83, as described above. Therefore, when the four primary transfer rollers 85Y, 85M, 85C, 85K are moved away from the image forming stations Y, M, C, K to release the transfer belt 81 from the thrust-condition, the blade opposing roller 83 is moved in the bias direction D83 as pulling the transfer belt 81. Consequently, the transfer belt 81 is moved for the distance $\Delta L2$ in the opposite direction of the transport direction D81 in the contact position of the cleaner blade 711, SO that the contaminant adhered to the distal end of the cleaner blade is separated therefrom.

As described above, the apparatus according to the fifteenth embodiment is adapted to remove the contaminant adhered to the distal end of the cleaner blade 711 simply by performing the "releasing step" to move the primary transfer rollers 85Y, 85M, 85C, 85K away from the image forming stations Y, M, C, K. Thus, the drive system is simplified, negating the need for the additional driving mechanism for rotating the transfer belt 81 in the opposite direction of the transport direction D81. In short, the apparatus of the fifteenth embodiment adopts the more simplified structure for effectively separating the contaminant adhered to the distal end of the cleaner blade 711, thus accomplishing the reduction of cost and size thereof.

In the fifteenth embodiment as well, the above releasing step is followed by the same tension eliminating step as that of the thirteenth embodiment. Therefore, even in a case where the apparatus is not operated for image forming operations and left in shutdown for long hours, the transfer belt may be prevented from sustaining unwanted curling so that the transfer belt may be increased in service life.

According to the fifteenth embodiment as described above, the "releasing step" is first performed to release the transfer belt 81 from the thrust-condition, so that the transfer belt 81 is moved away as being applied with the given tension. After the transfer belt 81 is released from the thrust-condition, the "tension eliminating step" is performed to eliminate the tension of the transfer belt 81 whereby the transfer belt 81 is prevented from sustaining the unwanted curling. Thus, the embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Sixteenth Embodiment

In the case where the contaminant adhered to the distal end of the cleaner blade 711 is separated by moving the transfer belt 81 in the opposite direction of the transfer direction D81 in the contact position of the cleaner blade 711, as described above, it is preferred to quickly move the transfer belt 81. Hence, the constitution omitting the downstream guide roller similarly to that of the fifteenth embodiment may be arranged as follows. It is noted here that a basic arrangement of the apparatus is the same as that of the thirteenth embodiment and hence, only characteristic parts of a sixteenth embodiment are described while the other parts thereof are represented by the equivalent characters, respectively, the description of which is dispensed with.

Figure 51:
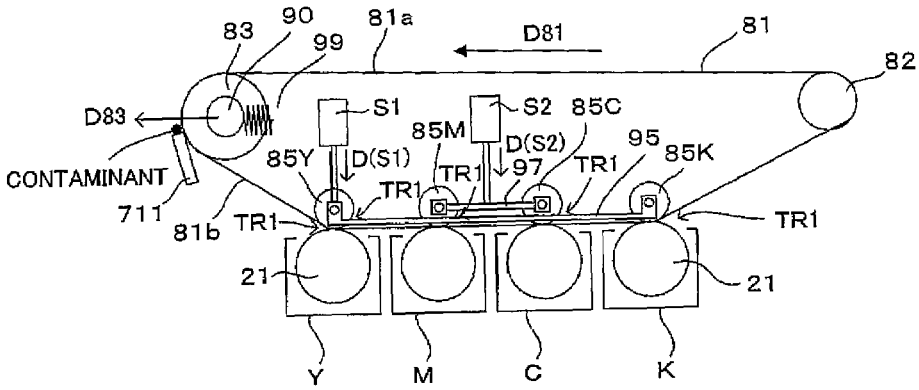
FIG. 51 is a diagram showing the operations of the apparatus of the sixteenth embodiment.
Figure 52:
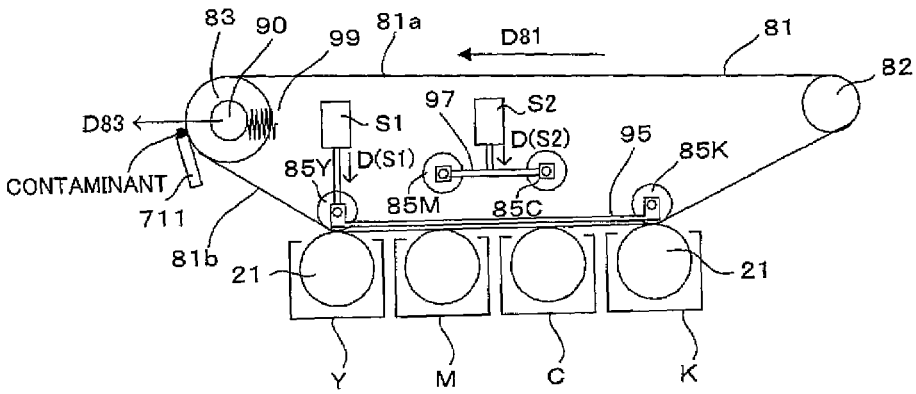
FIG. 52 is a diagram showing the operations of the apparatus of the sixteenth embodiment.
Figure 53:
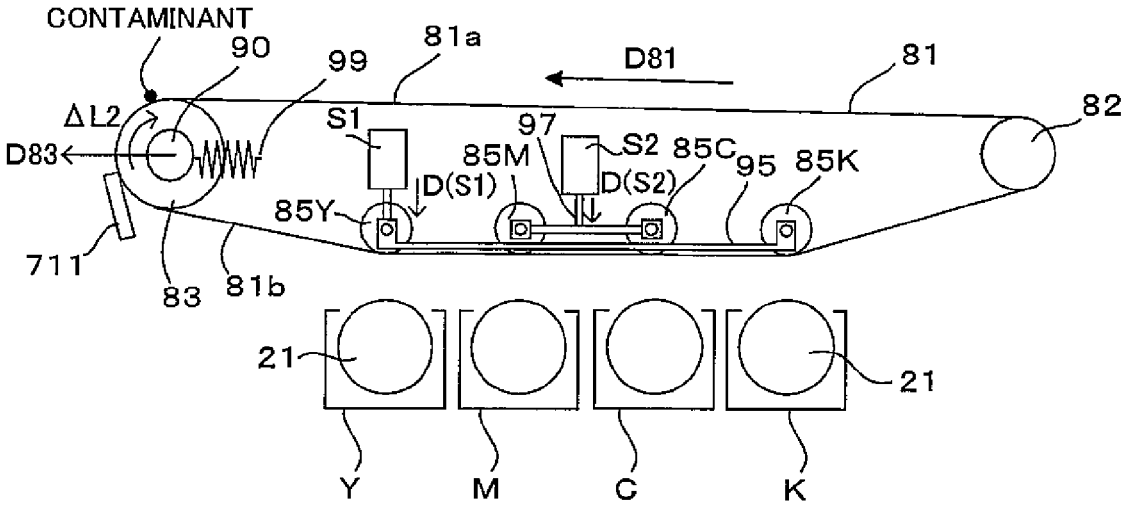
FIG. 53 is a diagram showing the operations of the apparatus of the sixteenth embodiment.

FIG. 51 to FIG. 53 are diagrams showing the operations of the apparatus of the sixteenth embodiment. In the sixteenth embodiment as well, the moving mechanism of the blade opposing roller 83 has the arrangement shown in FIG. 40, FIG. 42 and FIG. 43. That is, the movable pivots 90 and the tension springs 99 function as the "biasing member" of the invention. On the other hand, the cam controller 5290 applies a proper signal to the cam driver 5295 for pressing the peripheries of the eccentric cams 108 against the movable pivots 90, so as to press the movable pivots 90 in the opposite direction of the bias direction D83, whereby the blade opposing roller 83 is moved for the predetermined distance in the opposite direction of the bias direction D83. The blade opposing roller 83 according to the sixteenth embodiment is also biased by the tension springs 99 in the direction to be moved away from the driving roller 82 and is also adapted to reciprocate in the bias direction D83.

The cleaner blade 711 is unified with the blade opposing roller 83 and is adapted to reciprocate unitarily with the blade opposing roller 83. The apparatus of the sixteenth embodiment is constituted to omit the downstream guide roller 86 which is provided in the thirteenth and fourteenth embodiments described above. The primary transfer roller 85Y (most-upstream-transfer-member) disposed at the most upstream position in the transport direction D81 and the primary transfer roller 85K disposed at the most downstream position are rotatably supported by the first support member 95. The first support member 95 is fixedly supported by the first solenoid S1. The first solenoid S1 is electrically connected to the first solenoid controller 5260 of FIG. 38. Hence, the first support member 95 and the primary transfer rollers 85Y, 85K may be reciprocally moved in the stroke direction D(S1) of the first solenoid S1 by applying a proper signal to the first solenoid S1 from the first solenoid controller 5260.

On the other hand, two primary transfer rollers 85M, 85C of the four primary transfer rollers 85Y, 85M, 85C, 85K, except the most upstream primary transfer roller 85Y (most-upstream-transfer-member) disposed at the most upstream position in the transport direction D81 and the primary transfer roller 85K (most-downstream-transfer-member) at the most downstream position in the transport direction D81, are rotatably supported by the second support member 97. The second support member 97 is fixedly supported by the second solenoid S2. The second solenoid S2 is electrically connected to the second solenoid controller 5270 of FIG. 38. Hence, the second support member 97 and the primary transfer rollers 85M, 85C may be reciprocally moved in the stroke direction D(S2) of the second solenoid S2 by applying a proper signal to the second solenoid S2 from the second solenoid controller 5270. Thus, the first solenoid controller 5260, the second solenoid controller 5270, the cam controller 5290 and the cam driver 5295 according the sixteenth embodiment function as the "controller" of the invention.

In the sixteenth embodiment as well, the four primary transfer rollers 85Y, 85M, 85C, 85K are positioned in adjacency to the four image forming stations Y, M, C, K, so as to thrust the transfer belt 81 against the photosensitive drums 21 of the image forming stations Y, M, C, K, whereby the primary transfer positions TR1 are established, as shown in FIG. 51.

According to the sixteenth embodiment, the "releasing step" is performed as follows if it needed after the execution of the image forming operations. Specifically, two primary transfer rollers 85M, 85C are first moved away from the image forming stations M, C, before the primary transfer rollers 85Y, 85K are moved away from the image forming stations Y, K (releasing step). More specifically, except the primary transfer roller 85Y (most-upstream-transfer-member) disposed at the most upstream position in the transport direction D81 and the primary transfer roller 85K (most-downstream-transfer-member) at the most downstream position, the two primary transfer rollers 85M, 85C of the four primary transfer rollers 85Y, 85M, 85C, 85K in a state shown in FIG. 51 are moved away from the image forming stations M, C by means of the second solenoid S2. That is, the second solenoid controller 5270 (FIG. 38) outputs the releasing signal to the second solenoid S2 so as to move the two primary transfer rollers 85M, 85C away from the image forming stations M, C. At this time, as shown in FIG. 52, the transfer belt 81 is not released from the thrust-condition simply by moving the two primary transfer rollers 85M, 85C away from the image forming stations M, C. The transfer belt is still thrust against the image forming stations Y, M, C, K by means of the primary transfer rollers 85Y, 85K.

According to the sixteenth embodiment, the apparatus in the state shown in FIG. 52 operates the first solenoid controller 5260 (FIG. 38) to output the releasing signal to the first solenoid S1, thereby moving the primary transfer rollers 85Y, 85K away from the image forming stations Y, K (FIG. 53). The transfer belt 81 is released from the thrust-condition against the image forming stations Y, M, C, K only after the primary transfer rollers 85Y, 85K are moved away.

According to the sixteenth embodiment as described above, the two primary transfer rollers 85M, 85C except for the primary transfer rollers 85Y, 85K are first moved away from the image forming stations M, C, before the primary transfer rollers 85Y, 85K are moved away from the image forming stations Y, K. Therefore, the transfer belt 81 is released from the thrust-condition, in which the transfer belt 81 is thrust against the image forming stations Y, M, C, K, only after the primary transfer rollers 85Y, 85K are moved away. The primary transfer rollers 85M, 85C are already spaced away from the image forming stations M, C when the blade opposing roller 83 is allowed to move as the transfer belt 81 is released from the thrust-condition, thereby moving the transfer belt 81 away from the image forming stations Y, M, C, K. Hence, the operation of releasing the transfer belt 81 is not obstructed by the primary transfer rollers 85M, 85C. The operation of releasing the transfer belt 81 may be accomplished quickly. This permits the transfer belt 81 to be moved quickly in the opposite direction of the transport direction D81 in the contact position where the distal end of the cleaner blade 711 is contacted against the transfer belt 81. That is, the embodiment is preferred in that the contaminant adhered to the distal end of the cleaner blade 711 is more assuredly separated.

In the sixteenth embodiment as well, the above releasing step is followed by the same tension eliminating step as that of the thirteenth embodiment. Therefore, even in a case where the apparatus is not operated for image forming operations and left in shutdown for long hours, the transfer belt may be prevented from sustaining unwanted curling so that the transfer belt may be increased in service life According to the sixteenth embodiment as described above, the "releasing step" is first performed to release the transfer belt 81 from the thrust-condition, so that the transfer belt 81 is moved away as being applied with the given tension. After the transfer belt 81 is released from the thrust-condition, the "tension eliminating step" is performed to eliminate the tension of the transfer belt 81 whereby the transfer belt 81 is prevented from sustaining the unwanted curling. Thus, the embodiment not only provides the effective separation of the contaminant adhered to the distal end of the cleaner blade 711 by means of the more simplified structure, but also achieves the extended service life of the transfer belt 81. Thus, the apparatus is reduced in the cost and size.

Other Features

It is noted that the invention is not limited to the forgoing embodiments but other various modifications than the above may be made thereto so long as such modifications do not deviate from the scope of the invention. In the foregoing embodiments, for example, the image forming stations Y, M, C, K are arranged in this order from the upstream side of the transport direction D81. The sequence of image forming stations is not limited to this and may be varied as needed.

In the foregoing embodiments, the monochromatic primary transfer roller (monochromatic transfer member) and the monochromatic image forming station K are disposed at the most downstream position in the transport direction D81 of the transfer belt 81. However, the location of these components is not limited to this and these components may be disposed any other position than the most downstream position in the transport direction DS1. As described above, however, the monochromatic primary transfer roller and the monochromatic image forming station may preferably be disposed at the most downstream position in the transport direction D81 from the view point of preventing the transfer belt from abrading against the monochromatic primary transfer roller or the monochromatic image forming station K when the apparatus is switched from the color mode to the monochromatic mode.

In the foregoing embodiments, only the black toner (K) is used for forming the monochromatic images during the monochromatic mode. Alternatively, only the cyan toner (C), for example, may be used for forming the monochromatic images.

In the thrusting step of the first embodiment, the upstream three primary transfer rollers 85Y, 85M, 85C in the transport direction D81 are positioned in adjacency to the image forming stations Y, M, C, the primary transfer roller 85Y disposed at the most upstream position. However, the combination of the primary transfer rollers 85 to be positioned in adjacency to the image forming stations in the thrusting step is not limited to this. For instance, only the transfer rollers 85M, 85C may be so positioned. However, from the view point of providing, in the releasing step, a greater quantity $\Delta L2$ of movement of the transfer belt 81 in the opposite direction of the transport direction D81 in the contact position of the cleaner blade 711, it is preferred that at least the primary transfer roller 85Y at the most upstream position in the transport direction D81 is positioned in adjacency to the image forming station Y in the thrusting step and is moved away from the image forming station Y in the releasing step.

While the eighth to tenth embodiments use the four image forming stations Y, M, C, K, the number of image forming stations is not limited to this. What is needed is to use two or more image forming stations. While the eleventh embodiment uses the four image forming stations Y, M, C, K, the number of image forming stations is not limited to this. What is needed is to use three or more image forming stations.

While the eighth and tenth embodiments use the two solenoids S1, S2 for moving all the primary transfer rollers 85Y, 85M, 85C, 85K away from the image forming stations Y, M, C, K, the way to move away the primary transfer rollers is not limited to this. An alternative constitution, for example, may be made such that a single solenoid collectively moves all the primary transfer rollers 85Y, 85M, 85C, 85K away from the image forming stations Y, M, C, K.

In the eighth to twelfth embodiments, the tension springs 99 are provided in correspondence to the two movable pivots 90 disposed at the opposite ends of the blade opposing roller 83. However, the tension spring 99 may be provided at only one of the movable pivots 90. From the view point of uniformly applying the tension to the transfer belt 81, however, it is preferred to provide the tension springs 99 in correspondence to the two movable pivots 90.

In the eighth to twelfth embodiments, the "limiting member" is provided at each of the two movable pivots 90 disposed at the opposite ends of the blade opposing roller 83. However, the "limiting member" may be provided at only one of the movable pivots 90. From the view point of uniformly applying the tension to the transfer belt 81, however, it is preferred to provide the "limiting member" at each of the two movable pivots 90.

While the thirteenth to fifteenth embodiments use the four image forming stations Y, M, C, K, the number of image forming stations is not limited to this. What is needed is to use two or more image forming stations. While the sixteenth embodiment uses the four image forming stations Y, M, C, K, the number of image forming stations is not limited to this. What is needed is to use three or more image forming stations.

While the thirteenth and fifteenth embodiments use the two solenoids S1, S2 for moving all the primary transfer rollers 85Y, 85M, 85C, 85K away from the image forming stations Y, M, C, K, the way to move away the primary transfer rollers is not limited to this. An alternative constitution, for example, may be made such that a single solenoid collectively moves all the primary transfer rollers 85Y, 85M, 85C, 85K away from the image forming stations Y, M, C, K.

In the thirteenth to sixteenth embodiments, the tension spring 99 is provided at each of the two movable pivots 90 disposed at the opposite ends of the blade opposing roller 83, but the tension spring 99 may be provided at only one of the movable pivots 90. From the view point of uniformly applying the tension to the transfer belt 81, however, it is preferred to provide the tension spring 99 at each of the two movable pivots 90.

In the thirteenth to sixteenth embodiments, the eccentric cam 108 is provided at each of the two movable pivots 90 disposed at the opposite ends of the blade opposing roller 83. However, the eccentric cam 108 may be provided at only one of the movable pivots 90.

While the foregoing embodiments use the primary transfer roller, which is followingly rotatable, as the transfer member, a usable transfer member is not limited to this. A transfer member not adapted for following rotation, for example, may be used. In the case where the transfer member is the follower roller, however, the friction between the transfer belt and the transfer member (transfer roller) may be decreased when the transfer belt, as released from the thrust-condition, is moved away from the image forming stations. This permits the transfer belt to be quickly moved away. That is, this constitution is preferred in that the contaminant adhered to the distal end of the cleaner blade is more effectively separated.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention

What is claimed is:

1. An image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; and M transfer members disposed in one-on-one relation with the M image forming stations and each of which individually opposes the corresponding image forming station via the transfer belt, the image forming method comprising:

performing a color mode or a monochromatic mode, selectively, the color mode in which the transfer belt is thrust against the M image forming stations with positioning the M transfer members in adjacency to the image forming stations, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member and with moving (M−1) color transfer member(s) away from the image forming stations, the (M−1) color transfer member(s) defined by excluding the monochromatic transfer member from the M transfer members, so that only the toner image formed by the monochromatic image forming station is primarily transferred to the surface of the transfer belt to form monochromatic images;

bringing the transfer belt into a thrust-condition, as needed after completion of the monochromatic mode, with being positioned N, where N is integer which is equal to or smaller than (M−1) and which is equal to or larger than 1, color transfer member(s) out of the (M−1) color transfer members in adjacency to the image forming stations, the thrust-condition in which the transfer belt is thrust against the image forming stations; and releasing the transfer belt from the thrust-condition with moving the N color transfer member(s), which is/are positioned in adjacency to the image forming stations by the trusting, away from the image forming stations so as to bring the blade opposing roller into following rotation in the opposite direction of the transport direction as allowing the blade opposing roller to be moved in the bias direction by the biasing force of the biasing member.

2. An image forming method according to claim 1, wherein the monochromatic transfer member is one of the M transfer members which is disposed at the most downstream position in the transport direction.

3. An image forming method according to claim 2, wherein

L, where L is an integer which is equal to or smaller than (M−1) and which is equal to or larger than 1, color transfer member(s) out of the (M−1) color transfer members in adjacency to the image forming stations is positioned so as to allow the L color transfer member(s) to thrust the transfer belt against the image forming stations, the L color transfer member(s) including a most-upstream-color-transfer-member which is one of the (M−1) color transfer members disposed at the most upstream position in the transport direction, and the transfer belt is released from the thrust-condition with being moved the L color transfer member(s), positioned in adjacency to the image forming station(s) by the thrusting, away from the image forming stations so as to bring the blade opposing roller into following rotation in the opposite direction of the transport direction as allowing the blade opposing roller to be moved by the biasing force of the biasing member.

4. An image forming method according to claim 2, wherein a most-upstream-color-transfer-member, which is one of the (M−1) color transfer members and disposed at the most upstream position in the transport direction, is positioned so as to allow the most-upstream-color-transfer-member to thrust the transfer belt against the image forming stations, and the transfer belt is released from the thrust-condition with being moved the most-upstream-color-transfer-member, positioned in adjacency to the image forming station by the thrusting, away from the image forming stations so as to bring the blade opposing roller into following rotation in the opposite direction of the transport direction as allowing the blade opposing roller to be moved by the biasing force of the biasing member.

5. An image forming method according to claims 2, wherein the monochromatic transfer member is moved away from the image forming station in conjunction with being moved the color transfer members away from the image forming stations for releasing the transfer belt from the thrust-condition so as to bring the blade opposing roller into following rotation in the opposite direction of the transport direction as allowing the blade opposing roller to be moved by the biasing force of the biasing member.

6. An image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and an upstream guide roller which is disposed inside the transfer belt on the upstream side of the M transfer member and on the downstream side of the blade opposing roller in the transport direction, the image forming method comprising:

performing a color mode or a monochromatic mode, selectively, the color mode in which the transfer belt is thrust against the M image forming stations with positioning the M transfer members in adjacency to the image forming stations and with positioning the upstream guide roller so as to stretch the transfer belt by the upstream guide roller, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member, with moving (M−1) color transfer member(s) away from the image forming stations, and with moving the up stream guide roller inwardly of the transfer belt from the position in the color mode, the (M−1) color transfer member(s) defined by excluding the monochromatic transfer member from the M transfer members, so that only the toner image formed by the monochromatic image forming station is primarily transferred to the surface of the transfer belt to form monochromatic images;

bringing the transfer belt into a thrust-condition, as needed after completion of the monochromatic mode, with positioning the upstream guide roller at the position in the color mode, the thrust-condition in which the transfer belt is thrust against the image forming stations; and releasing the transfer belt from the thrust-condition with being moved the upstream guide roller, which is positioned at the position in the color mode by the thrusting, inwardly of the transfer belt from the position in the color mode so as to bring the blade opposing roller into following rotation in the opposite direction of the transport direction as allowing the blade opposing roller to be moved in the bias direction by the biasing force of the biasing member.

7. An image forming method according to claims 6, wherein the monochromatic transfer member is moved away from the image forming station in conjunction with being moved the upstream guide roller, which is positioned at the position in the color mode by the thrusting, inwardly of the transfer belt from the position in the color mode so as to bring the blade opposing roller into following rotation in the opposite direction of the transport direction as allowing the blade opposing roller to be moved by the biasing force of the biasing member.

8. An image forming apparatus comprising:

a driving roller;

a blade opposing roller which is a follower roller biased by a biasing member in a bias direction to be moved away from the driving roller and free to reciprocate in the bias direction;

a transfer belt which is stretched around at least two rollers including the driving roller and the blade opposing roller and which is rotatably transported in a predetermined transport direction;

a cleaner blade unified with the blade opposing roller for reciprocating unitarily with the blade opposing roller in the bias direction and holding whose distal end in contact against the blade opposing roller via the transfer belt so as to clean a surface of the transfer belt;

M, where M is integer which is equal to or larger than 2, image forming stations which are arranged on the downstream side of the blade opposing roller and on the upstream side of the driving roller in the transport direction and which individually form toner images of mutually different colors;

M transfer members disposed in one-on-one relation with the M image forming stations and each of which individually opposes the corresponding image forming station via the transfer belt; and a controller which controls the positions of the M transfer members, wherein the controller performing a color mode or a monochromatic mode, the color mode in which the transfer belt is thrust against the M image forming stations with positioning the M transfer members in adjacency to the image forming stations, so that the toner images formed by the M image forming stations in the mutually different colors are primarily transferred to the surface of the transfer belt in a manner to be mutually superimposed to form color images, the monochromatic mode in which the transfer belt is thrust against only a monochromatic transfer member out of the M transfer members with positioning the monochromatic transfer member in adjacency to a monochromatic image forming station opposed by the monochromatic transfer member and with moving (M−1) color transfer member(s) away from the image forming stations, the (M−1) color transfer member(s) defined by excluding the monochromatic transfer member from the M transfer members, so that only the toner image formed by the monochromatic image forming station is primarily transferred to the surface of the transfer belt to form monochromatic images, and wherein the controller brings the transfer belt into a thrust-condition, as needed after completion of the monochromatic mode, with positioning N, where N is integer which is equal to or smaller than M−1 and which is equal to or larger than 1, color transfer member(s) out of the (M−1) color transfer members in adjacency to the image forming stations, the thrust-condition in which the transfer belt is thrust against the image forming stations, and the controller releases the transfer belt from the thrust-condition with moving the N color transfer member(s), which is/are positioned in adjacency to the image forming stations by the thrusting, away from the image forming stations so as to bring the blade opposing roller into following rotation in the opposite direction of the transport direction as allowing the blade opposing roller to be moved in the bias direction by the biasing force of the biasing member.

9. An image forming apparatus comprising:

a driving roller;

a blade opposing roller which is a follower roller biased by a biasing member in a bias direction to be moved away from the driving roller and free to reciprocate in the bias direction;

a transfer belt which is stretched around at least two rollers including the driving roller and the blade opposing roller and which is rotatably transported in a predetermined transport direction;

a cleaner blade which is unified with the blade opposing roller for reciprocating unitarily with the blade opposing roller in the bias direction and holding whose distal end in contact against the blade opposing roller via the transfer belt so as to clean a surface of the transfer belt;

M, where M is integer which is equal to or larger than 2, image forming stations which are arranged on the downstream side of the blade opposing roller and on the upstream side of the driving roller in the transport direction and which individually form toner images of mutually different colors;

M transfer members disposed in one-on-one relation with the M image forming stations and each of which individually opposes the corresponding image forming station via the transfer belt;

a positioner which brings the transfer belt into a thrust-condition with positioning the M transfer members in adjacency to the image forming stations, the thrust-condition in which the transfer belt is thrust against the image forming stations when the images of all the M image forming stations primarily transferred onto the surface of the transfer belt, and which releases the transfer belt from the thrust-condition, as needed, with moving the M transfer member from the image forming stations; and a limiting member which acts against a biasing force of the biasing member to prevent the blade opposing roller from moving in the bias direction, wherein the blade opposing roller is moved by the biasing force in the bias direction as applying tension to the transfer belt and is followingly rotated in the opposite direction of the transport direction in conjunction with the transfer belt being released form the thrust-condition with the M transfer members moved away from the image forming stations by the positioner, and the limiting member restricts the movement of the blade opposing roller in the bias direction so as to decrease the tension applied to the transfer belt by the blade opposing roller, when the blade opposing roller moves for a predetermined distance or more in the bias direction in conjunction with the transfer belt released form thrust-condition.

10. An image forming apparatus according to claim 9, further comprising a downstream guide roller which is disposed inside the transfer belt on the upstream side of the driving roller and on the downstream side of the M transfer members in the transfer direction and which stretches the transfer belt when the images of the M image forming stations primarily transferred onto the surface of the transfer belt, wherein the positioner releases the transfer belt from the thrust-condition, as needed, with moving the M transfer member from the image forming stations and moving the downstream guide roller inwardly of the transfer belt, and the blade opposing roller is moved by the biasing force in the bias direction as applying tension to the transfer belt and is followingly rotated in the opposite direction of the transport direction in conjunction with the transfer belt being released form the thrust-condition with the M transfer members moved away from the image forming stations and downstream guide roller moved inwardly of the transfer belt by the positioner.

11. An image forming apparatus according to claim 9, further comprising a downstream guide roller which is disposed inside the transfer belt on the upstream side of the driving roller and on the downstream side of the M transfer members in the transfer direction and which stretches the transfer belt when the images of the M image forming stations primarily transferred onto the surface of the transfer belt, wherein the positioner releases the transfer belt from the thrust-condition, as needed, with moving a most-upstream-transfer-member away from the image forming stations and moving the downstream guide roller inwardly of the transfer belt after moving (M−1) transfer member(s) away from the image forming stations, the most-upstream-transfer-member being one of the M transfer members disposed at the most upstream position in the transport direction, the (M−1) transfer member(s) defined by excluding the most-upstream-transfer-member from the M transfer members, and the blade opposing roller is moved by the biasing force in the bias direction as applying tension to the transfer belt and is followingly rotated in the opposite direction of the transport direction in conjunction with the transfer belt being released form the thrust-condition with the most-upstream-transfer-member moved away from the image forming stations and the downstream guide roller moved inwardly of the transfer belt by the positioner.

12. An image forming apparatus comprising:

a driving roller;

a blade opposing roller which is a follower roller biased by a biasing member in a bias direction to be moved away from the driving roller and free to reciprocate in the bias direction;

a transfer belt which is stretched around at least two rollers including the driving roller and the blade opposing roller and which is rotatably transported in a predetermined transport direction;

a cleaner blade which is unified with the blade opposing roller for reciprocating unitarily with the blade opposing roller in the bias direction and holding whose distal end in contact against the blade opposing roller via the transfer belt so as to clean a surface of the transfer belt;

K, where K is integer which is equal to or larger than 3, image forming stations which are arranged on the downstream side of the blade opposing roller and on the upstream side of the driving roller in the transport direction and which individually form toner images of mutually different colors;

K transfer members disposed in one-on-one relation with the K image forming stations and each of which individually opposes the corresponding image forming station via the transfer belt;

a positioner which brings the transfer belt into a thrust-condition with positioning the K transfer members in adjacency to the image forming stations, the thrust-condition in which the transfer belt is thrust against the image forming stations when the images of all the K image forming stations primarily transferred onto the surface of the transfer belt, and which releases the transfer belt from the thrust-condition, as needed, with moving a most-upstream-transfer-member and a most-downstream-transfer-member away from the image forming stations after moving the (K-2) transfer member from the image forming stations, the most-upstream-transfer-member being one of the K transfer members disposed at the most upstream position in the transport direction, the most-downstream-transfer-member being one of the K transfer members disposed at the most downstream position in the transport direction, the (K-2) transfer member(s) defined by excluding the most-upstream-transfer-member and the most-downstream-transfer-member from the K transfer members; and a limiting member which acts against a biasing force of the biasing member to prevent the blade opposing roller from moving in the bias direction, wherein the blade opposing roller is moved by the biasing force in the bias direction as applying tension to the transfer belt and is followingly rotated in the opposite direction of the transport direction in conjunction with the transfer belt being released form the thrust-condition with the most-upstream-transfer-member and most-downstream-transfer-member moved away from the image forming stations by the positioner, the limiting member restricts the movement of the blade opposing roller in the bias direction so as to decrease the tension applied to the transfer belt by the blade opposing roller, when the blade opposing roller moves for a predetermined distance or more in the bias direction in conjunction with the transfer belt released form thrust-condition.

13. An image forming apparatus according to claim 9, wherein the biasing member has a movable pivot disposed at end of the blade opposing roller so that the blade opposing roller pivotably rotates around the movable pivot, the movable pivot free to reciprocate in the bias direction; and tension spring biases the movable pivot in the bias direction to move away from the driving roller, the biasing member using the tension springs to bias the movable pivot in the bias direction so as to bias the blade opposing roller in the bias direction, and the limiting member has a abutment member fixed to a place spaced from the location of the movable pivots by a predetermined distance in the bias direction in a state where the M transfer members are positioned in adjacency to the image forming stations, so that the movable pivot abuts against the abutment member to decrease the tension applied to the transfer belt by the blade opposing roller when the blade opposing roller is moved for the predetermined distance in conjunction with the transfer belt being released form the thrust-condition.

14. An image forming apparatus according to claim 9, wherein the biasing member has a movable pivot disposed at end of the blade opposing roller so that the blade opposing roller pivotably rotates around the movable pivot, the movable pivot free to reciprocate in the bias direction; and tension spring biases the movable pivot in the bias direction to move away from the driving roller, the biasing member using the tension springs to bias the movable pivot in the bias direction so as to bias the blade opposing roller in the bias direction, and the limiting member has a movable abutment member free to reciprocate in the bias direction as disposed at places spaced from the locations of the movable pivot by a predetermined distance in the bias in a state where the M transfer members are positioned in adjacency to the image forming stations; and a compression spring disposed at places downstream from the movable abutment member in the bias direction, so that the movable pivot abuts against the abutment member and applied a reaction force in the opposite direction of the bias direction by means of the compression springs to restrict the movement of the blade opposing roller in the bias direction for decreasing the tension applied to the transfer belt by the blade opposing roller when the blade opposing roller is moved for the predetermined distance in conjunction with the transfer belt being released form the thrust-condition.

15. An image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; and M transfer members disposed in one-on-one relation with the M image forming stations and each of which individually opposes the corresponding image forming station via the transfer belt, the image forming method comprising:

bringing the transfer belt into the thrust-condition, in which the transfer belt is thrust against the image forming stations, with positioning the M transfer members in adjacency to the image forming stations, so that the toner images formed by the M image forming stations in the mutually different colors are primarily transferred to the surface of the transfer belt in a manner to be mutually superimposed to form color images;

releasing the transfer belt from the thrust-condition, as needed, with moving the M transfer member away from the image forming stations so as to bring the blade opposing roller into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

16. An image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; M, where M is integer which is equal to or larger than 2, image forming stations which are arranged on the downstream side of the blade opposing roller and on the upstream side of the driving roller in the transport direction and which individually form toner images of mutually different colors; M transfer members disposed in one-on-one relation with the M image forming stations and each of which individually opposes the corresponding image forming station via the transfer belt; and a downstream guide roller which is disposed inside the transfer belt on the upstream side of the driving roller and on the downstream side of the M transfer members in the transfer direction, the image forming method comprising:

bringing the transfer belt into the thrust-condition, in which the transfer belt is thrust against the image forming stations, with positioning the M transfer members in adjacency to the image forming stations and allowing the downstream guide roller stretch the transfer belt, so that the toner images formed by the M image forming stations in the mutually different colors are primarily transferred to the surface of the transfer belt in a manner to be mutually superimposed to form color images;

releasing the transfer belt from the thrust-condition, as needed, with moving the M transfer member away from the image forming stations and moving the downstream guide roller inwardly of the transfer belt so as to bring the blade opposing roller into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

17. An image forming method according to claim 16, wherein a most-upstream-transfer-member, which is one of the M transfer members and disposed at the most upstream position in the transport direction, is moved away from the image forming stations and the downstream guide roller is moved inwardly of the transfer belt, after moving (M−1) transfer member(s) away from the image forming stations, the (M−1) transfer member(s) defined by excluding the most-upstream-transfer member from the M transfer members.

18. An image forming method using an image forming apparatus which includes: a driving roller; a blade opposing roller which is a follower roller biased by a biasing member in a bias direction to be moved away from the driving roller and free to reciprocate in the bias direction; a transfer belt which is stretched around at least two rollers including the driving roller and the blade opposing roller and which is rotatably transported in a predetermined transport direction; a cleaner blade unified with the blade opposing roller for reciprocating unitarily with the blade opposing roller in the bias direction and holding whose distal end in contact against the blade opposing roller via the transfer belt so as to clean a surface of the transfer belt; K, where K is integer which is equal to or larger than 3, image forming stations which are arranged on the downstream side of the blade opposing roller and on the upstream side of the driving roller in the transport direction and which individually form toner images of mutually different colors; and K transfer members disposed in one-on-one relation with the K image forming stations and each of which individually opposes the corresponding image forming station via the transfer belt, the image forming method comprising:

bringing the transfer belt into the thrust-condition, in which the transfer belt is thrust against the image forming stations, with positioning the K transfer members in adjacency to the image forming stations, so that the toner images formed by the K image forming stations in the mutually different colors are primarily transferred to the surface of the transfer belt in a manner to be mutually superimposed to form color images;

releasing the transfer belt from the thrust-condition, as needed after the image forming, with moving a most-upstream-transfer-member and a most-downstream-transfer-member away from the image forming stations after moving the (K-2) transfer member from the image forming stations, the most-upstream-transfer-member being one of the K transfer members disposed at the most upstream position in the transport direction, the most-downstream-transfer-member being one of the K transfer members disposed at the most downstream position in the transport direction, the (K-2) transfer member(s) defined by excluding the most-upstream-transfer-member and the most-downstream-transfer-member from the K transfer members, so that the blade opposing roller is brought into following rotation in the opposite direction of the transport direction as allowing the blade opposing roller to be moved in the bias direction by the biasing force of the biasing member; and eliminating the tension of the transfer belt applied by the blade opposing roller, after the releasing, with moving the blade opposing roller for a predetermined distance in the opposite direction of the bias direction.

19. An image forming apparatus comprising:

a driving roller;

a blade opposing roller which is a follower roller biased by a biasing member in a bias direction to be moved away from the driving roller and free to reciprocate in the bias direction;

a transfer belt which is stretched around at least two rollers including the driving roller and the blade opposing roller and which is rotatably transported in a predetermined transport direction;

a cleaner blade which is unified with the blade opposing roller for reciprocating unitarily with the blade opposing roller in the bias direction and holding whose distal end in contact against the blade opposing roller via the transfer belt so as to clean a surface of the transfer belt;

M, where M is integer which is equal to or larger than 2, image forming stations which are arranged on the downstream side of the blade opposing roller and on the upstream side of the driving roller in the transport direction and which individually form toner images of mutually different colors;

M transfer members disposed in one-on-one relation with the M image forming stations and each of which individually opposes the corresponding image forming station via the transfer belt; and a controller which controls the positions of the M transfer members and the blade opposing roller, wherein the controller brings the transfer belt into the thrust-condition, in which the transfer belt is thrust against the image forming stations, with positioning the M transfer members in adjacency to the image forming stations, so that the toner images formed by the M image forming stations in the mutually different colors are primarily transferred to the surface of the transfer belt in a manner to be mutually superimposed to form color images, and as needed, the controller releases the transfer belt from the thrust-condition with moving the M transfer member away from the image forming stations so as to bring the blade opposing roller into following rotation in the opposite direction of the transport direction as allowing the blade opposing roller to be moved in the bias direction by the biasing force of the biasing member, and then eliminates the tension of the transfer belt applied by the blade opposing roller with moving the blade opposing roller for a predetermined distance in the opposite direction of the bias direction.

* * * * *